US012305407B2

(12) United States Patent
Kressin et al.

(10) Patent No.: US 12,305,407 B2
(45) Date of Patent: May 20, 2025

(54) DECORATIVE MOULDING ASSEMBLY AND METHOD OF MANUFACTURING AND ASSEMBLING THE SAME

(71) Applicant: MCS Industries, Inc., Easton, PA (US)

(72) Inventors: Matthew Scott Kressin, Allentown, PA (US); Martin Zamorano Fragoso, Chihuahua (MX); Robert Terry Coyle, Jr., Palmer, PA (US)

(73) Assignee: MCS Industries, Inc., Easton, PA (US)

( * ) Notice: Subject to any disclaimer, the term of this patent is extended or adjusted under 35 U.S.C. 154(b) by 451 days.

(21) Appl. No.: 17/584,784

(22) Filed: Jan. 26, 2022

(65) Prior Publication Data

US 2023/0235575 A1 Jul. 27, 2023

(51) Int. Cl.
*E04F 19/02* (2006.01)
*E04B 1/58* (2006.01)

(52) U.S. Cl.
CPC ..... *E04F 19/02* (2013.01); *E04B 1/5825* (2013.01); *E04B 2001/5856* (2013.01)

(58) Field of Classification Search
CPC ..... E04F 19/02; E04F 19/0486; E04F 19/083; E04B 1/5806; E04B 1/5818; E04B 2001/5856; A47G 1/101; A47G 1/0611; E06B 3/96; E06B 3/964; E06B 3/9644; E06B 3/9645; E06B 3/9682; F16B 2012/446; F16B 2200/67
See application file for complete search history.

(56) References Cited

U.S. PATENT DOCUMENTS

| | | | |
|---|---|---|---|
| 2,204,862 | A | 12/1937 | Lehman |
| 2,270,796 | A | 1/1942 | Hauser |
| 2,447,346 | A | 8/1945 | Krantz |
| 2,639,109 | A | 3/1949 | Hoag |
| 2,857,635 | A | 12/1956 | Maple et al. |

(Continued)

FOREIGN PATENT DOCUMENTS

| | | | |
|---|---|---|---|
| CN | 204370772 | U | 6/2015 |
| CN | 207499301 | U | 6/2018 |

(Continued)

OTHER PUBLICATIONS

Columbia Frame, Instructions to hang mirrow over the door, Columbia Frame Inc., 6251, rue Notre-Dame, Montreal, Quebec H1N 2E9, Nov. 23, 2005.

(Continued)

*Primary Examiner* — Ryan D Kwiecinski
(74) *Attorney, Agent, or Firm* — The Belles Group, P.C.

(57) ABSTRACT

A decorative moulding assembly for a wall or ceiling in an interior space. The decorative moulding assembly may include a first moulding piece and a second moulding piece each having an ornamental front surface, a rear surface, and a channel in the rear surface and a connector for connecting the first and second moulding pieces together. The connector may include a first portion that nests within the channel of the first moulding piece and a second portion that nests within the channel of the second moulding piece. The first portion of the connector may include a U-shaped body having first and second legs that deflect inwardly towards one another as the first portion of the connector is being inserted into the first channel of the first moulding piece.

16 Claims, 50 Drawing Sheets

(56) References Cited

U.S. PATENT DOCUMENTS

| | | | | |
|---|---|---|---|---|
| 3,034,612 | A * | 5/1962 | Jourdan | E06B 3/9685 160/381 |
| 3,200,913 | A | 8/1965 | Nelson | |
| 3,224,715 | A | 12/1965 | Maggiore | |
| 3,384,987 | A | 5/1968 | Prechtl | |
| 3,707,061 | A | 12/1972 | Collette et al. | |
| 4,024,691 | A * | 5/1977 | Hansen | E06B 3/9645 403/402 |
| 4,035,979 | A | 7/1977 | Koreska | |
| 4,216,597 | A | 8/1980 | Kocina et al. | |
| 4,336,645 | A | 6/1982 | Bucci | |
| 4,466,591 | A | 8/1984 | Alonzo | |
| 4,496,128 | A | 1/1985 | Larsen | |
| 4,531,315 | A | 7/1985 | Sobel | |
| 4,557,457 | A | 12/1985 | Cockfield | |
| 4,611,780 | A | 9/1986 | Robertson | |
| 4,862,612 | A * | 9/1989 | Sugihara | A47G 1/101 403/402 |
| 4,922,638 | A * | 5/1990 | Litvak | A47G 1/10 40/783 |
| 4,979,323 | A | 12/1990 | Wenkman et al. | |
| 5,076,736 | A | 12/1991 | Grewe | |
| 5,189,820 | A * | 3/1993 | Komamura | A47G 1/0611 16/355 |
| 5,413,297 | A | 5/1995 | Adams | |
| 5,454,542 | A | 10/1995 | Hart | |
| 5,457,923 | A | 10/1995 | Logan et al. | |
| 5,485,932 | A | 1/1996 | Romm et al. | |
| 5,645,178 | A | 7/1997 | Conley | |
| 5,695,073 | A | 12/1997 | Klein et al. | |
| 5,701,697 | A | 12/1997 | Komamura | |
| 5,810,304 | A | 9/1998 | Lehrman | |
| 5,820,292 | A * | 10/1998 | Fremstad | A47G 1/102 403/321 |
| 5,855,279 | A | 1/1999 | Klein et al. | |
| 5,950,337 | A | 9/1999 | Lehrman | |
| 6,138,841 | A | 10/2000 | Klein | |
| 6,223,914 | B1 | 5/2001 | Snell | |
| 6,299,118 | B1 | 10/2001 | Farrell | |
| 6,311,851 | B1 | 11/2001 | Knudsen, Sr. et al. | |
| 6,575,416 | B1 | 6/2003 | Avinger | |
| 6,746,175 | B1 * | 6/2004 | Gonnerman | E06B 3/962 403/403 |
| 6,854,610 | B2 | 2/2005 | Adams | |
| 6,857,528 | B2 | 2/2005 | Klein et al. | |
| 6,857,608 | B2 | 2/2005 | Avinger | |
| 7,097,048 | B2 | 8/2006 | Rimback et al. | |
| D531,017 | S | 10/2006 | Debevec et al. | |
| 7,185,864 | B2 | 3/2007 | Adams | |
| 7,188,741 | B1 | 3/2007 | Abdi et al. | |
| 7,207,088 | B2 | 4/2007 | Adams et al. | |
| RE39,638 | E | 5/2007 | Klein et al. | |
| 7,234,671 | B2 | 6/2007 | Avinger | |
| D551,959 | S | 10/2007 | Hargins | |
| 7,309,053 | B2 | 12/2007 | Lin | |
| D568,725 | S | 5/2008 | Snider | |
| 7,654,500 | B1 | 2/2010 | Jump | |
| 7,770,315 | B2 * | 8/2010 | Bauer | A47G 1/10 40/784 |
| 7,784,233 | B2 | 8/2010 | Friedlich | |
| 7,828,144 | B2 | 11/2010 | Bentley et al. | |
| 7,891,124 | B1 | 2/2011 | Willis | |
| 7,992,833 | B1 | 8/2011 | Goodman et al. | |
| 8,353,490 | B2 | 1/2013 | Spinelli | |
| 8,387,838 | B2 | 3/2013 | Adams et al. | |
| 8,534,627 | B2 | 9/2013 | Kressin | |
| 8,596,017 | B2 | 12/2013 | Emanuel | |
| 8,746,644 | B2 | 6/2014 | Kressin | |
| 9,060,627 | B2 | 6/2015 | Kressin | |
| 9,279,538 | B1 | 3/2016 | Wening | |
| 9,380,891 | B2 | 7/2016 | Wittenberg et al. | |
| 9,386,867 | B2 | 7/2016 | Kressin | |
| 9,392,889 | B2 | 7/2016 | Trainor-Smith et al. | |
| 9,480,350 | B2 | 11/2016 | Kressin | |
| D791,578 | S | 7/2017 | Royak | |
| 9,801,478 | B1 | 10/2017 | Kressin et al. | |
| 10,039,394 | B2 | 8/2018 | Pyle | |
| 10,080,448 | B2 | 9/2018 | Kressin | |
| 10,238,221 | B2 | 3/2019 | Kressin | |
| 10,549,573 | B2 | 2/2020 | Boychuk | |
| 10,681,995 | B2 | 6/2020 | Pyle et al. | |
| 2003/0201291 | A1 | 10/2003 | Kestler | |
| 2004/0173550 | A1 | 9/2004 | Adams | |
| 2005/0189458 | A1 | 9/2005 | Avinger | |
| 2007/0001088 | A1 | 1/2007 | Bowman | |
| 2008/0098664 | A1 | 5/2008 | McGregor | |
| 2008/0110777 | A1 | 5/2008 | Bentley et al. | |
| 2008/0185299 | A1 | 8/2008 | Thorman | |
| 2008/0185353 | A1 | 8/2008 | Immerman et al. | |
| 2008/0245751 | A1 | 10/2008 | Moran | |
| 2009/0165319 | A1 | 7/2009 | Gallien | |
| 2009/0199783 | A1 | 8/2009 | Wilmore | |
| 2010/0308193 | A1 | 12/2010 | Bonshor | |
| 2011/0168858 | A1 | 7/2011 | Mears | |
| 2011/0252680 | A1 | 10/2011 | Pitcher et al. | |
| 2011/0253755 | A1 | 10/2011 | Adams et al. | |
| 2011/0284707 | A1 | 11/2011 | Adams et al. | |
| 2012/0251988 | A1 | 10/2012 | Moffatt | |
| 2014/0034801 | A1 | 2/2014 | Kim | |
| 2014/0356051 | A1 * | 12/2014 | Korb | F16B 12/40 403/205 |
| 2017/0035223 | A1 | 2/2017 | Kressin et al. | |
| 2017/0055728 | A1 | 3/2017 | Krake et al. | |
| 2017/0055729 | A1 | 3/2017 | Krake et al. | |
| 2017/0055730 | A1 | 3/2017 | Krake et al. | |
| 2017/0055732 | A1 | 3/2017 | Krake et al. | |
| 2017/0202374 | A1 | 7/2017 | Kressin et al. | |
| 2017/0367506 | A1 | 12/2017 | Pyle et al. | |
| 2019/0082863 | A1 | 3/2019 | Kressin et al. | |
| 2019/0116995 | A1 * | 4/2019 | Udermann | A47G 1/10 |
| 2023/0235575 | A1 * | 7/2023 | Kressin | E04B 1/5825 52/311.2 |

FOREIGN PATENT DOCUMENTS

| | | | | |
|---|---|---|---|---|
| DE | 102012023546 | | 6/2014 | |
| EP | 2568104 | A1 | 3/2013 | |
| FR | 2659372 | A1 | 9/1991 | |
| JP | 2004324374 | | 11/2004 | |
| JP | 2004324374 | A * | 11/2004 | |
| JP | 2017140576 | | 8/2017 | |
| WO | WO2005038273 | A2 | 4/2005 | |
| WO | WO2009035502 | A1 | 3/2009 | |
| WO | WO2012141780 | A2 | 10/2012 | |
| WO | WO2012141782 | A2 | 10/2012 | |
| WO | WO-2017176135 | A1 * | 10/2017 | A47B 47/0008 |

OTHER PUBLICATIONS

Alibaba Group, Cute Stainless Steel Over The Door Dual Hanger Hook Hat Coat Holder Worldwide Store, website www/aliexpress.com, printed Oct. 4, 2016. US.

Aliexpress, Fashion Brand Wall Hanger Hooks Rose Leaves Metal Over Door Kitchen Bathroom For Coat Hat Towel Holder, website www.aliexpress.com, printed Oct. 4, 2016. US.

Aliexpress, Over Door Bathroom Hanger Coat Clothes Hat Bag Towel Hanging Rack Holder—7 Hooks, website www.aliexpress.com, printed Oct. 4, 2016. US.

Iron Accents, Discover decorating with wrought iron flair!; Wire Mesh Wall Mirror Center, website: https://www.ironaccents.com/19-cq7241.html, Printed Nov. 15, 2018 US.

Vintage. Brass Wire Mesh Mirror, 1950s, Website: https://www.vntg.com/70801/brass-wire-mesh-mirror-1950s. Printed Nov. 15, 2018 Germany.

West Elm, Entryway Mirror and Hooks, Website: https://www.westelm.com/products/entryway-mirror-hooks-d3047/, Printed Nov. 15, 2018 US.

Target, Rectangle Entryway Decorative Wall Mirror with Hooks—Threshold. Website: https://www.target.com/p/rectangle-entryway-decorative-wall-mirror-with-hooks-threshold-153/-/A-50362224. Printed Nov. 15, 2018 US.

(56) References Cited

OTHER PUBLICATIONS

West Elm, Entryway Mirror and Hooks—Large. Website: https://www.westelm.com/products/entryway-mirror-hooks-large-d3050/. Printed Nov. 15, 2018 US.
Gallery Perfect, Photo Frame Wall Gallery Kit, https://www.amazon.com/GALLERY-PERFECT-Piece-Gallery-13FW2901/dp/B00MFL5TOY, Website, Amazon.com. US.
At Home Frame Images Aug. 15, 2017, pp. 1-9.
Amazon Website: Focal Point Dover Small Decorative Corners Panel Molding Kit, https://www.amazon.com/System-Decorative-Corners-Polyurethane-Moulding/dp/B07C7RQVZH., Retrieved Dec. 16, 2021., pp. 1-4.
Focal Point Products Website: https://www.focalpointproducts.com/other-products/panel-moulding-kits.html., Retrieved Dec. 16, 2021., pp. 1-3.

* cited by examiner

DECORATIVE MOULDING ASSEMBLY AND METHOD OF MANUFACTURING AND ASSEMBLING THE SAME

BACKGROUND OF THE INVENTION

Decorative mouldings are used in interior spaces to provide wall or ceiling surfaces with texture, color contrasts, or other decorative features. Homeowners may hire a carpenter or handyman to create a custom decorative moulding design. Alternatively, there are some kits that enable a homeowner to attach frame parts together to create a desired aesthetic design, which can then be mounted to the wall or ceiling. However, such kits are difficult to use by the average homeowner, which can be a source of frustration and may result in the homeowner creating a design that is less than desirable. Thus, a need exists for a decorative moulding assembly that is easy to assemble and mount to make such decorative mouldings more accessible to the everyday homeowner.

SUMMARY OF THE INVENTION

The present invention is directed to a decorative moulding assembly or kit which enables a user to easily and readily fit several pieces of a moulding together into a chosen design and then hang the final product on a wall. The decorative moulding assembly may include multiple moulding pieces with interior channels that are configured to receive a connector. The connector may be snap-fit or press-fit connected to the channels of the various moulding pieces in order to couple the moulding pieces together. In some embodiments, the moulding pieces that are coupled together are both, or all, extruded. In other embodiments, the moulding pieces that are coupled together may include one extruded part and one molded part. Various different connectors and connection techniques may be used depending on the material of construction for the moulding pieces.

In one aspect, the invention may be a decorative moulding assembly comprising: a first moulding piece comprising a first end, a second end, an ornamental front surface, and a rear surface, a first channel formed into the rear surface and extending from the first end to the second end, the first channel having a U-shaped cross-sectional area; a second moulding piece comprising a first end, a second end, an ornamental front surface, and a rear surface, a second channel formed into the rear surface and extending from the first end to the second end, the second channel having a U-shaped cross-sectional area; and a connector comprising a first elongated portion and a second elongated portion that intersect in an L-shape, each of the first and second elongated portions comprising a U-shaped body, wherein the first elongated portion of the connector nests within the first channel of the first moulding piece and the second elongated portion of the connector nests within the second channel of the second moulding piece to couple the connector to the first and second moulding pieces, which couples the first and second moulding pieces together.

In another aspect, the invention may be a decorative moulding assembly comprising: a first moulding piece comprising an ornamental front surface and a rear surface, a first channel formed into the rear surface, the first channel having a U-shaped cross-sectional area and a first engagement feature; a second moulding piece comprising an ornamental front surface and a rear surface, a second channel formed into the rear surface, the second channel having a U-shaped cross-sectional area and a second engagement feature; and a connector comprising a first elongated portion and a second elongated portion that intersect in an L-shape, the first elongated portion having a U-shaped body comprising first and second legs that are spaced apart from one another by a third channel and the second elongated portion having a U-shaped body comprising first and second legs that are spaced apart from one another by a fourth channel, the first elongated portion comprising a third engagement feature and the fourth elongated portion comprising a fourth engagement feature; wherein the first elongated portion of the connector is snap-fit connected to the first moulding piece by inserting the first elongated portion into the first channel during which the first and second legs of the first elongated portion flex inwardly towards one another and into the third channel until the third engagement feature of the first elongated portion mates with the first engagement feature of the first channel of the first moulding piece; and wherein the second elongated portion of the connector is snap-fit connected to the second moulding piece by inserting the second elongated portion into the second channel during which the first and second legs of the second elongated portion flex inwardly towards one another and into the fourth channel until the fourth engagement feature of the second elongated portion mates with the second engagement feature of the second channel of the second moulding piece.

In yet another aspect, the invention may be a method of manufacturing and assembling a decorative moulding, the method comprising: extruding a first moulding piece comprising an ornamental front surface and a rear surface having a first channel with a first engagement feature; extruding a second moulding piece comprising an ornamental front surface and a rear surface having a second channel with a second engagement feature; injection molding a connector comprising a first elongated portion and a second elongated portion that intersect in an L-shape, the first elongated portion comprising a third engagement feature and the second elongated portion comprising a fourth engagement feature; inserting the first elongated portion of the connector into the first channel of the first moulding piece until the third engagement feature of the first elongated portion of the connector mates with the first engagement feature of the first channel of the first moulding piece to snap-fit connect the first elongated portion of the connector to the first moulding piece; and inserting the second elongated portion of the connector into the second channel of the second moulding piece until the fourth engagement feature of the second elongated portion of the connector mates with the second engagement feature of the second channel of the second moulding piece to snap-fit connect the second elongated portion of the connector to the second moulding piece, thereby coupling the first and second moulding pieces together.

In still another embodiment, the invention may be a decorative moulding assembly comprising: a first moulding piece comprising an ornamental front surface and a rear surface, a first channel formed into the rear surface; a second moulding piece comprising an ornamental front surface and a rear surface, a second channel formed into the rear surface; a connector comprising: a first portion that nests within the first channel of the first moulding piece to couple the connector to the first moulding piece; and a second portion that nests within the second channel of the second moulding piece to couple the connector to the second moulding piece; and wherein the first portion of the connector comprises a U-shaped body comprising first and second legs that deflect inwardly towards one another as the first portion of the connector is being inserted into the first channel of the first moulding piece.

In a further embodiment, the invention may be a decorative moulding assembly comprising: a first moulding piece comprising an ornamental front surface and a rear surface, a first channel formed into the rear surface, the first channel comprising a first engagement feature; a second moulding piece comprising an ornamental front surface and a rear surface, a second channel formed into the rear surface, the second channel comprising a second engagement feature; a connector comprising: a first portion that nests within the first channel of the first moulding piece, the first portion having a third engagement feature that mates with the first engagement feature of the first channel to couple the connector to the first moulding piece; and a second portion that nests within the second channel of the second moulding piece, the second portion having a fourth engagement feature that mates with the second engagement feature of the second channel to couple the connector to the second moulding piece; and wherein the first and second engagement features are different from one another, and wherein the third and fourth engagement features are different from one another.

In a still further embodiment, the invention may be a decorative moulding assembly comprising: a first moulding piece comprising an ornamental front surface and a rear surface, a first channel formed into the rear surface; a second moulding piece comprising an ornamental front surface and a rear surface, a second channel formed into the rear surface; a connector comprising: a first portion that nests within the first channel of the first moulding piece, the first portion having a first shape; and a second portion that nests within the second channel of the second moulding piece, the second portion having a second shape that is different than the first shape.

In yet another embodiment, the invention may be a method of manufacturing and assembling a decorative moulding, the method comprising: extruding a first moulding piece comprising an ornamental front surface and a rear surface having a first channel with a first engagement; injection molding a second moulding piece comprising an ornamental front surface and a rear surface having a second channel with a second engagement; providing a connector comprising a first elongated portion and a second elongated portion, the first elongated portion comprising a third engagement feature and the second elongated portion comprising a fourth engagement feature; inserting the first elongated portion of the connector into the first channel of the first moulding piece until the third engagement feature of the first elongated portion of the connector mates with the first engagement feature of the first channel of the first moulding piece to snap-fit connect the first elongated portion of the connector to the first moulding piece; and inserting the second elongated portion of the connector into the second channel of the second moulding piece until the fourth engagement feature of the second elongated portion of the connector mates with the second engagement feature of the second channel of the second moulding piece to press-fit connect the second elongated portion of the connector to the second moulding piece, thereby coupling the first and second moulding pieces together.

In still another embodiment, the invention may be a decorative moulding assembly comprising: a first moulding piece comprising an ornamental front surface and a rear surface, a first channel formed into the rear surface, the channel comprising a first engagement feature; a second moulding piece comprising an ornamental front surface and a rear surface, and a second channel formed into the rear surface that extends along a second channel axis, the second moulding piece comprising a first wall and a second wall that extend transversely across the second channel, the first and second walls being spaced apart by a gap; a connector comprising: a first portion that nests within the first channel of the first moulding piece, the first portion having a second engagement feature that mates with the first engagement feature to couple the connector to the first moulding piece; and a second portion that nests within the gap between the first and second walls to couple the connector to the second moulding piece.

In a further embodiment, the invention may be a decorative moulding assembly comprising: a first moulding piece comprising an ornamental front surface and a rear surface, a first channel formed into the rear surface, the first channel comprising a first engagement feature; a second moulding piece comprising a first end surface, a second end surface, an ornamental front surface, a rear surface, and a connector coupled to and extending from at least one of the first and second end surfaces, the connector comprising a second engagement feature; and wherein the connector nests within the first channel of the first moulding piece and the second engagement feature of the connector mates with the first engagement feature of the channel of the first moulding piece to couple the first moulding piece to the second moulding piece.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
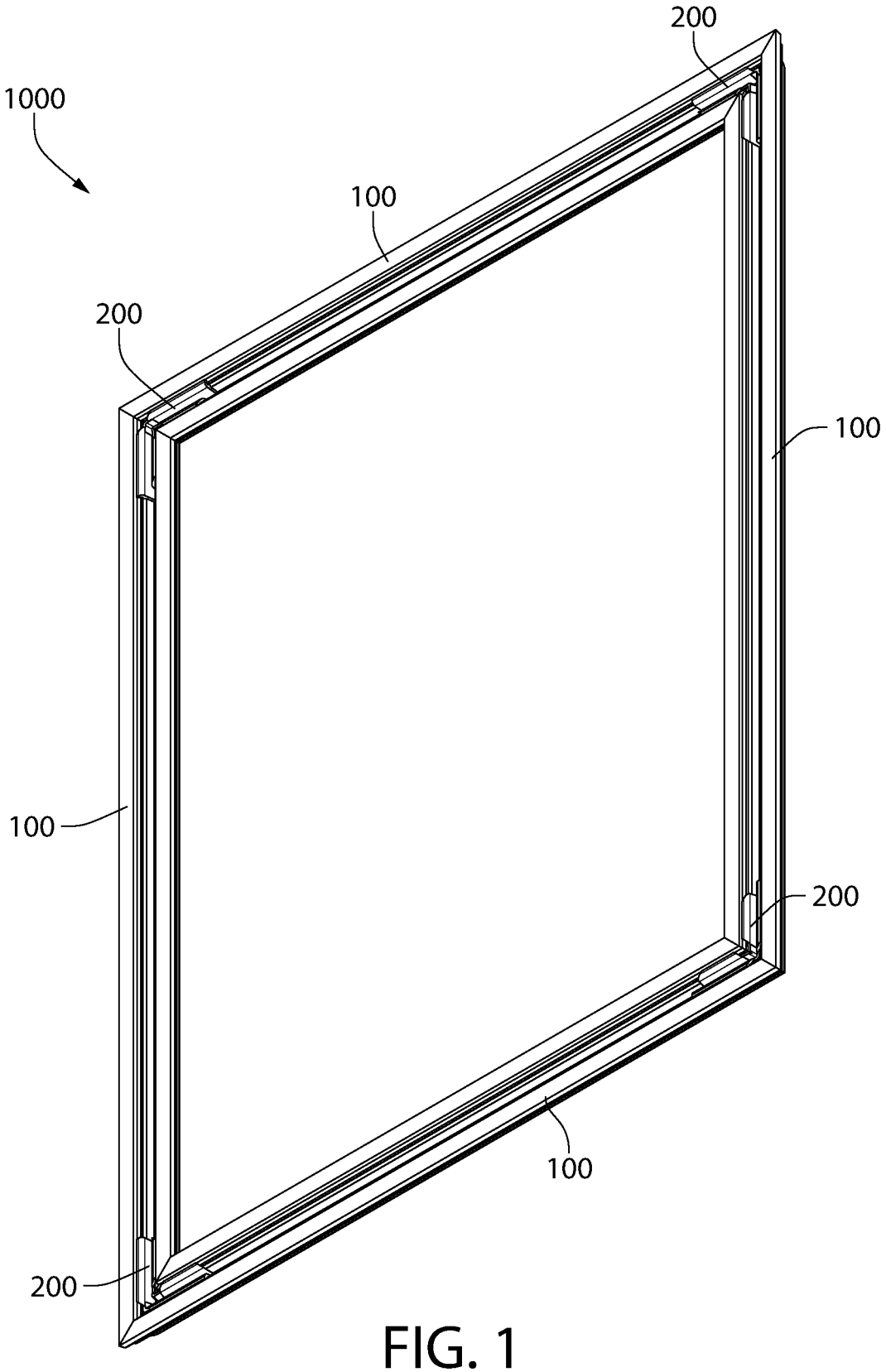
FIG. 1 is a rear perspective view of a decorative moulding assembly in an assembled state in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
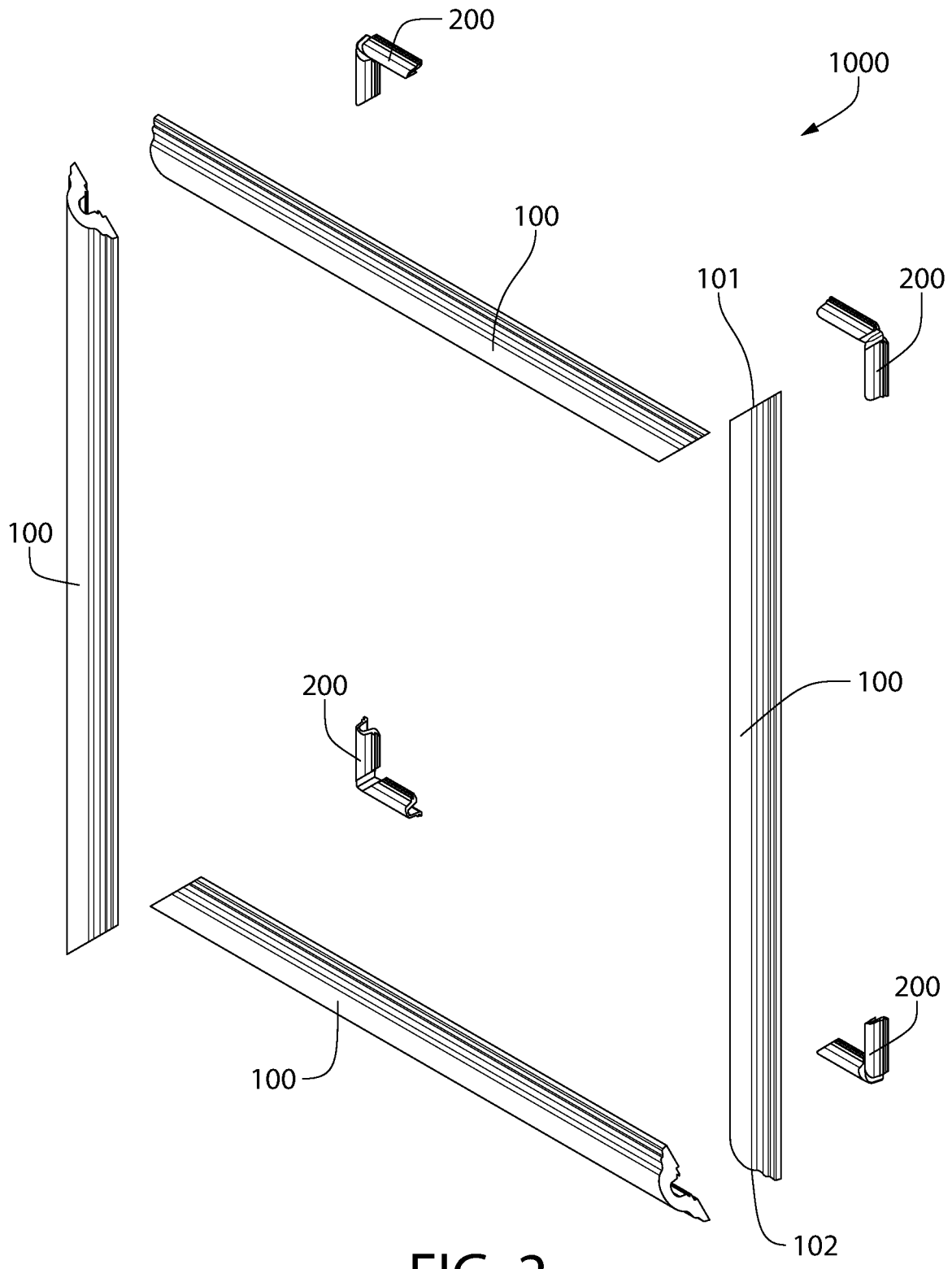
FIG. 2 is an exploded front view of the decorative moulding assembly of FIG. 1.
Figure 3:
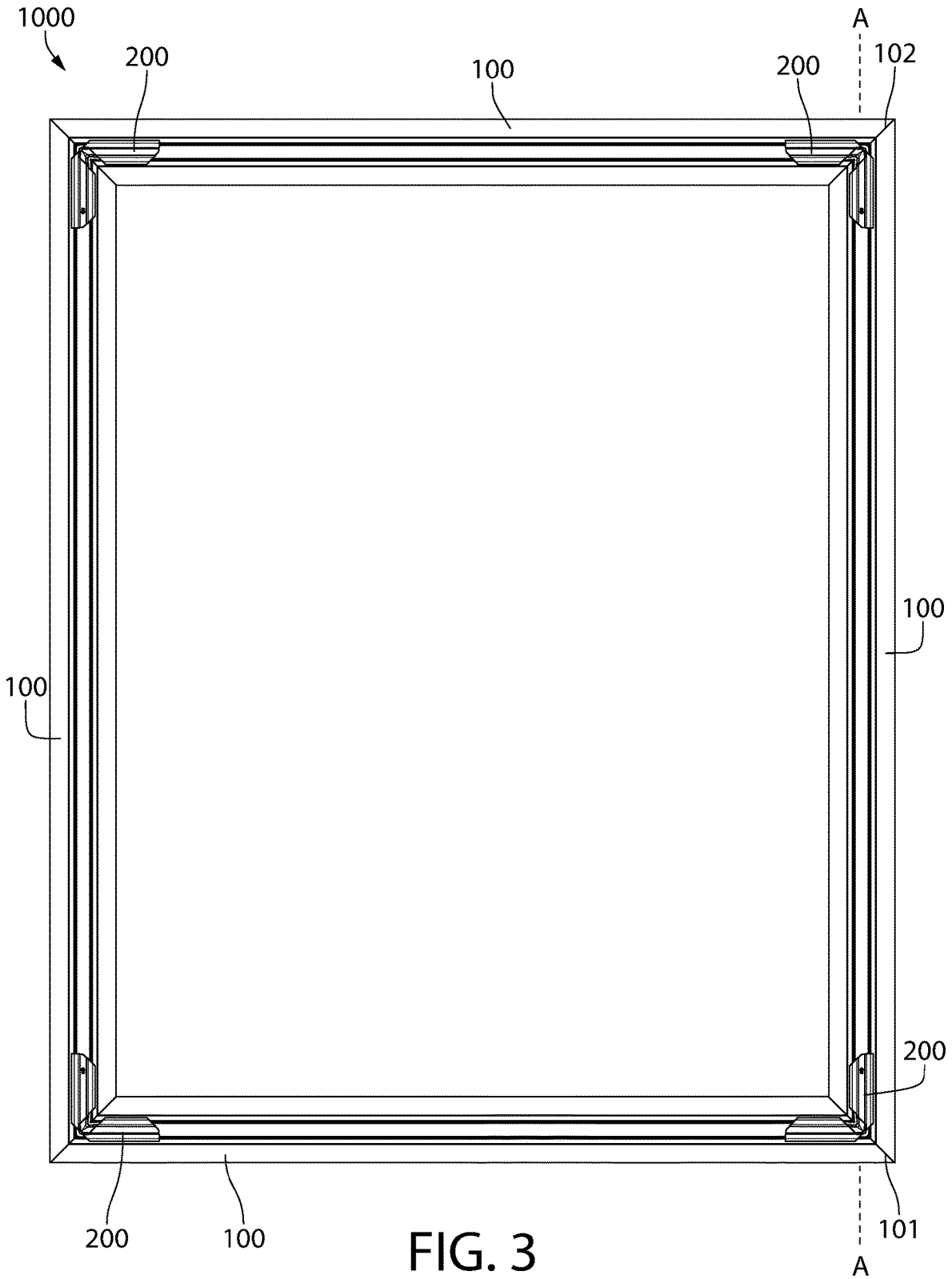
FIG. 3 is a rear view of the decorative moulding assembly of FIG. 1.

Referring to FIGS. 1-3, a decorative moulding assembly 1000 will be described in accordance with a first embodiment of the present invention. The decorative moulding assembly 1000 comprises a plurality of moulding pieces 100 and a plurality of connectors 200 that are used to couple the moulding pieces 100 together in a desired or predetermined manner. Thus, the moulding pieces 100 and the connectors 200 are prefabricated and may be sold together, unassembled, in a kit. That is, the moulding pieces 100 and the connectors 200 may be packaged unassembled and sold together so that a consumer can purchase the kit and assemble the moulding pieces 100 and the connectors 200 together to form the decorative moulding assembly 1000 as shown in FIGS. 1 and 3. In the exemplified embodiment, the decorative moulding assembly 1000, when assembled, has a square or rectangular shape. However, the invention is not to be so limited and other shapes may be possible in other embodiments, including any desired shapes or patterns that a user may want to have a decoration on a wall or ceiling surface. Some additional exemplary, non-limiting shapes are depicted in later described embodiments.

In this embodiment, the moulding pieces 100 are all identical, except for potentially having a different length as described below. That is, each of the moulding pieces 100 has an identical ornamental profile so that the moulding pieces 100 create a seamless decorative appearance when the moulding pieces 100 are attached to one another. Furthermore, each of the moulding pieces 100 has an identically shaped and profiled channel within which the connectors 200 nest when the connectors 200 are coupled to the moulding pieces 100. As seen in FIGS. 1-3, the moulding pieces 100 are each elongated along a longitudinal axis A-A. In the exemplified embodiment the decorative moulding assembly 1000 is in the shape of a rectangle when assembled, such that the top and bottom moulding pieces 100 have a shorter length than the two side moulding pieces 100. In other embodiments, all of the moulding pieces 100 may have the same length or all may have different lengths or other variations regarding the lengths of the different moulding pieces 100 may be used to form a desired shape when assembled Each of the moulding pieces 100 comprises a first end 101 and a second end 102, with the moulding pieces 100 being elongated along the longitudinal axis A-A between the first and second ends 101, 102. In the exemplified embodiment, the first and second ends 101, 102 of each of the moulding pieces 100 is cut at a 45° relative to the longitudinal axis A-A of the moulding piece 100, so that when two of the moulding pieces 100 are positioned adjacent to one another to form the decorative moulding assembly 1000, the abutting ends or end surfaces of the two moulding pieces 100 form a miter joint. Thus, each of the first and second ends 101, 102 of each of the moulding pieces 100 may be mitered or cut at a non-perpendicular angle relative to the longitudinal axis A-A, in some embodiments.

The connectors 200 are used to couple the moulding pieces 100 together to form the desired assembled shape. That is, each of the connectors 200 may be coupled to an end portion of one of the moulding pieces 100 and an end portion of another one of the moulding pieces 100 to couple the two end pieces together. The connectors 200 may be an L-shape in some embodiments particularly where the assembled decorative moulding assembly 1000 is a rectangular or square shape, as such L shape permits portions of the connectors 200 to be coupled to each of the two adjacently positioned moulding pieces 100. As seen in FIG. 3, the connectors 200 may be inserted into channels in the various moulding pieces 100 to couple the connectors 200 to the moulding pieces 100 and maintain the moulding pieces 100 in the desired abutting position to form the assembled shape.

Figure 4A:
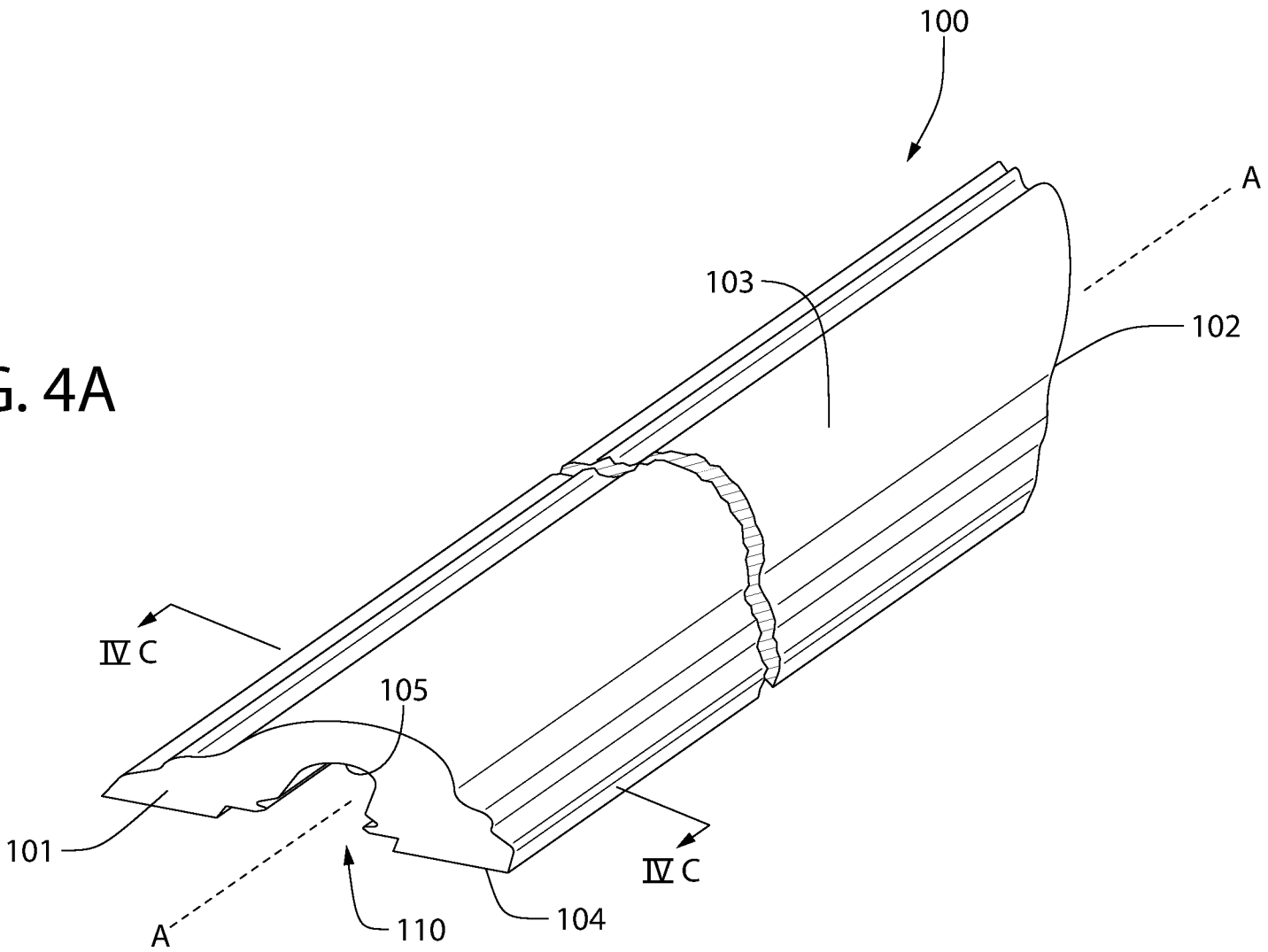
FIG. 4A is a front perspective view of a moulding piece of the decorative moulding assembly of FIG. 1.
Figure 4B:
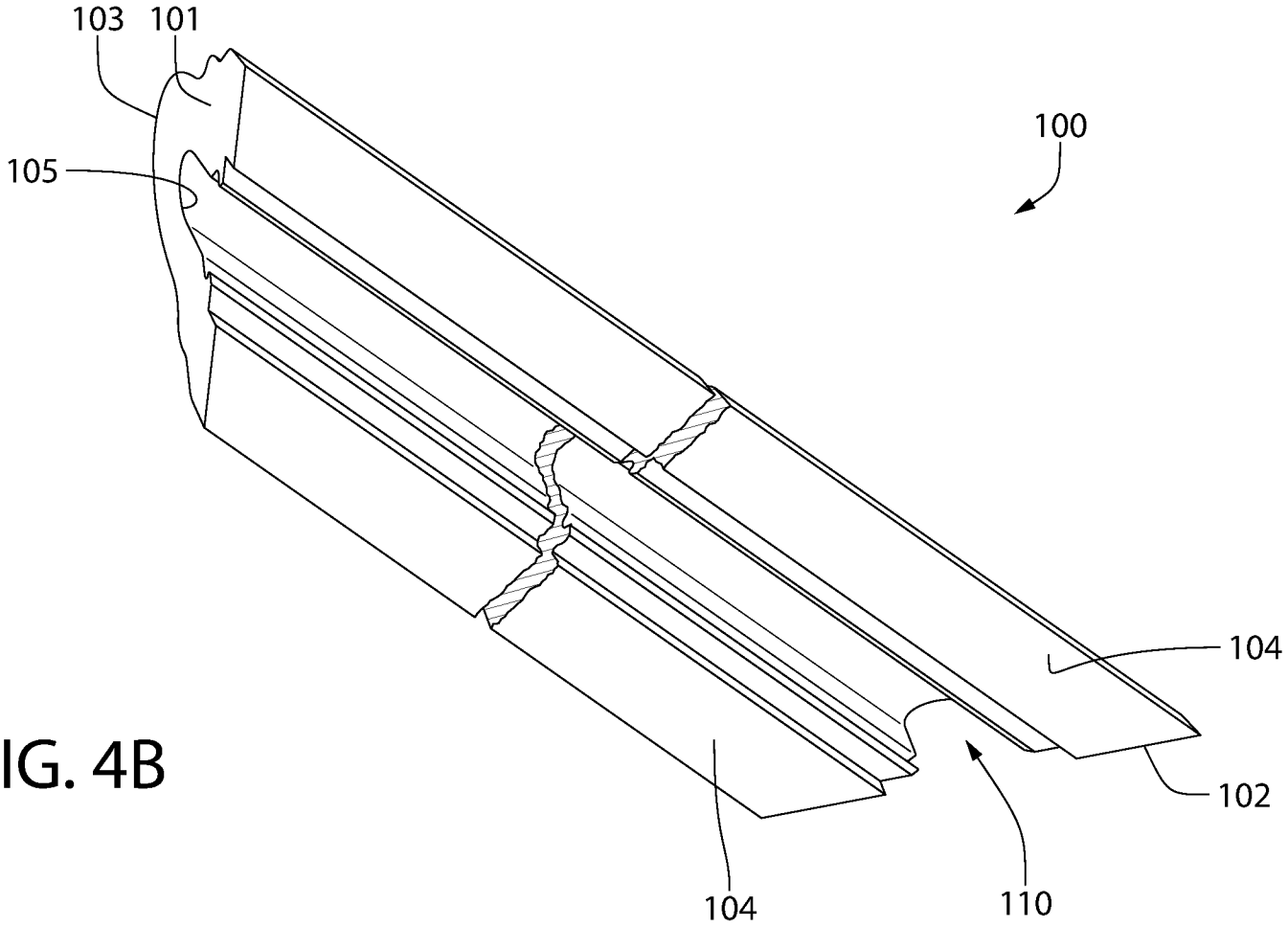
FIG. 4B is a rear perspective view of the moulding piece of FIG. 4A.
Figure 4C:
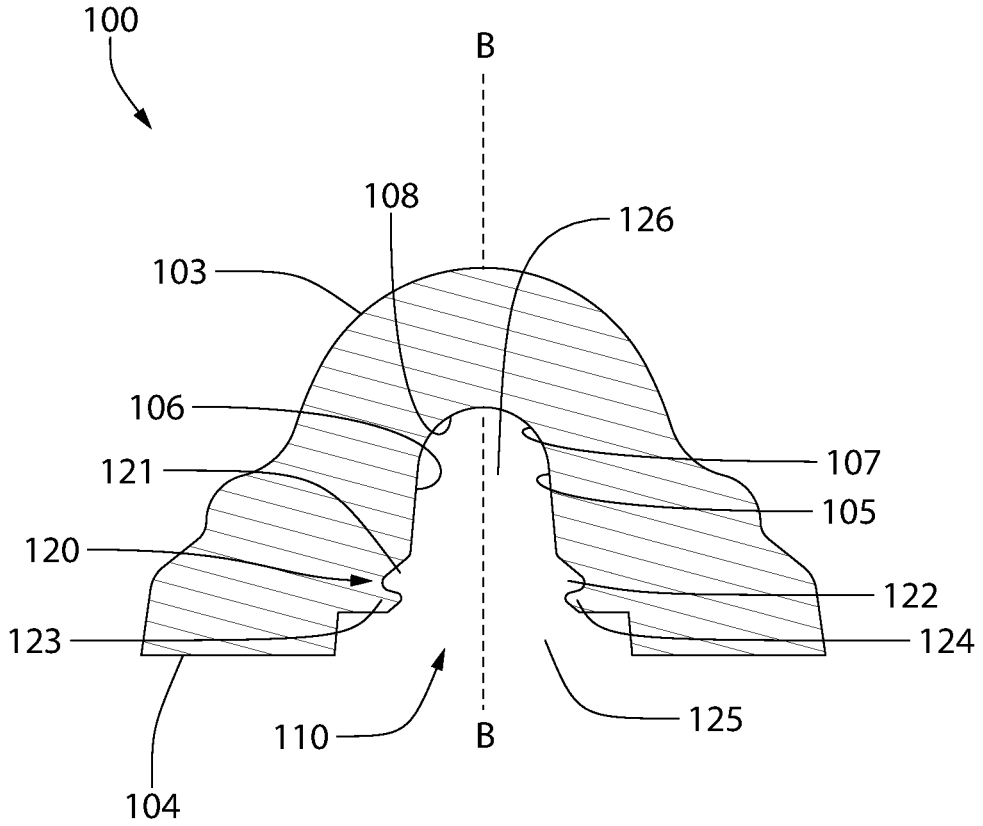
FIG. 4C is a cross-sectional view taken along line IVC-IVC of FIG. 4A.

Referring to 4A-4C, the moulding pieces 100 will be further described. As mentioned above, in this embodiment the moulding pieces 100 all have an identical shape and structure, with the potential exception of their length. FIGS. 4A and 4B illustrate the moulding piece 100 with a break line to indicate that its length may be greater or smaller than that which is depicted. The description of the moulding pieces 100 with reference to FIGS. 4A-4C is applicable to each of the moulding pieces 100 depicted in FIGS. 1-3. In the exemplified embodiment, all of the moulding pieces 100 are formed by extrusion. More specifically, the moulding pieces 100 are formed by extrusion of a polystyrene foam or a polyvinyl chloride foam.

The moulding pieces 100 extend from the first end 101 to the second end 102 along the longitudinal axis A-A. The first and second ends 101, 102 may also be referred to herein as first and second end surfaces. The moulding pieces 100 comprise a front surface 103 and a rear surface 104. The front surface 103 is ornamental, meaning it has an aesthetically pleasing or decorative shape which is intended to be displayed and visible within an interior space within which the decorative moulding assembly 1000 is located. While a particular ornamental appearance is depicted in the drawings, the invention is not to be limited to this particular shape and appearance in all embodiments. The front surface (or ornamental front surface) 103 may have any desirable ornamental profile including various contours, ridges, grooves, or the like to create a desired aesthetic.

The moulding pieces 100 comprise a channel 110 that is formed into the rear surface 104. The channel 110 has a U-shaped cross-sectional area or shape. Furthermore, the channel 110 is configured to receive a portion of the connector 200 to facilitate the coupling of the connector 200 to the moulding pieces 100, which thereby couples the moulding pieces 100 to one another indirectly via the connector 200. As mentioned above, while one of the moulding pieces 100 is being described, it should be appreciated that all of the moulding pieces 100 of the decorative moulding assembly 100 have the same features as described herein. Thus, the various moulding pieces 100 as shown in FIGS. 1-3 may be referred to in the claims as a first moulding piece, a second moulding piece, a third moulding piece, and a fourth moulding piece. Furthermore, the channels of each respective one of the moulding pieces may be referred to in the claims as a first channel, a second channel, a third channel, and a fourth channel so that the prefixes first, second, third, and fourth are used consistently to describe the various moulding pieces 100 and their components and/or features.

Because the moulding pieces 100 are extruded, they have a fixed cross-sectional profile along their entire length. As such, the channel 110 extends the full length of the moulding piece 100 from the first end 101 to the second end 102. Thus, the channel 110 is open at each of the first and second ends 101, 102, and also at the rear surface 104. The moulding piece 100 comprises an inner surface 105 that defines, or bounds, the channel 110. In the exemplified embodiment, the channel 110 is symmetrical about a first axis B-B, although such symmetry is not required in all embodiments. In some embodiments the channel 110 may not be symmetrical. Thus, the first axis B-B may be an axis that extends along the depth of the channel 110 in a direction between the ornamental front surface 103 and the rear surface 104 of the moulding piece 100, such that the first axis B-B is generally perpendicular to the longitudinal axis A-A. The inner surface 105 of the moulding piece 100 is divided by the first axis B-B into a first portion 106 of the inner surface 105 located on a first side of the first axis B-B and a second portion 107 of the inner surface 105 located on a second side of the first axis B-B.

The moulding piece 100 comprises a first engagement feature 120, which is located within or along the channel 110. In the exemplified embodiment, the first engagement feature 120 comprises a first groove (or a first locking groove) 121 located along the first portion 106 of the inner surface 105 and a second groove (or a second locking groove) 122 located along the second portion 107 of the inner surface 105. It should be appreciated that the invention is not limited to the first engagement feature 120 comprising the first and second grooves 121, 122. Specifically, in one alternative embodiment the first engagement feature 120 may comprise one of the first and second grooves 121, 122, but not both. In still other embodiments, the first engagement feature 120 may comprise a protuberance, or a pair of protuberances, on the first and second portions 106, 107 of the inner surface 105. Moreover, in embodiments where the first engagement feature 120 comprises the first and second grooves 121, 122, the first and second grooves 121, 122 are not limited to the cross-sectional shape of the grooves as shown in FIG. 4C and grooves having other profiles or shapes may be used. The first engagement feature 120 is configured to mate with an engagement feature of the connector 200 which will be described below, and thus the exact structure of the first engagement feature 120 may change to enable sufficient mating with an engagement feature of the connector 200. Thus, variations to what is shown in the drawings are possible in accordance with the invention described herein.

In the exemplified embodiment, each of the first and second grooves 121, 122 extend the full length of the channel 110 from the first end 101 of the moulding piece 100 to the second end 102 of the moulding piece 100. Moreover, the first and second grooves 121, 122 are aligned such that an axis perpendicular to the first axis B-B will intersect both of the first and second grooves 121, 122. Due to the first and second grooves 121, 122 being aligned, the channel 120 is symmetrical about the first axis B-B in the exemplified embodiment. However, in other embodiments the first and second grooves 121, 122 may not be aligned and in such embodiments the channel 120 may not be symmetrical. That is, one of the first and second grooves 121, 122 may be located closer to the rear surface 104 of the moulding piece 100 than the other. The inner surface 105 of the moulding piece 100 which defines the channel 110 comprises a U-shaped portion 108 which extends between the first and second grooves 121, 122. The U-shaped portion 108 is smooth and free of any grooves or protuberances in the exemplified embodiment. While the channel 120 generally, and the U-shaped portion 108 thereof more specifically, has a rounded bight portion, the invention is not to be so limited in all embodiments. In some embodiments, the bight portion of the channel 120 may be linear rather than arcuate. The channel 120 will be deemed to have a U-shaped cross-sectional area/shape whether the bight portion is arcuate as shown or linear (i.e., whether the U shape is rounded or squared at the bight portion). The inner surface 105 could also have various ridges, valleys, waves, bumps, or the like while still maintaining the general U-shape as shown.

The moulding piece 100 comprises a first tab 123 located on the first portion 106 of the inner surface 105 of the first channel 110. The first tab 123 is located immediately adjacent to the first groove 121 between the first groove 121 and the rear surface 104 of the moulding piece 100. An upper surface of the first tab 123 forms a lower boundary of the first groove 121 and allows for a locking engagement between the moulding piece 100 and the connector 200. The moulding piece 100 comprises a second tab 124 located on the second portion 107 of the inner surface 105 of the first channel 110. The second tab 124 is located immediately adjacent to the second groove 122 between the second groove 122 and the rear surface 104 of the moulding piece 100. An upper surface of the second tab 124 forms a lower boundary of the second groove 122 and allows for a locking engagement between the moulding piece 100 and the connector 200. A distal edge of each of the first and second tabs 123, 124 is angled downwardly and outwardly in a direction away from the first axis B-B. This facilitates the introduction of the connector 200 into the channel 110, as will be described in greater detail below.

The channel 110 comprises an entry section 125 and a nesting section 126. The entry section 125 is located adjacent to the rear surface 104 of the moulding piece 100 and the nesting section 126 is located between the entry section 125 and the ornamental front surface 103 of the moulding piece 100. In the exemplified embodiment, the entry section 125 has a rectangular cross-sectional area/shape whereas the nesting section 126 has the U-shaped cross-sectional area. In other embodiments, the entry section 125 may simply continue the U shape of the nesting section 126. The first and second tabs 123, 124 form the lower-most or distal-most part of the nesting section 126 of the channel 110. The entry section 125 has a greater maximum width than the nesting section 126.

Figure 5A:
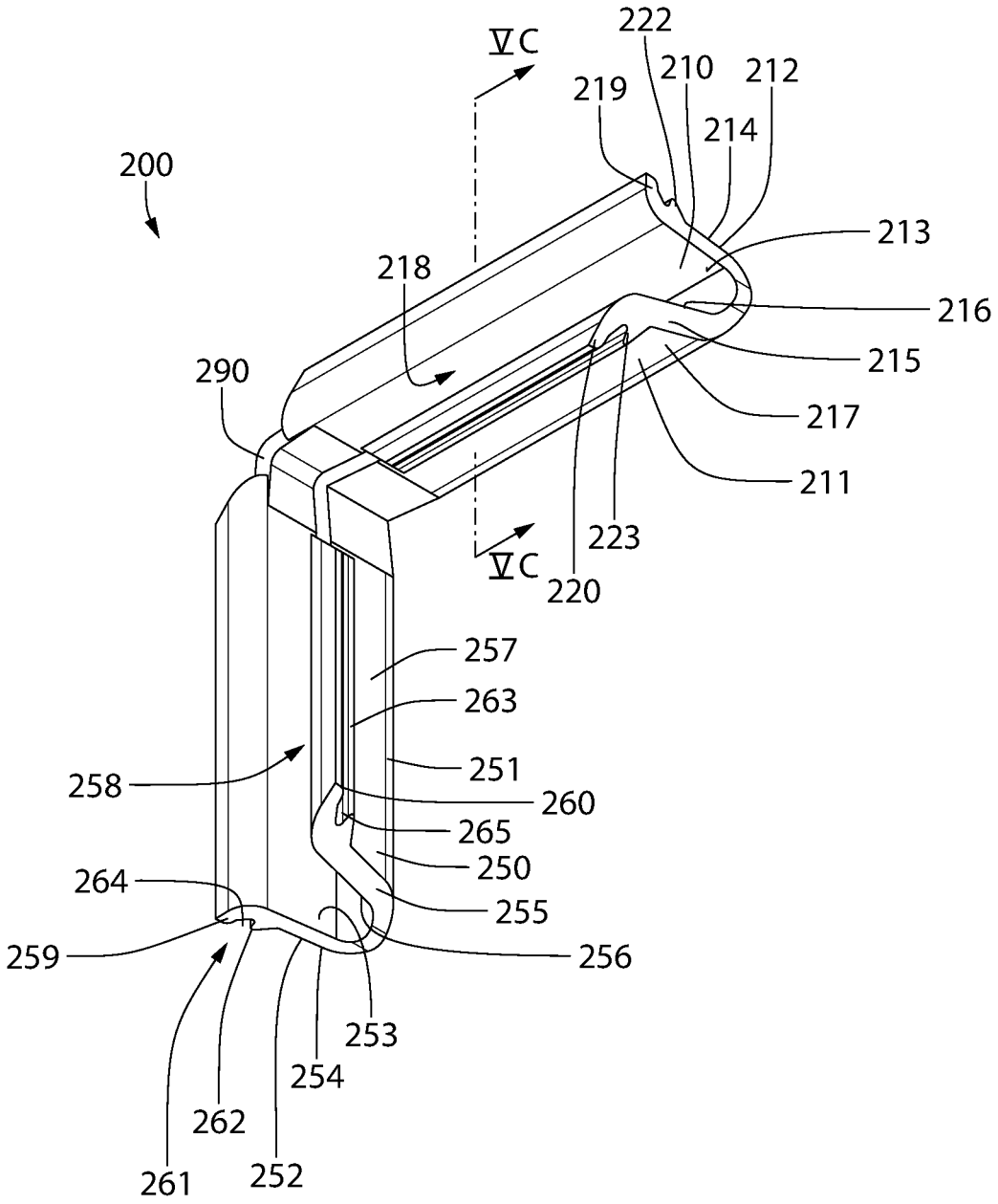
FIG. 5A is a rear perspective view of a connector of the decorative moulding assembly of FIG. 1.
Figure 5B:
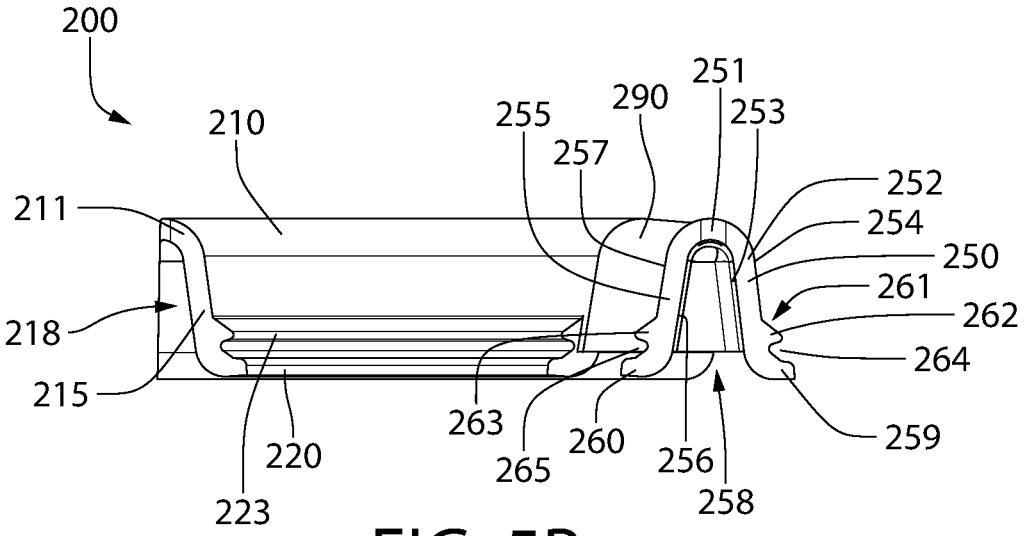
FIG. 5B is a side elevation view of the connector of FIG. 5A.
Figure 5C:
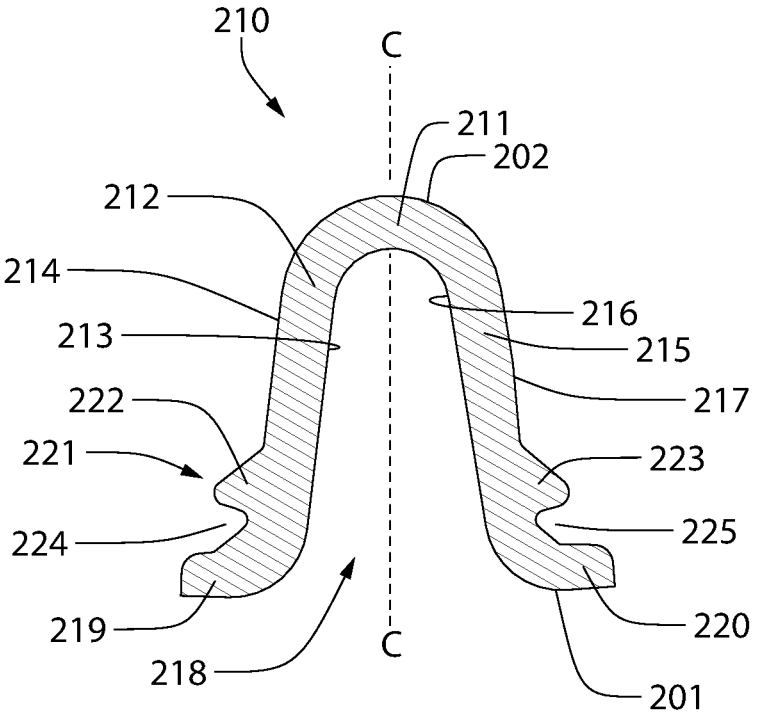
FIG. 5C is a cross-sectional view taken along line VC-VC of FIG. 5A.

Turning now to FIGS. 5A-5C, the connector 200 will be described. In the exemplified embodiment, the connector is formed by injection molding. Thus, the connector is formed from a plastic material, such as a material selected from the group consisting of acrylonitrile butadiene styrene (ABS), high impact polystyrene (HIPS), and polyvinyl chloride (PVC). Other materials may be used to construct the connector 200 in other embodiments. However, the invention is not to be so limited in all embodiments and it could be manufactured using other manufacturing techniques, including extrusion. The connector 200 operates as a sort of clip that can be clipped into the channel 110 of the moulding pieces 100 for purposes of coupling the moulding pieces 100 together to form the decorative moulding assembly 1000.

The connector 200 comprises a first portion 210 and a second portion 250. Each of the first and second portions 210, 250 is elongated and the first and second portions 210, 250 are arranged and oriented relative to one another to intersect in an L-shape. In the exemplified embodiment, the first and second portions 210, 250 are oriented at a 90° angle relative to one another. However, the invention is not to be so limited in all embodiments and the first and second portions 210, 250 may be oriented at other angles relative to one another, such as a 30° angle, a 45° angle, a 60° angle, 120° angle, 135° angle, 150° angle or the like. Thus, as used herein the term L-shape encompasses embodiments where the first and second portions 210, 250 intersect at any angle between 30° and 150°. In still other embodiments, the first and second portions 210, 250 may be aligned in a linear manner such that they may be coaxial with respect to one another. The specific angle at which the first and second portions 210, 250 are oriented relative to one another may be dictated by the desired overall shape of the assembled decorative moulding assembly 1000. In the exemplified embodiment, there is a corner portion 290 that connects the first and second portions 210, 250 to one another. In other embodiments, the corner portion 290 may be omitted and the first and second portions 210, 250 may be directly connected to one another. The connector 200 is an integral, monolithic component which comprises both of the first and second portions 210, 250, and the corner portion 290 when included.

In this embodiment, each of the first and second portions 210, 250 of the connector 200 is identical in size, length, structure, and the like (i.e., they are identical in all respects). Thus, while both of the first and second portions 210, 250 will be described herein in some detail, if some features are described with regard to one of the first and second portions 210, 250 but not the other, it should be noted that such feature is applicable to both of the first and second portions. That is, any feature described with reference to either of the first and second portions 210, 250 is applicable to both of the first and second portions 210, 250. FIG. 5C is a cross-section through part of the first portion 210 and while no similar cross section is provided through the second portion 250 it should be appreciated that such cross-section would be identical to FIG. 5C.

The first portion 210 of the connector 200 comprises a U-shaped body 211. The U-shaped body 211 comprises a first leg 212 having an inner surface 213 and an outer surface 214 and a second leg 215 having an inner surface 216 and an outer surface 217. The inner surfaces 213, 216 of the first and second legs 212, 215 are spaced apart from one another, owing to the U-shape of the body 211. That is, the inner surfaces 213, 216 of the first and second legs 212, 215 are spaced apart from one another by a channel 218 (which may be referred to as a third channel in the claims). This permits the first and second legs 212, 215 to flex or deflect inwardly into the channel 218 towards one another during the coupling of the connector 200 to the moulding pieces 100 as described further herein.

In the exemplified embodiment, the first portion 210 of the connector 200 is symmetric about a third axis C-C. However, the invention is not to be so limited in all embodiments and the connector 200 may not be symmetrical in all embodiments. Nonetheless, the third axis C-C extends vertically through the channel 218 in a direction between a bottom end 201 and a top end 202 of the connector 200. Each of the first and second legs 212, 215 flares outwardly in a direction away from the third axis C-C at a location adjacent to the bottom end 201 of the connector 200. That is, the first leg 212 comprises a distal-most portion 219 that extends outwardly away from the third axis C-C and the second leg 215 comprises a distal-most portion 220 that extends outwardly away from the third axis C-C.

The first portion 210 of the connector 200 comprises a third engagement feature 221 that facilitates the attachment of the first portion 210 of the connector 200 to one of the moulding pieces 100. In the exemplified embodiment, the third engagement feature 221 comprises a first protuberance 222 protruding from the outer surface 214 of the first leg 212 and a second protuberance 223 protruding from the outer surface 217 of the second leg 215. However, the invention is not limited to the third engagement feature 221 comprising protuberances, and in other embodiments the third engagement feature 221 may comprise a single protuberance, or the protuberances could be replaced with grooves. Moreover, in embodiments wherein the third engagement feature 221 comprises the first and second protuberances 222, 223, the invention is not to be particularly limited by the shape of the protuberances 222, 223. Rather, the protuberances 222, 223 should mate with the grooves 121, 122 of the moulding piece 100 so while the shapes of the protuberances 222, 223 and the grooves 121, 122 should correspond to one another, the particular shape selected is not to be limiting in all embodiments unless specifically claimed as such.

In the exemplified embodiment, the first and second protuberances 222, 223 are aligned in the direction of the third axis C-C, thereby making the first portion 210 of the connector 200 symmetrical about the third axis C-C. However, the invention is not to be so limited and in other embodiments the first and second protuberances 222, 223 may not be aligned with one another. Each of the first and second protuberances 222, 223 extends continuously along an entirety of the length of the first portion 210 in the exemplified embodiment. In other embodiments, the first and second protuberances 222, 223 may be discontinuous or may extend partially but not entirely along the length of the first portion 210 of the connector 200. Upper surfaces of the first and second protuberances 222, 223 are angled or sloped downwardly and outwardly away from the third axis C-C to facilitate the sliding engagement of the connector 200 to the moulding piece 100 as described further herein below.

The first protuberance 222 is spaced apart from the distal-most portion 219 of the first leg 212 by a first nesting groove 224. The second protuberance 223 is spaced apart from the distal-most portion 220 of the second leg 215 by a second nesting groove 225. As discuss further, the first and second tabs 123, 124 of the moulding pieces 100 nest within the first and second nesting grooves 224, 225 when the connector 200 is coupled to the first moulding piece 100.

The second portion 250 of the connector 200 is the same as the first portion 210 of the connector 200, and will be described here with reference to FIGS. 5A and 5B (FIG. 5C illustrates only the first portion 210 of the connector 200, although the second portion 250 of the connector 200 is structurally identical as described above). The second portion 250 of the connector 200 comprises a U-shaped body 251. The U-shaped body 251 comprises a first leg 252 having an inner surface 253 and an outer surface 254 and a second leg 255 having an inner surface 256 and an outer surface 257. The inner surfaces 253, 256 of the first and second legs 252, 255 are spaced apart from one another, owing to the U-shape of the body 255. That is, the inner surfaces 253, 256 of the first and second legs 252, 255 are spaced apart from one another by a channel 258 (which may be referred to as a fourth channel in the claims). This permits the first and second legs 252, 255 to flex or deflect inwardly into the channel 258 towards one another during the coupling of the connector 200 to the moulding pieces 100 as described further herein.

In the exemplified embodiment, the second portion 250 of the connector 200 is symmetric about a fourth axis (not shown, but the same concept as the third axis C-C shown in FIG. 5C). Each of the first and second legs 252, 255 flares outwardly in a direction away from the fourth axis at a location adjacent to the bottom end 201 of the connector 200. That is, the first leg 252 comprises a distal-most portion 259 that extends outwardly away from the fourth axis and the second leg 255 comprises a distal-most portion 260 that extends outwardly away from the fourth axis.

The second portion 250 of the connector 200 comprises a fourth engagement feature 261 that facilitates the attachment of the second portion 250 of the connector 200 to one of the moulding pieces 100. In the exemplified embodiment, the fourth engagement feature 261 comprises a first protuberance 262 protruding from the outer surface 254 of the first leg 252 and a second protuberance 263 protruding from the outer surface 257 of the second leg 255. Just like with the third engagement feature 221, the fourth engagement feature 261 may comprise grooves instead of protuberances, and the grooves/protuberances are not to be limited to any particular shape unless specifically claimed as such. In the exemplified embodiment, the first and second protuberances 262, 263 are aligned in the direction of the fourth axis, thereby making the second portion 250 of the connector 200 symmetrical about the fourth axis. However, the invention is not to be so limited and in other embodiments the first and second protuberances 262, 263 may not be aligned with one another. Each of the first and second protuberances 262, 263 extends continuously along an entirety of the length of the second portion 250 in the exemplified embodiment. In other embodiments, the first and second protuberances 262, 263 may be discontinuous or may extend partially but not entirely along the length of the second portion 250 of the connector 200. Upper surfaces of the first and second protuberances 262, 263 are angled or sloped downwardly and outwardly away from the fourth axis to facilitate the sliding engagement of the connector 200 to the moulding piece 100 as described further herein below.

The first protuberance 262 is spaced apart from the distal-most portion 259 of the first leg 252 by a first nesting groove 264. The second protuberance 263 is spaced apart from the distal-most portion 260 of the second leg 255 by a second nesting groove 265. As discuss further, the first and second tabs 123, 124 of the moulding pieces 100 nest within the first and second nesting grooves 264, 265 when the connector 200 is coupled to the first moulding piece 100.

Having described the moulding pieces 100 and the connector 200 in some detail, the process of assembling the moulding pieces 100 and the connectors 200 together to form the decorative moulding assembly 1000 will be described with reference to FIGS. 6A-6E. In describing the assembly process, the moulding pieces 100 will be described with the suffixes a and be to refer to different ones of the moulding pieces 100. That is, in FIGS. 6-6E the connector 200 is used to couple a first moulding piece 100*a* to a second moulding piece 100*b*. Each of the first and second moulding pieces 100*a*, 100*b* is identical to the moulding pieces 100 described previously.

Figure 6A:
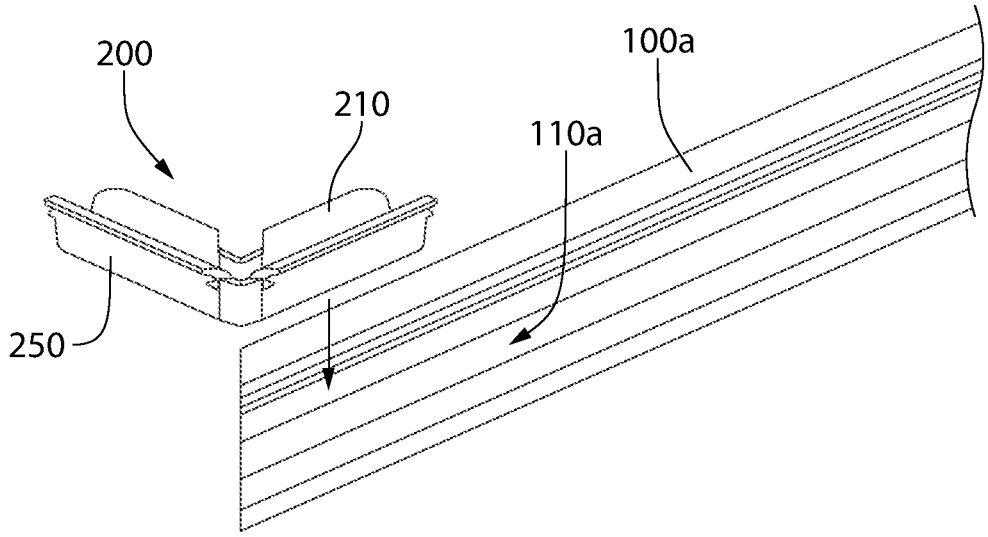
FIGS. 6A-6D illustrate the process of coupling the connector of FIGS. 5A-5C to two of the moulding pieces of FIGS. 4A-4C to couple the two moulding pieces together.
Figure 6B:
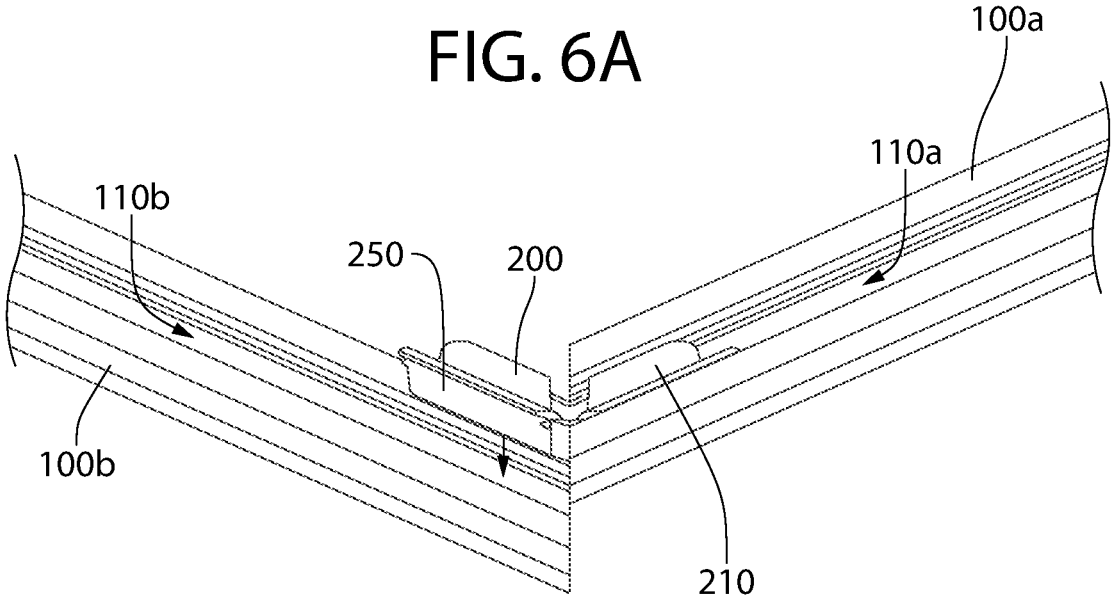
Figure 6C:
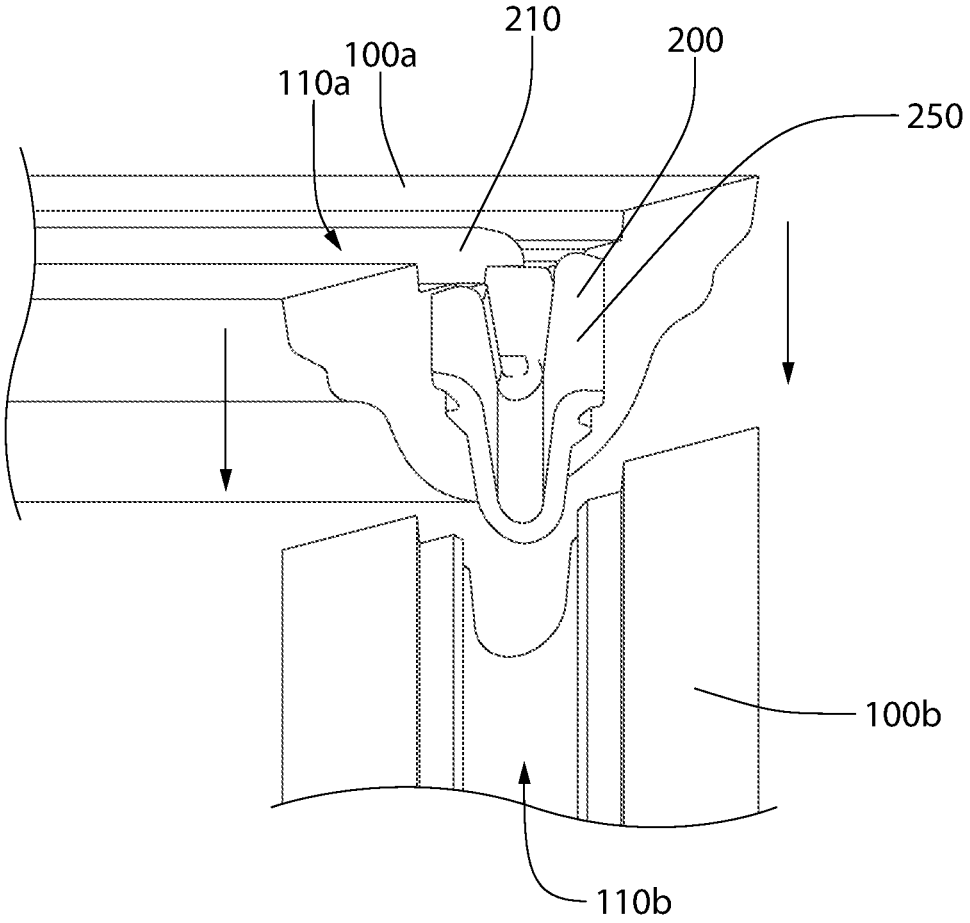

Referring first to FIG. 6A, one of the connectors 200 is depicted in alignment with a first channel 110*a* of the first moulding piece 100*a*. That is, the first portion 210 of the connector 200 is aligned with the first channel 110*a* of the first moulding piece 100*a*. Referring to FIG. 6B, the first portion 210 of the connector 200 is then pressed into the first channel 110*a* and ultimately coupled to the first moulding piece 100*a* via a snap-fit connection. The specific details of the coupling between the connector 200 and the first moulding piece 100*a* will be described below with reference to FIG. 6E. FIG. 6B illustrates the first portion 210 of the connector 200 nested within the first channel 110*a* of the first moulding piece 100*a* and then illustrates the second moulding piece 100*b* aligned with the second portion 250 of the connector 200. FIG. 6C provides a close-up view of the first portion 210 of the connector 200 nested within the first channel 110*a* of the first moulding piece 100*a* and with the second portion 250 of the connector 200 aligned with the second channel 110*b* of the second moulding piece 100*b*.

Figure 6D:
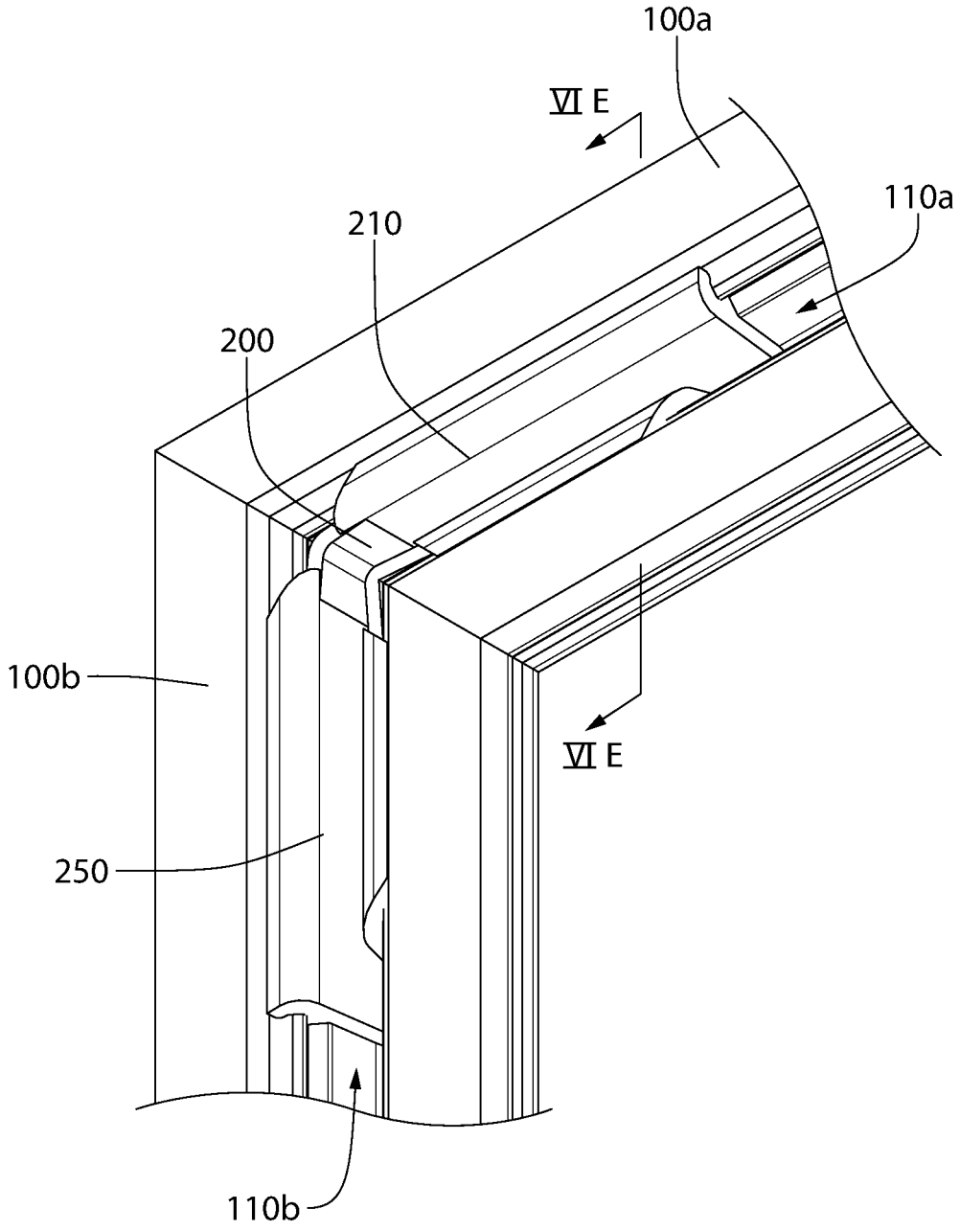

Next, the second portion 250 of the connector 200 is pressed into the second channel 110*b* of the second moulding piece 110*a* until the second portion 250 of the connector 200 is snap-fit connected to the second moulding piece 110*a*. FIG. 6D illustrates the connector 200 being coupled to both of the first and second moulding pieces 110*a*, 110*b*. As discussed above, the ends or end surfaces of the first and second moulding pieces 110*a*, 110*b* are all cut at an angle, so the end surfaces are abutted to form a miter joint as shown in FIG. 6D.

Figure 6E:
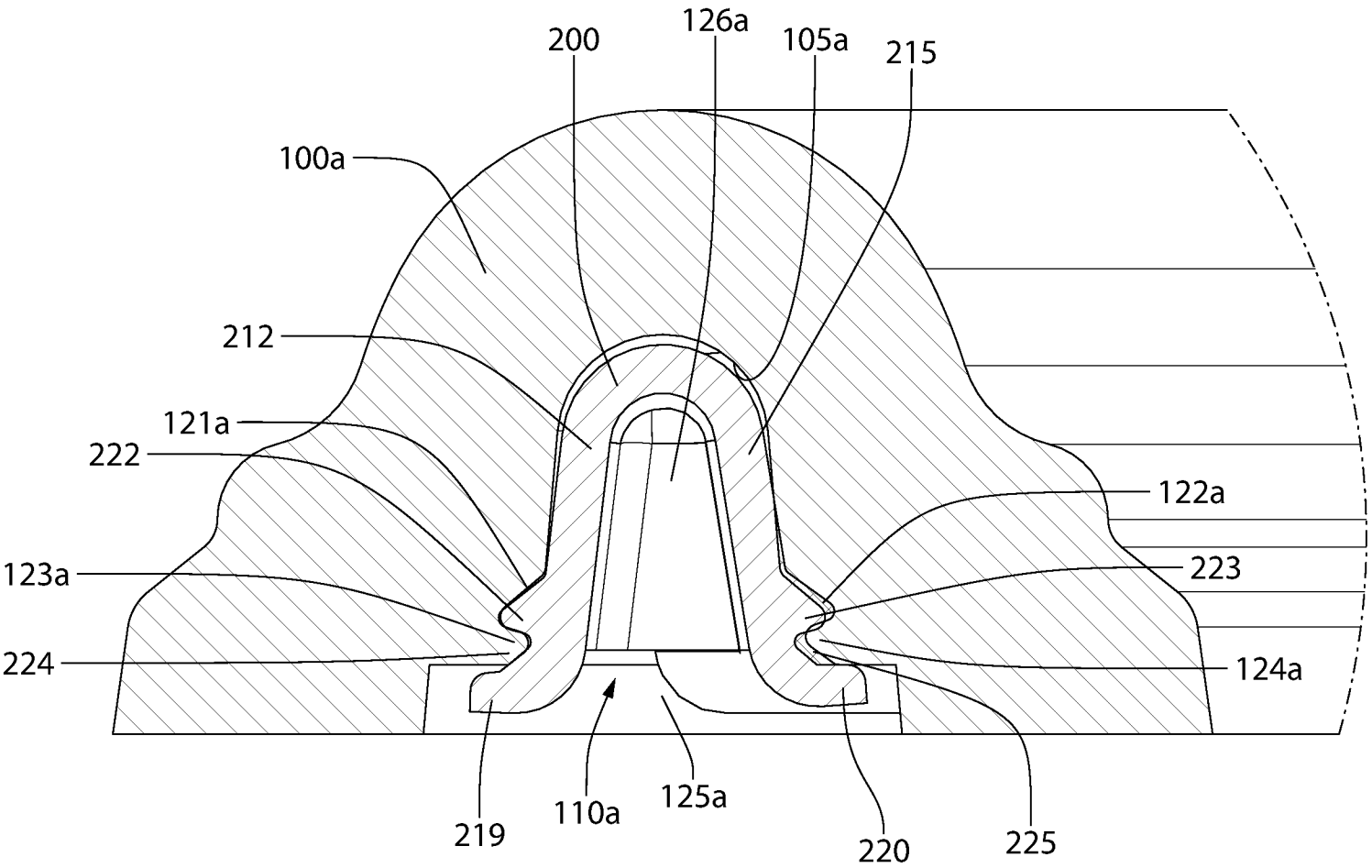
FIG. 6E is a cross-sectional view taken along line VIE-VIE of FIG. 6D.

Referring to FIG. 6E, the engagement between the first portion 210 of the connector 200 and the first moulding piece 100*a* will be described. While not depicted in FIG. 6E, it should be appreciated that the engagement between the second portion 250 of the connector 200 and the second moulding piece 100*b* is exactly the same as the engagement between the first portion 210 of the connector 200 and the first moulding piece 100*a* which is shown in FIG. 6E. Thus, while the engagement between the second portion 250 of the connector 200 and the second moulding piece 100*b* will not be described herein in the interest of brevity, the description of the engagement between the first portion 250 of the connector 200 and the first moulding piece 100*a* is applicable thereto.

To couple the first portion 210 of the connector 200 to the first moulding piece 100*a*, the connector 200 is inserted into the first channel 110*a* with the outer surfaces 214, 217 of the first and second legs 212, 215 facing the inner surface 105*a* of the channel 110*a*. As the first portion 210 of the connector 200 is pressed into the first channel 110*a*, the upper surfaces of the first and second protuberances 222, 223 will contact the lower surfaces of the first and second tabs 123*a*, 124*a*. Due to the angles of the upper surfaces of the first and second protuberances 222, 223 and the lower surfaces of the first and second tabs 123*a*, 124*a*, continued movement of the first portion 210 of the connector 200 into the first channel 110*a* causes the first and second legs 212, 215 of the first portion 210 of the connector 200 to flex or deflect inwardly into the channel 218 formed between the first and second legs 212, 215. Then, as the first portion 210 of the connector 200 is continued to be moved deeper into the first channel 110*a*, eventually the first and second protuberances 222, 223 (i.e., the third engagement feature 221) become aligned with the first and second grooves 121*a*, 122*a* (i.e., the first engagement feature 120*a*). Once the first and second protuberances 222, 223 become aligned with the first and second grooves 121*a*, 122*a*, the first and second legs 212, 215 return to their normal position. That is, the first and second legs 212, 215 are biased and/or flex back outwardly to their natural state, which is the state and/or position of the first and second legs 212, 215 when no forces are acting thereon.

Once the first and second legs 212, 215 are biased back to their natural state/position, the first and second protuberances 222, 223 nest within the first and second grooves 121*a*, 122*a*. The first portion 210 of the connector 200 cannot be removed from the first channel 110*a* without first flexing the first and second legs 212, 215 inwardly once again in order to remove the first and second protuberances 222, 223 from the first and second grooves 121*a*, 122*a*. Thus, the engagement between the first and second protuberances 222, 223 and the first and second grooves 121*a*, 122*a* locks the first portion 210 of the connector 200 to the first moulding piece 100*a*. The first and second tabs 123*a*, 124*a* prevent the connector 200 from simply being pulled out of the first channel 110*a* without first flexing the first and second legs 212, 215 inwardly towards one another. It is the engagement between the first and second protuberances 222, 223 of the connector 200 with the first and second grooves 121*a*, 122*a* of the first moulding piece 100*a* which facilitate the snap-fit connection between the connector 200 and the first moulding piece 100*a*.

When the first portion 210 of the connector 200 is fully nested within the first channel 110*a* of the first moulding piece 100*a*, the tabs 123*a*, 124*a* of the first moulding piece 100*a* nest within the first and second nesting grooves 224, 225 of the connector 200. Furthermore, the distal-most portions 219, 220 of the first and second legs 212, 215 nest within the entry section 125*a* of the first channel 110*a* and the remainder of the first portion 210 of the connector 200 nests within the nesting section 126*a* of the first channel 110*a*. In some embodiments, the connector 200 may be fixedly coupled to the first moulding piece 100*a*, such as by adhesive or welding. In other embodiments, the engagement between the various structural/mechanical features of the connector 200 and the first moulding piece 100*a* maintain the coupling between the connector 200 and the first moulding piece 100*a*. Without adhesive or welding, it may be possible to separate the connector 200 from the first moulding piece 100*a* after the coupling if so desired. As noted above, in this embodiment the engagement between the second portion 250 of the connector 200 and the second moulding piece 100*b* is the same as the engagement between the first portion 210 of the connector 200 and the first moulding piece 100*a* as described above. When the connector 200 is coupled to the moulding pieces 100, no portion of the connector 200 protrudes from the rear surface 204 of the moulding piece 100 to which it is coupled.

Additional connectors 200 may be coupled to the various moulding pieces 100 in order to form the decorative moulding assembly 1000 as shown in FIGS. 1 and 3. In FIGS. 1 and 3, the decorative moulding assembly 1000 comprises four of the moulding pieces 100 and four of the connectors 200. Depending on the shape of the decorative moulding assembly 1000 more or less moulding pieces 100 and/or connectors 200 may be used in other embodiments. The decorative moulding assembly 1000 is easy to manufacture and easy to assemble. In particular, manufacturing of the moulding pieces 100 is accomplished in a single extrusion step and manufacturing of the connectors 200 is accomplished in a single injection molding step. There is no secondary operation required. That is, there is no requirement to router or otherwise create any channels or the like in the components after their manufacture. Then, assembly simply requires a user to snap-fit connect the connectors 200 to the moulding pieces 100 in the desired arrangement to create the decorative moulding assembly 1000.

Figure 7A:
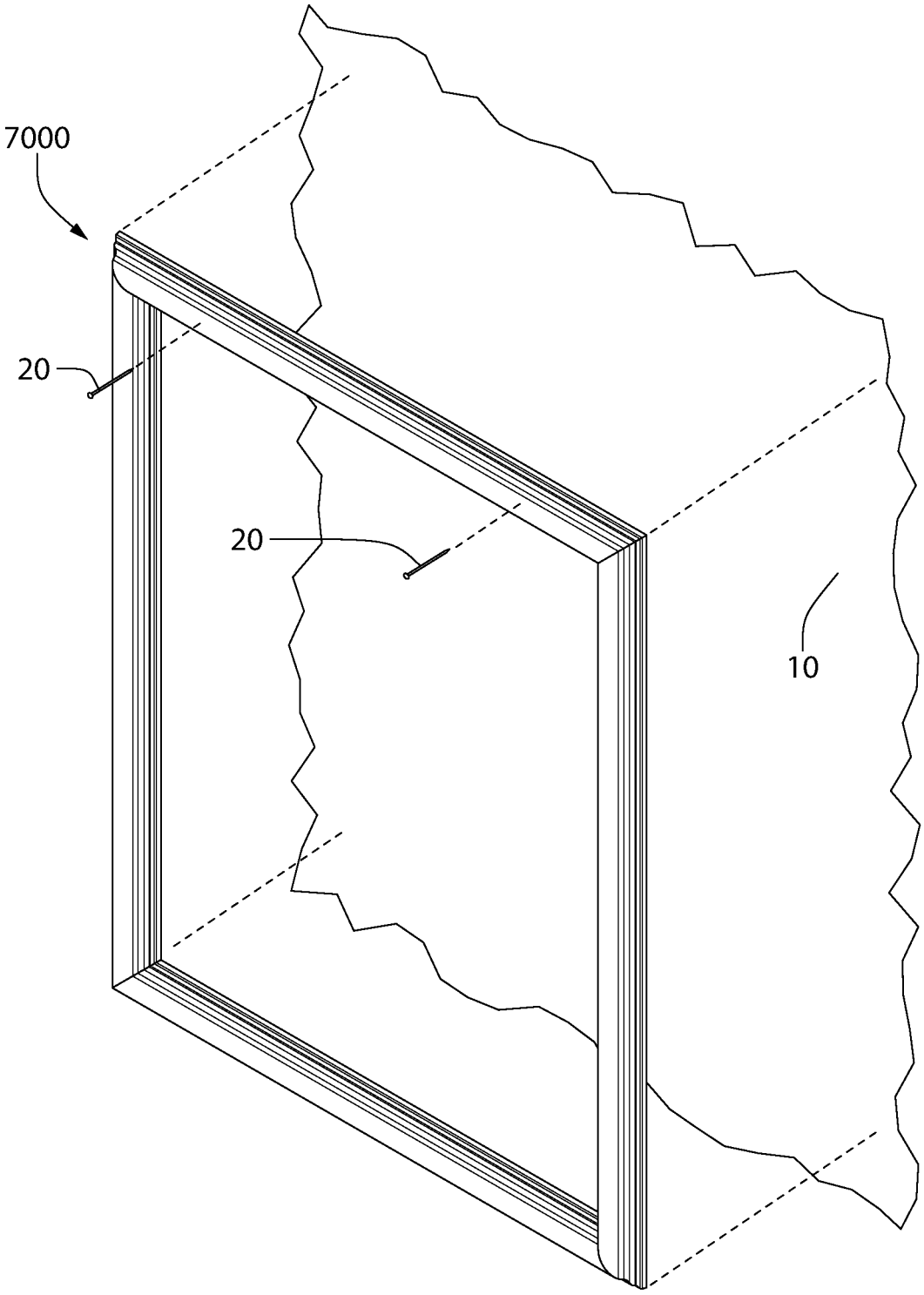
FIGS. 7A and 7B illustrate the use of fasteners to mount the decorative moulding assembly of FIG. 1 to a wall.
Figure 7B:
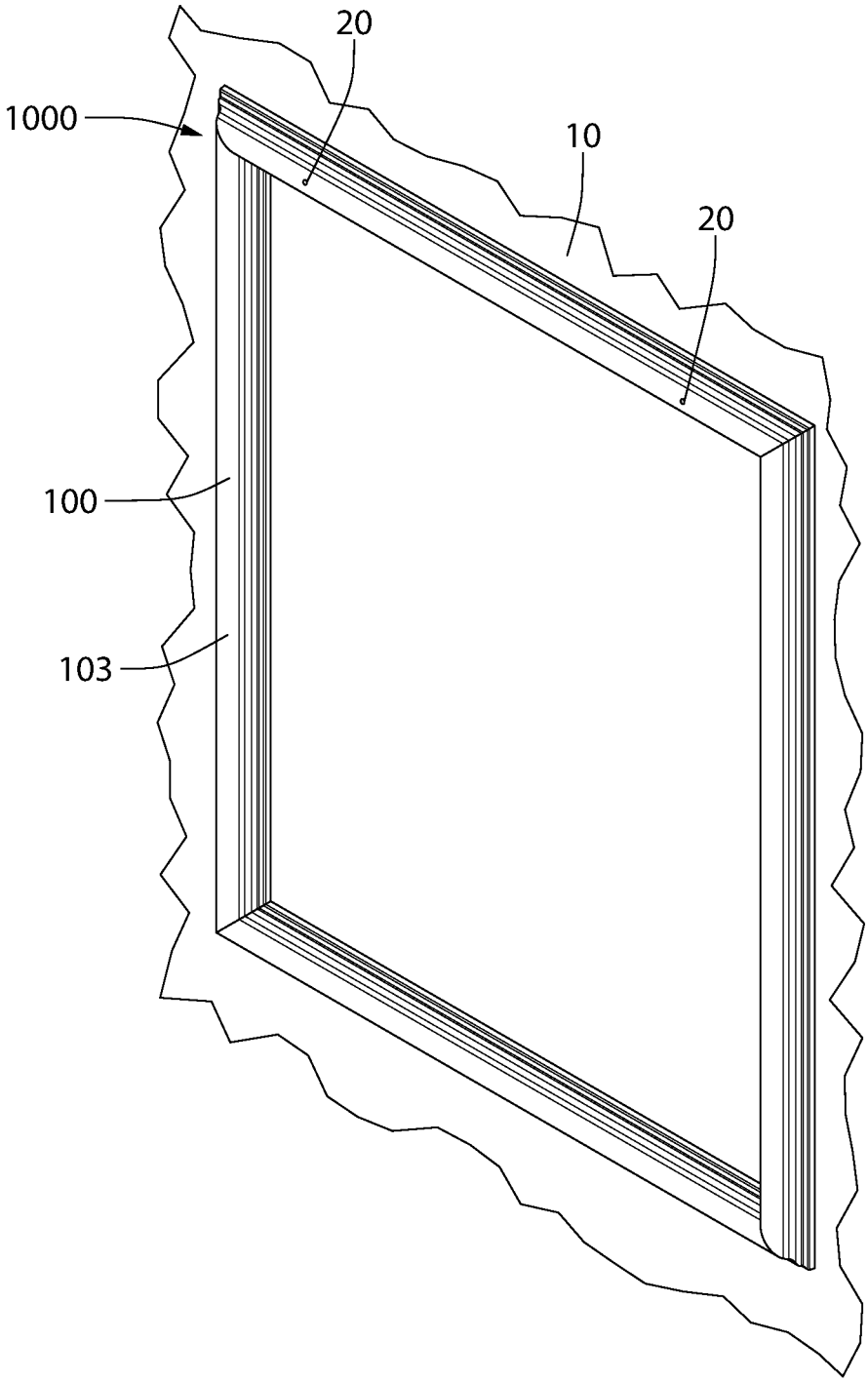

Finally, referring to FIGS. 7A and 7B, once the decorative moulding assembly 1000 has been assembled as described herein, the user can mount the decorative moulding assembly 1000 to a wall 10 or other interior surface. In the exemplified embodiment, this is achieved using nails 20, which may be brad nails or the like. In some embodiments, the decorative moulding assembly 1000 may be mounted to a wall using 18 ga to 21 ga headed brad nails that be shot from a pneumatic brad nailer gun at standard 90-100 psi from a standard Air Compressor. The moulding pieces 100 may have a thickness between 0.095" and 0.15" to make sure that the head of the nail is set or embedded into the material of the moulding piece 100 so that it can be filled with putty prior to painting. In other embodiments, the decorative moulding assembly 1000 may be attached to the wall using other means, such a screws, adhesives, tapes, glues, or the like.

Figure 8:
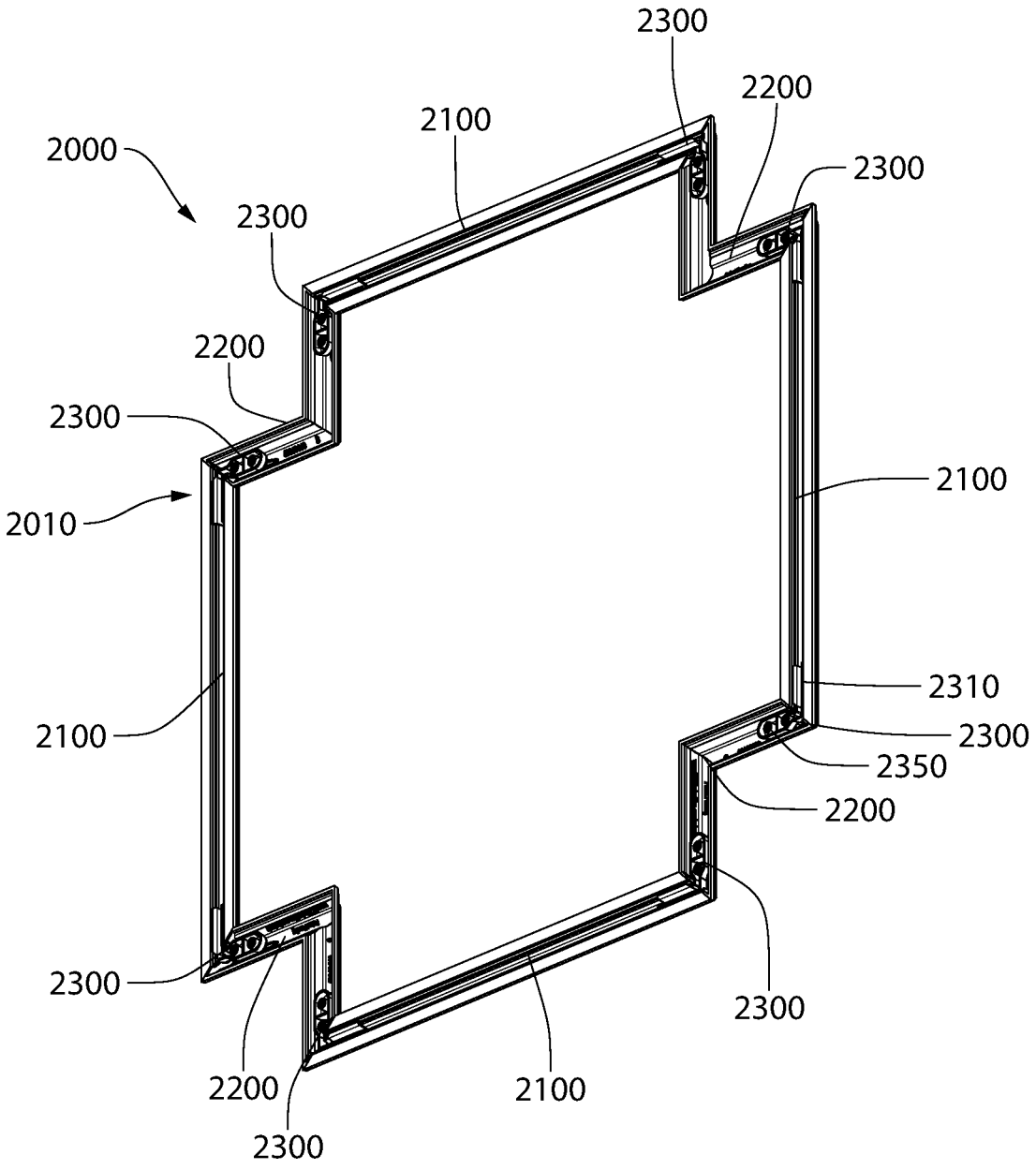
FIG. 8 is a rear perspective view of a decorative moulding assembly in accordance with a second embodiment of the present invention.
Figure 9:
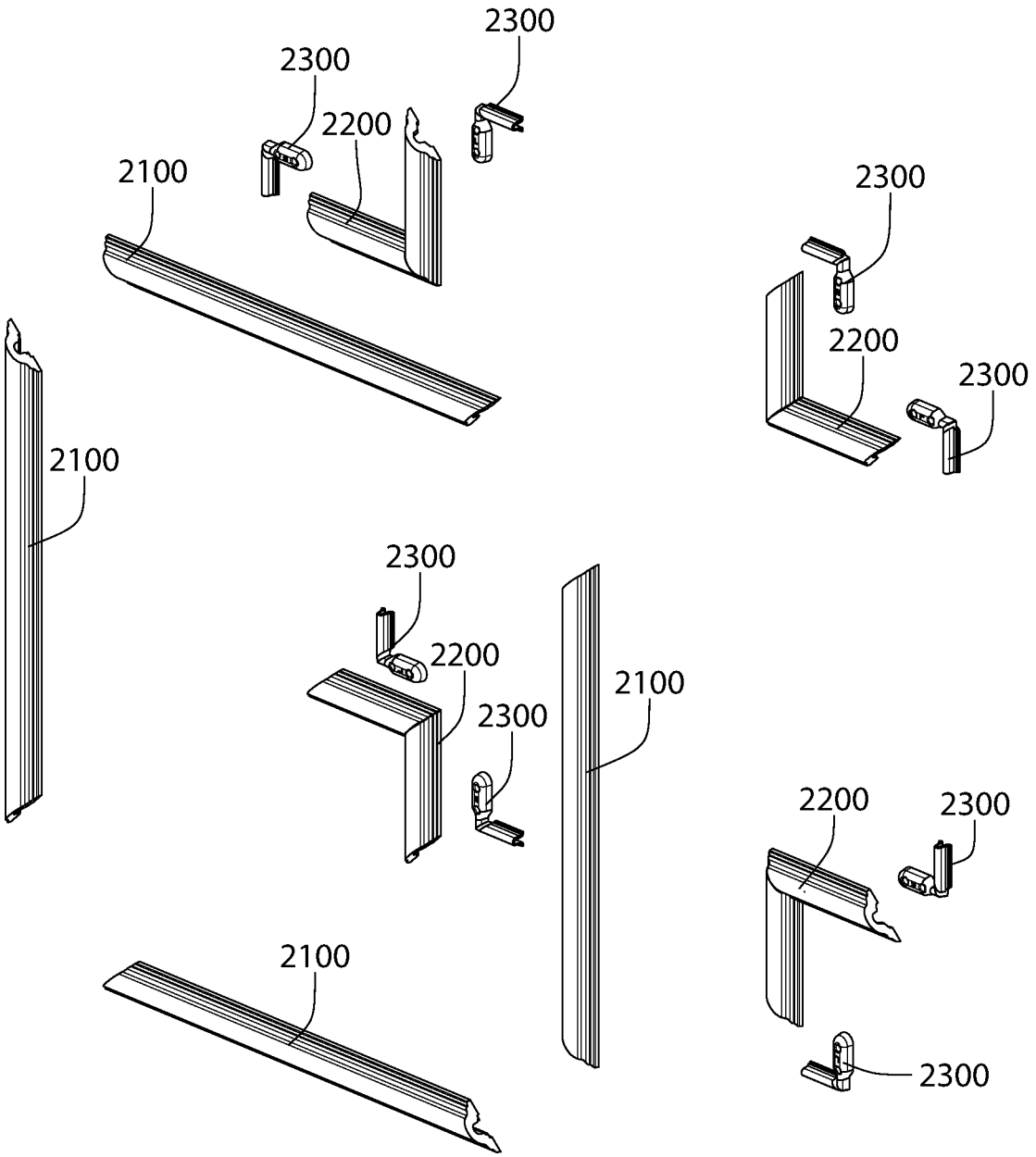
FIG. 9 is an exploded front view of the decorative moulding assembly of FIG. 8.
Figure 10:
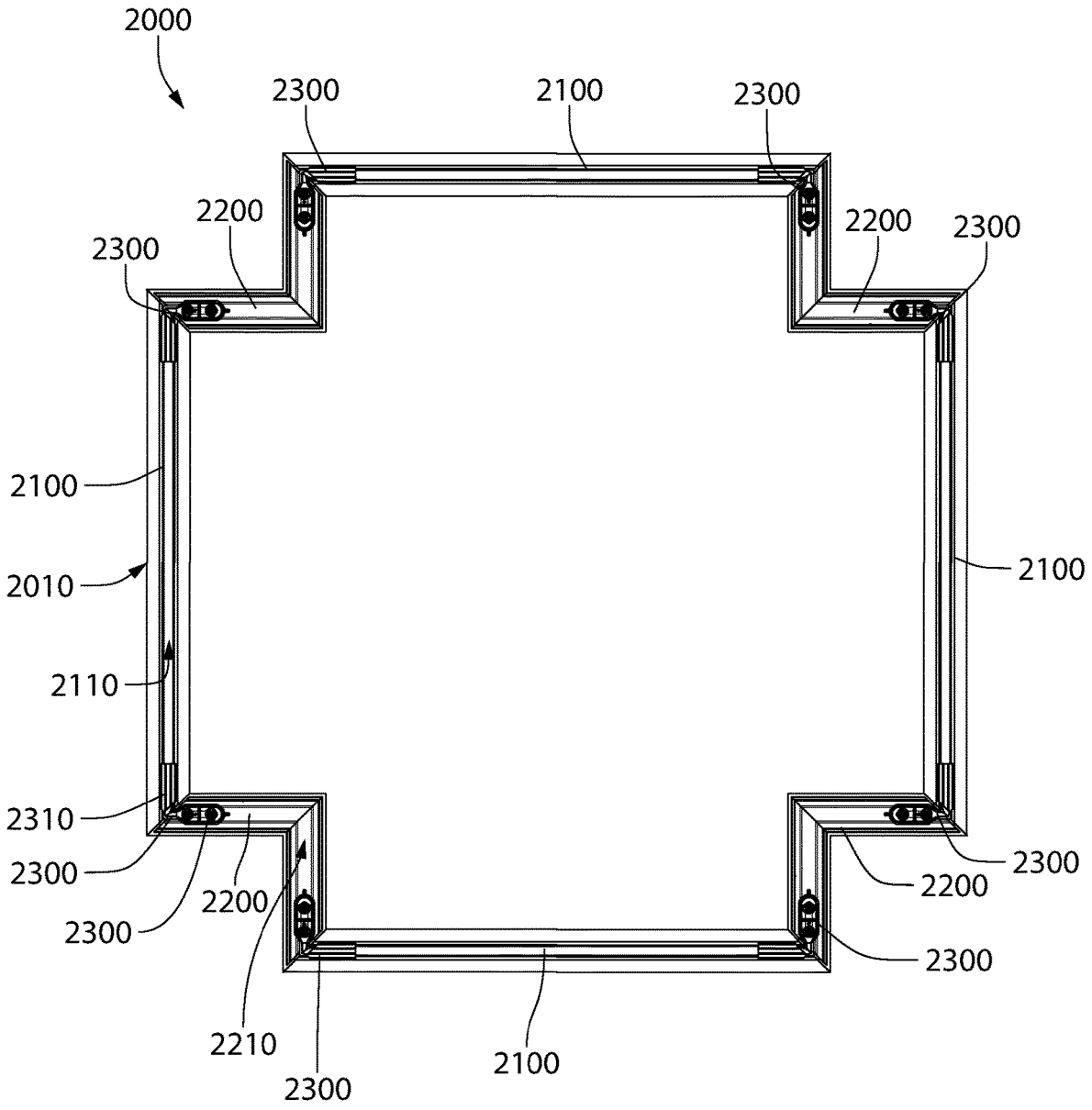
FIG. 10 is a rear view of the decorative moulding assembly of FIG. 8.
Figure 11A:
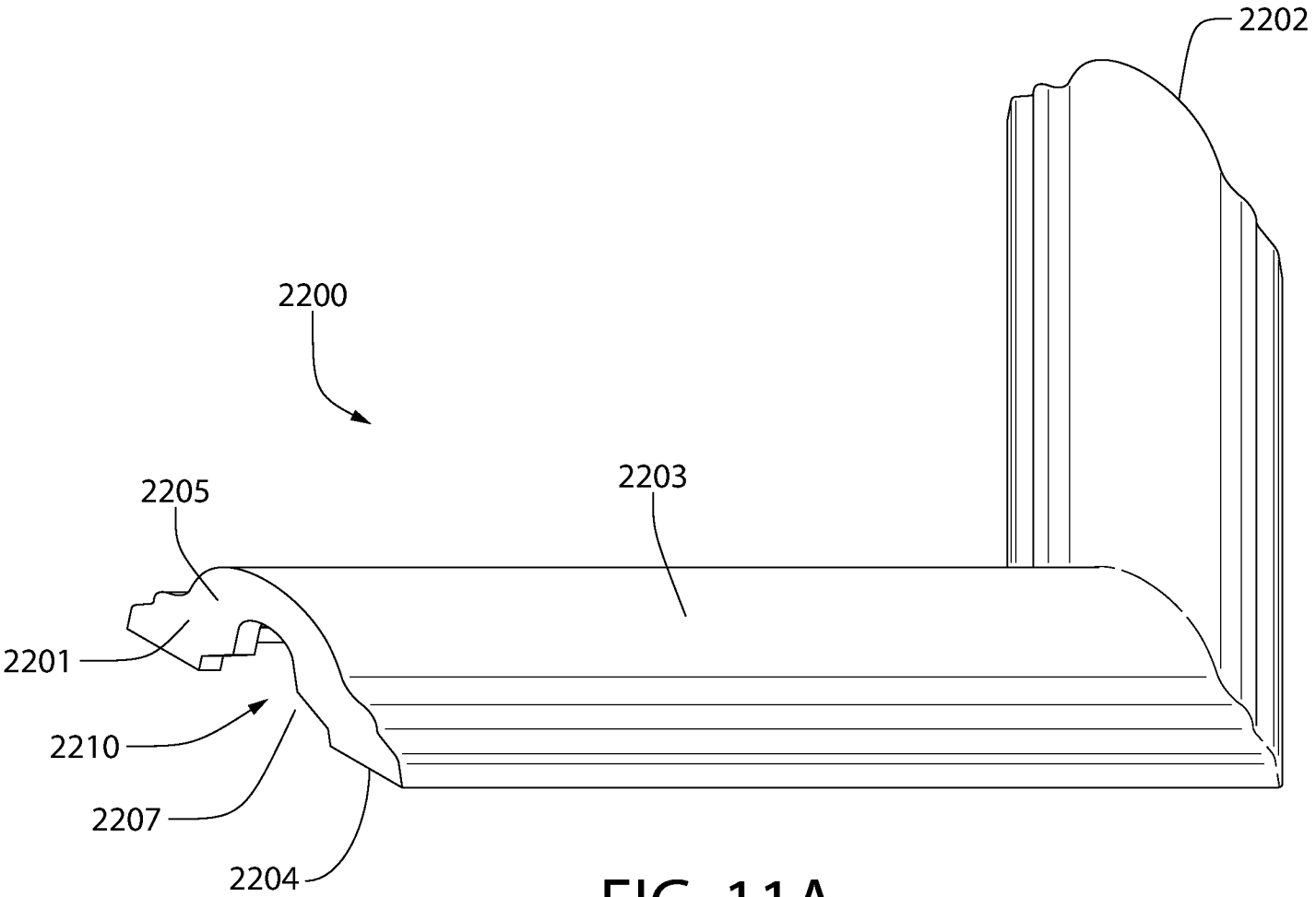
FIG. 11A is a front perspective view of a moulding piece of the decorative moulding assembly of FIG. 8.
Figure 11B:
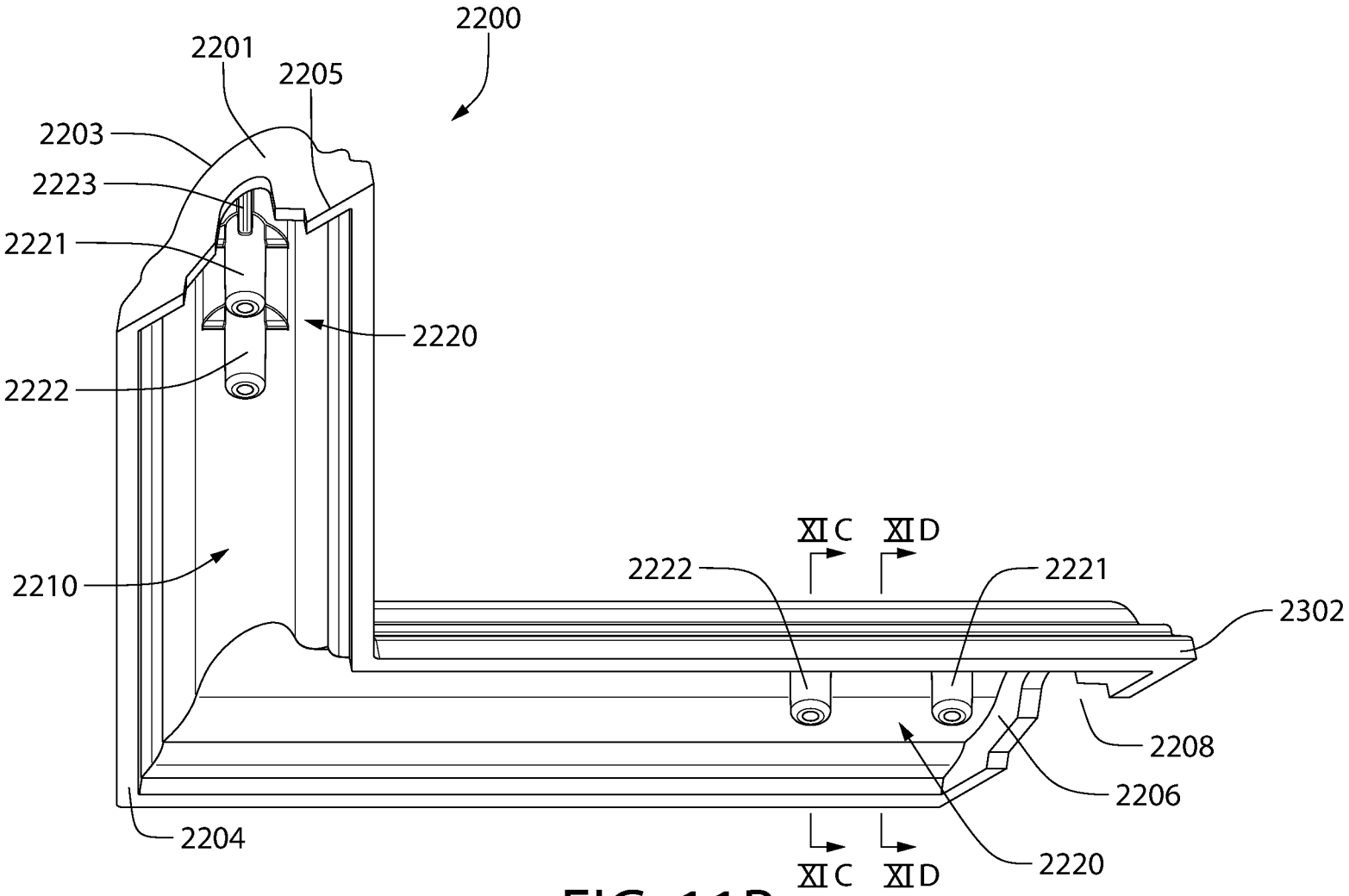
FIG. 11B is a rear perspective view of the moulding piece of FIG. 11A.
Figure 11C:
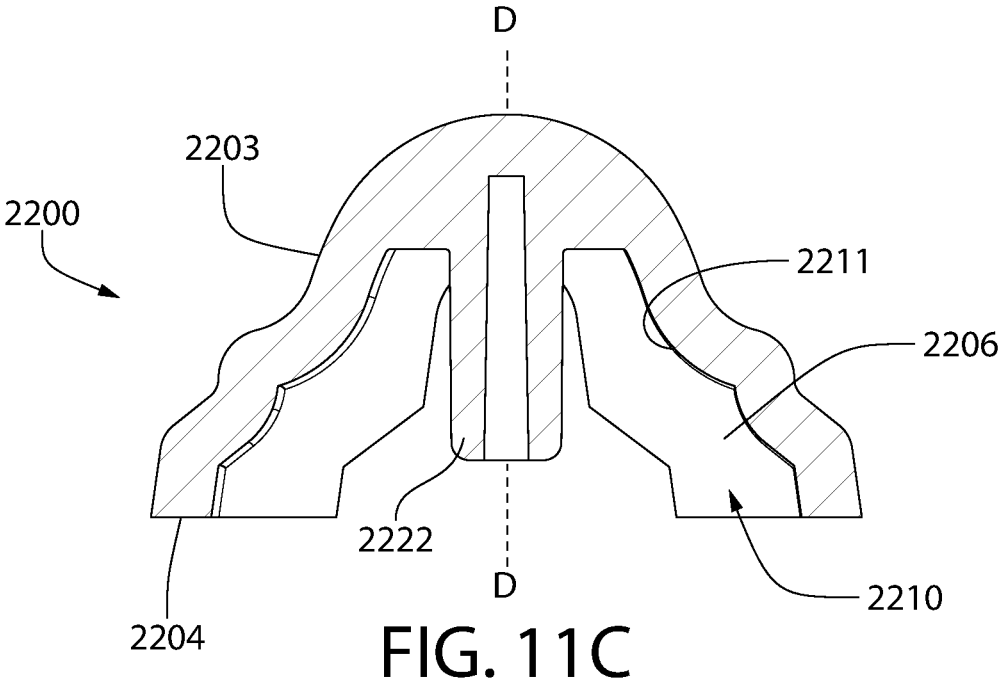
FIG. 11C is a cross-sectional view taken along line XIC-XIC of FIG. 11B.
Figure 11D:
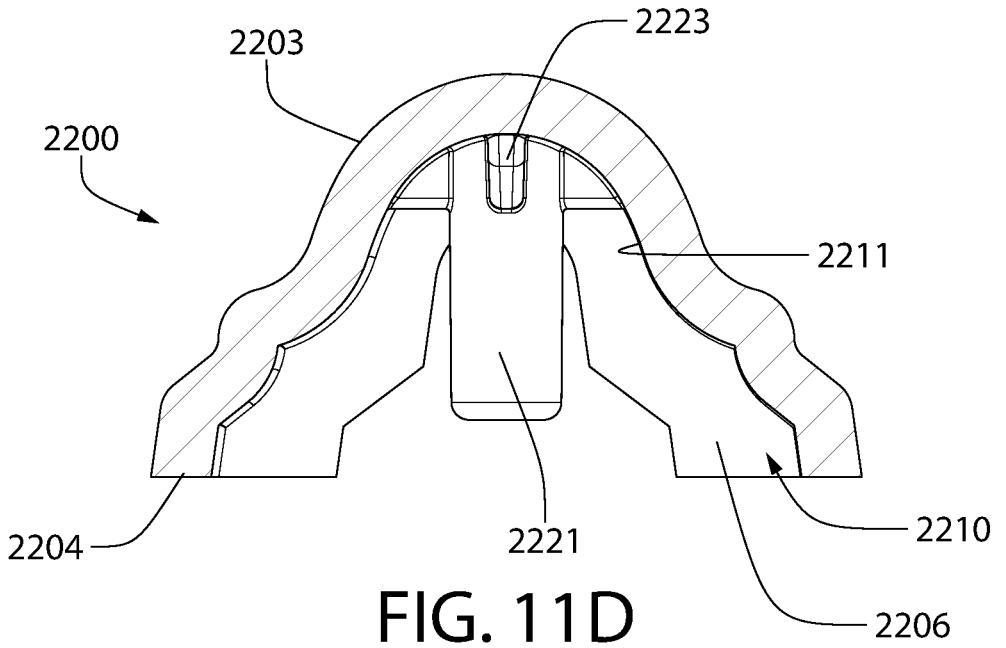
FIG. 11D is a cross-sectional view taken along line XID-XID of FIG. 11B.

Referring now to FIGS. 8-10, a decorative moulding assembly 2000 is illustrated in accordance with another embodiment of the present invention. The decorative moulding assembly 2000 is intended to be mounted to a wall or other interior surface for decorative purposes. The decorative moulding assembly 2000 is similar to the decorative moulding assembly 1000 described above, except for the nuances described herein.

The decorative moulding assembly 2000 comprises a plurality of moulding pieces 2010 and a plurality of connectors 2300. The plurality of moulding pieces 2010 comprise a plurality of first moulding pieces 2100 and a plurality of second moulding pieces 2200. The first moulding pieces 2100 are identical to the moulding pieces 100 described above. Thus, the first moulding pieces 2100 will not be described in detail here, it being understood that the description of the moulding pieces 100 with reference to FIGS. 1-7B is applicable. In the exemplified embodiment, the first moulding pieces 2100 may be extruded as described above and the second moulding pieces 2200 may be formed via injection moulding. Thus, the first moulding pieces 2100 may be extruded from polystyrene foam, polyvinyl chloride foam, or the like and the second moulding pieces 2200 may be injection molded from ABS, HIPS, PVC, or the like. The connectors 2300 may be injection molded from ABS, HIPS, PVC, or the like as well as with the prior described embodiment.

It should be noted that the second moulding pieces 2200 are injection molded rather than extruded due to their non-linear shape. Because the second moulding pieces 2200 are injection molded, they are formed with a different shape and design than the first moulding pieces 2200. In particular, the shape of the first moulding pieces 2100 cannot easily be made by injection molding due to the thickness of the material being too great, which will cause the top part to sink downwardly creating issues with the aesthetic of the exterior profile surface. The high thickness will also require a long cooling time, which will slow down the manufacturing time and therefore increase the manufacturing expense. Furthermore, forming the various engagement features with injection molding adds complexity to the manufacturing process and therefore also increases cost. Thus, the second moulding pieces 2200 which are injection molded are made with a different shape and profile as compared to the first moulding pieces 2100.

The first moulding pieces 2100 comprise channels 2110 and the second moulding pieces 2200 comprise channels 2210. The connectors 2300 comprise a first portion 2310 and a second portion 2350. When the decorative moulding assembly 2000 is assembled, the first portions 2310 of the connectors 2300 nest within the channels 2110 in the first moulding pieces 2100 and the second portions 2350 of the connectors 2300 nest within the channels 2210 in the second moulding pieces 2200. As noted above, the first moulding pieces 2100 are identical to the first moulding pieces 100 described above. Thus, the channels 2110 of the first moulding pieces 2100 are identical to the channels 110 of the first moulding pieces 100 described above. The relationship and mating interaction between the first portions 2310 of the connectors 2300 and the channels 2100 of the first moulding pieces 2100 is the same as that which was described above.

Since the first moulding pieces 2100 are identical to the first moulding pieces 100, the first moulding pieces 2100 will not be shown and described separately with reference to this embodiment. Thus, FIGS. 3A-3C and the related description are completely applicable to the first moulding pieces 2100.

Referring to FIGS. 11A-11D, the second moulding pieces 2200 will be described. The second moulding pieces 2200 are not linear. Rather, the second moulding pieces 2200 are L-shaped such that they include two linear sections that intersect, and for this reason they are unable to be formed via extrusion but are instead formed via injection molding. The second moulding pieces 2200 may be referred to as square corners, owing to their L-shape which forms a corner. While the first and second linear sections of the second moulding pieces 2200 intersect at a perpendicular angle in the exemplified embodiment, the invention is not to be so limited and other angles of intersection between the first and second linear sections of the second moulding pieces 2200 may be used in other embodiments. Due to the modification in the manufacturing technique of the second moulding pieces 2200, the same structural features which facilitate the coupling between the connecters 2300 and the first moulding pieces 2100 (which is the protuberances/grooves described above with reference to the moulding pieces 100 and the connectors 200) does not work to effectively couple the connectors 2300 to the second moulding pieces 2200. That is, the groove shapes which were formed into the first moulding pieces 2100 due to the extrusion manufacturing technique are not readily formed into the second moulding pieces 2200 which are formed using an injection molding manufacturing technique. Thus, the second moulding pieces 2200 have a different structure, at least in part, to ensure that the connectors 2300 can be sufficiently coupled thereto.

The second moulding pieces 2200 comprise a first end 2201, a second end 2202, an ornamental front surface 2203, and a rear surface 2204. The first and second ends 2201, 2202 are mitered as described above with reference to the prior embodiments. Furthermore, the ornamental front surface 2203 may have any desired profile, contours, or ornamentation, but it should match or otherwise correspond to the ornamental front surface of the first moulding pieces 2100 so that when the decorative moulding assembly 2000 is assembled, it has a seamless decorative appearance. The second moulding piece 2200 comprises a channel 2210 formed into the rear surface 2204. The channel 2210 is defined or bounded by a sidewall surface or an inner surface 2211 that has a wavy curvature. However, the invention is not to be limited by the contours or the like on the sidewall surface 2211 of the channel 2210 in all embodiments. The channel 2210 has a generally U-shaped cross sectional area, although the invention is not to be limited to this in all embodiments.

The second moulding piece 2200 comprises an engagement feature 2220 located within the channel 2210. The engagement feature 2220 is configured to engage with features on the connector 2300 for purposes of coupling the connector 2300 to the second moulding piece 2200. In the exemplified embodiment, the engagement feature 2220 comprises a first post 2221 and a second post 2222 that protrude from the sidewall surface 2211 of the channel 2210. While two posts are depicted in the exemplified embodiment, the engagement feature 2220 could comprise just one post or more than two posts in other embodiments. Thus, each engagement feature 2220 may comprise at least one post in some embodiments. Moreover, while the engagement features 2220 are illustrated as posts in the exemplified embodiment, the engagement features 2220 could be bores configured to receive posts on the connector 2300 in other embodiments. In the exemplified embodiment, the posts 2221, 2222 protrude from the sidewall surface 2211 in a direction perpendicular to a longitudinal axis of the portion of the channel 2210 within which the post 2221, 2222 is located. That is, the posts 2221, 2222 are elongated along an axis D-D which is perpendicular to the longitudinal axis of the channel 2210 within which they are positioned. The axis D-D of the posts 2221, 2222 is coaxial with the direction at which the connectors 2300 are moved relative to the second moulding pieces 2200 during attachment of the connectors 2300 to the second moulding pieces 2200.

The second moulding piece 2200 comprises two of the engagement features 2220, and more specifically two of the first posts 2221 and two of the second posts 2222. One set of the first and second posts 2221, 2222 is located along a first linear section of the second moulding piece 2200 adjacent to the first end 2201 of the second moulding piece 2200 and another set of the first and second posts 2221, 2222 is located along a second linear section of the second moulding piece 2200 adjacent to the second end 2202 of the second moulding piece 2200. Each of the sets of the first and second posts 2221, 2222 is configured to be coupled to one of the connectors 2300, as described in more detail below. The posts 2221, 2222 are generally cylindrical in shape, and in some embodiments the posts 2221, 2222 may taper slightly in diameter as they extend further from the sidewall surface 2211. In other embodiments, the posts 2221, 2222 may have a constant diameter. The posts 2221, 2222 terminate in distal end surfaces which are recessed relative to the rear surface 2204 of the second moulding piece 2200. That is, the posts 2221, 2222 do not extend or protrude beyond the rear surface 2204 of the second moulding piece 2200.

The second moulding pieces 2200 have a first end wall 2205 located at the first end 2201 thereof and a second end wall 2206 located at the second end 2202 thereof. The end walls 2205, 2206 form an end point of the channel 2210. Furthermore, each of the end walls 2205, 2206 comprises a notch or opening 2207, 2208 formed therein which provides a passageway into the channel 2210. Thus, while a portion of the connector 2300 nests within the channel 2210, another portion of the connector 2300 extends through one of the openings 2207, 2208 and protrudes from one of the first and second ends 2201, 2202 of the second moulding piece 2200. The engagement features 2220 may also comprise ribs 2223 that extend between the posts 2221, 2222 and/or between the post 2221 and end walls 2205, 2206 of the second moulding piece 2200 to increase the structural rigidity of the parts.

Figure 12A:
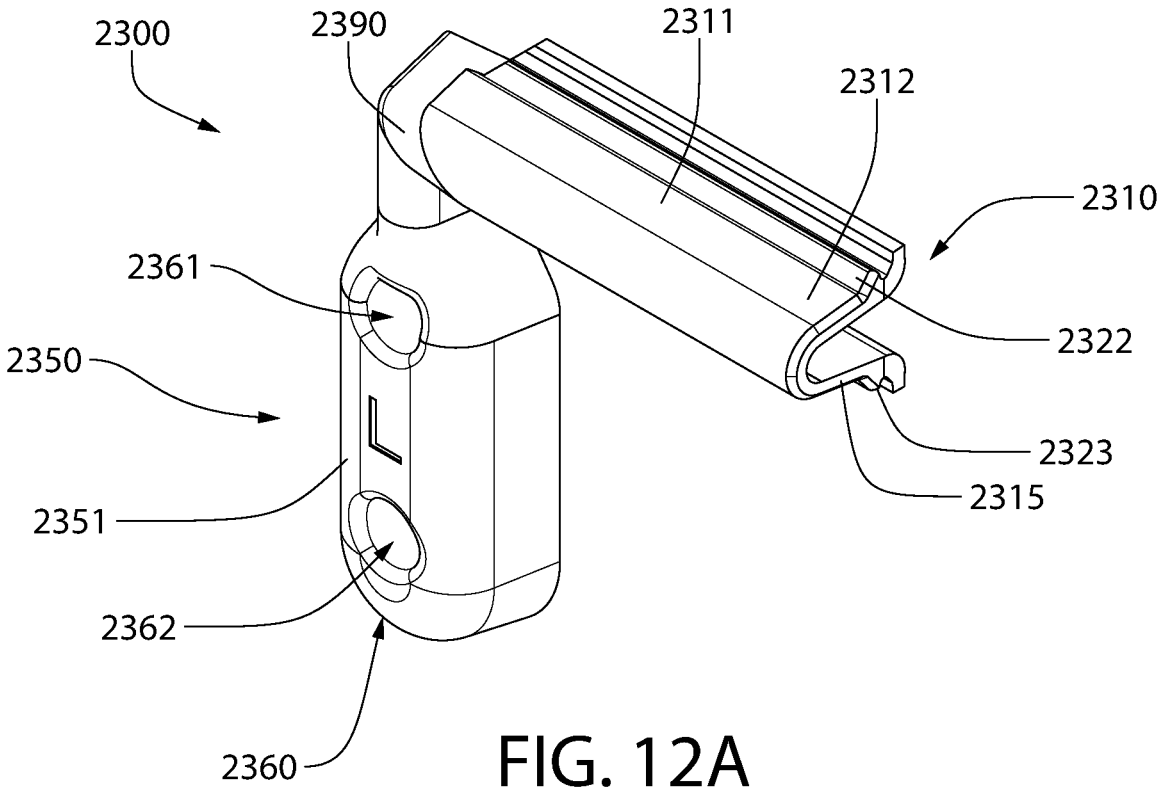
FIG. 12A is a front perspective view of a connector of the decorative moulding assembly of FIG. 8.
Figure 12B:
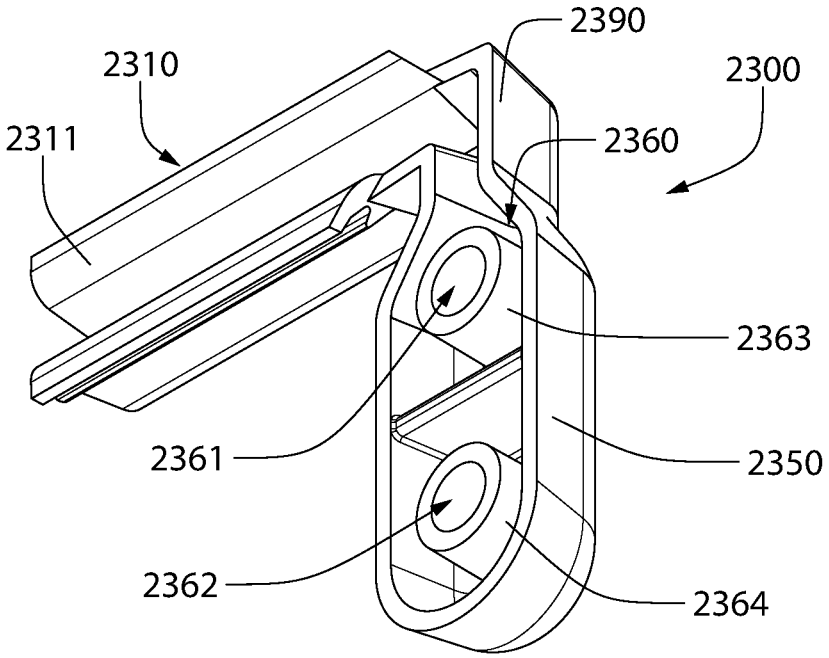
FIG. 12B is a rear perspective view of the connector of FIG. 12A.

Referring to FIGS. 12A and 12B, the connector 2300 will be described. The connector 2300 comprises the first portion 2310 and the second portion 2350, as noted above. In this embodiment, the connector 2300 has a generally L shape, such that the first and second portions 2310, 2350 are oriented perpendicularly relative to one another. Moreover, an L-shaped connection portion 2390 extends between the first and second portions 2310, 2350 and couples them together. The connector 2300 is a monolithic, unitary part that comprises the first and second portions 2310, 2350 and the connector portion 2390, although the connector portion 2390 could be omitted in some embodiments. However, the invention is not to be so limited and in various other embodiments the first and second portions 2310, 2350 may be oriented at any desired angle relative to one another, including coaxial in some embodiments.

The first portion 2310 of the connector 2300 is identical to the first and second portions 210, 250 of the connector 200 described above. In particular, the first portion 2310 of the connector 2300 is configured to nest within and mate with the channel 2110 of one of the first moulding pieces 2100, which is identical to the moulding pieces 100 described above. Thus, the first portion 2310 of the connector 2300 is identical to the first and second portions 210, 250 of the connector 200 to enable this functionality. The first portion 2310 of the connector 2300 comprises a U-shaped body 2311 having a first leg 2312 and a second leg 2315. There is an engagement feature which comprises a first protuberance 2322 protruding from the first leg 2312 and a second protuberance 2323 protruding from the second leg. The first and second protuberances 2322, 2323 nest within grooves in the channel 2110 which is consistent with the description of the prior embodiment. That is the engagement between the first portion 2310 of the connector 2300 and the first moulding piece 2100 is the same as that which is depicted in FIG. 6E and thus a repeat illustration of this mating structure is not provided with regard to this embodiment because the prior illustration and description is applicable.

The second portion 2350 of the connector 2300 has a completely different shape and structure than the first portion 2310 of the connector 2300. This is mainly because the second portion 2350 of the connector 2300 is configured to engage with the engagement features 2220 of the second moulding pieces 2200, which are different than the engagement features (i.e., the grooves) of the first moulding pieces 2100. While an exemplary embodiment is provided herein which shows a specifically shaped first portion 2310 and second portion 2350, the invention is not to be limited by the specific shapes shown for all embodiments. In some embodiments, the invention may be directed to the connector 2300 which has differently shaped first and second portions 2310, 2350 without being limited to a specific shape thereof. In the exemplified embodiment, the second portion 2350 comprises an oval-shaped body 2351. However, it should be appreciated that the shape of the body 2351 may be different than that which is shown in the exemplified embodiment in other embodiments. For example, the body 2351 may be circular, square, rectangular, triangular, or the like in other embodiments. The body 2351 comprises an engagement feature 2360 that is configured to mate with the engagement feature 2220 (i.e., the posts 2221, 2222) of the second moulding piece 2200.

In particular, the body 2351 comprises a first bore 2361 and a second bore 2362. The first bore 2361 is surrounded by a first annular wall 2363 and the second bore 2362 is surrounded by a second annular wall 2364. The first and second bores 2361 may have a diameter which is tapered or constant, much like the discussion of the tapering or constant diameter of the posts 2221, 2222 above. The first and second bores 2361, 2362 are configured to receive the first and second posts 2221, 2222 in a press-fit or friction fit or interference fit manner to facilitate the coupling of the connector 2300 to the second moulding piece 2200.

Thus, in this embodiment, the engagement feature of the first portion 2310 of the connector 2300, which is formed by the protuberances 2322, 2323, is different than the engagement feature of the second portion 2350 of the connector 2300, which is formed by the bores 2361, 2362. While the first portion 2310 of the connector 2300 is configured to be coupled to the first moulding piece 2100 via a snap-fit connection, the second portion 2350 of the connector 2300 is configured to be coupled to the second moulding piece 2200 via a press-fit connection. As mentioned above, this is due, at least in part, to the fact that the first moulding piece 2100 is linear and therefore formed by extrusion and the second moulding part 2200 is non-linear and therefore formed by injection molding. Again, while specific embodiments of the engagement features of the first and second portions 2310, 2350 is shown in the drawings, the invention is not to be limited by the specific embodiments as shown unless specifically claimed as such.

Figure 13A:
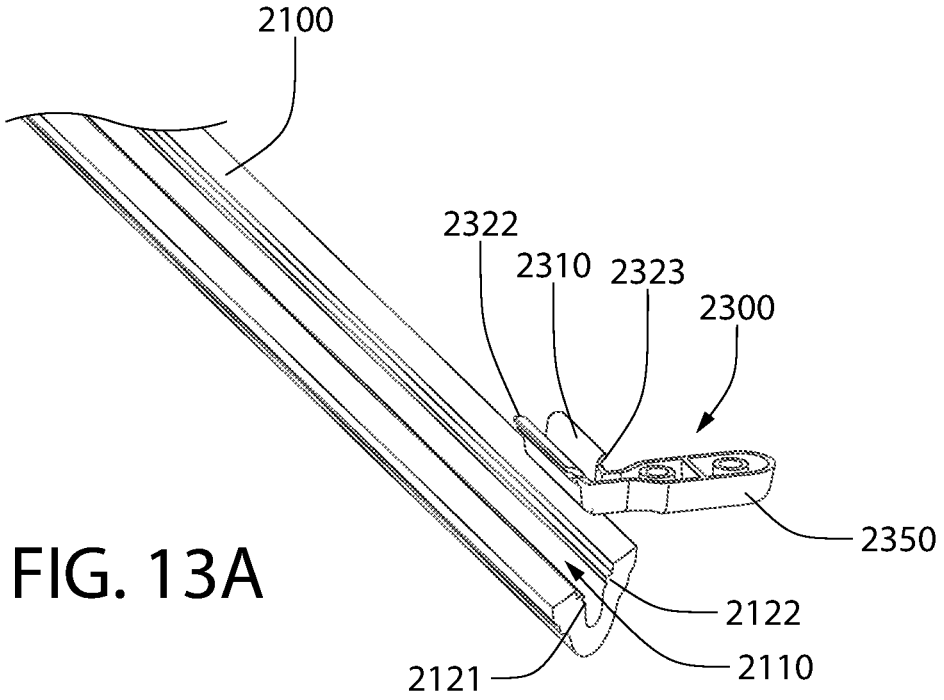
FIGS. 13A-13E illustrate the process of coupling the connector of FIGS. 12A and 12B to various moulding pieces to form the decorative moulding assembly of FIG. 8.
Figure 13B:
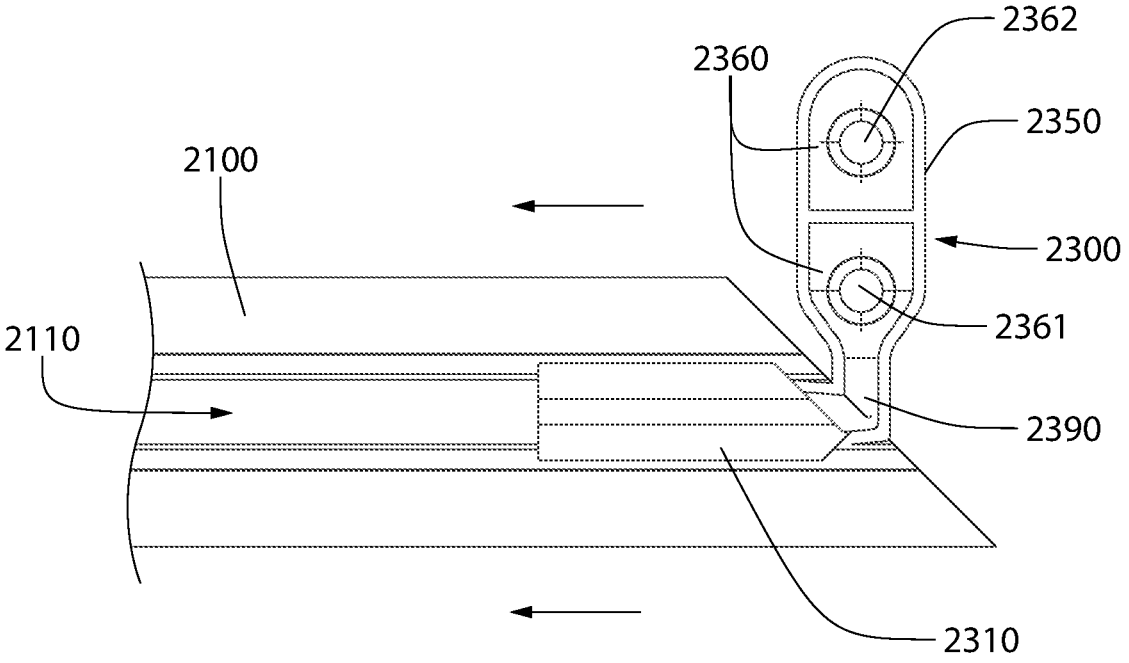

Referring sequentially to FIGS. 13A-13E, the manner in which the connector 2300 is coupled to one of the first moulding pieces 2100 and one of the second moulding pieces 2200 will be described. First, FIGS. 13A and 13B illustrate the connector 2300 being coupled to the first moulding piece 2100. The first portion 2310 of the connector 2300 is aligned with the channel 2110 of the first moulding piece 2100. Next, the first portion 2310 of the connector 2300 is moved towards the channel 2110 until the first portion 2310 of the connector 2300 nests within the channel 2110. During this movement of the first portion 2310 of the connector 2300 into the channel 2110 of the first moulding piece 2100, the first portion 2310 of the connector 2300 becomes snap-fit connected to the first moulding piece 2100 due to the engagement between the protuberances 2322, 2323 of the connector 2300 and the grooves 2121, 2122 of the channel 2110 of the first moulding piece 2100. That is, the first portion 2310 of the connector 2300 simply needs to be pressed into the channel 2110 of the first moulding piece 2100 to engage the various engagement features of the connector 2300 and the first moulding piece 2100 to snap-fit couple the connector 2300 to the first moulding piece 2100. The details of the engagement between the first portion 2310 of the connector 2300 and the first moulding piece 2100 is the same as that which is depicted in FIG. 6E described above.

Figure 13C:
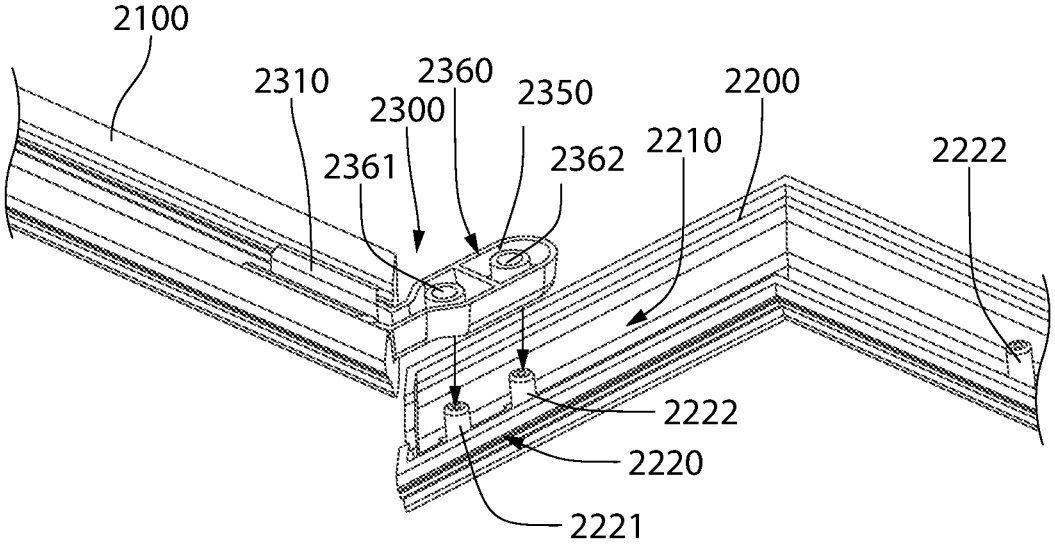
Figure 13D:
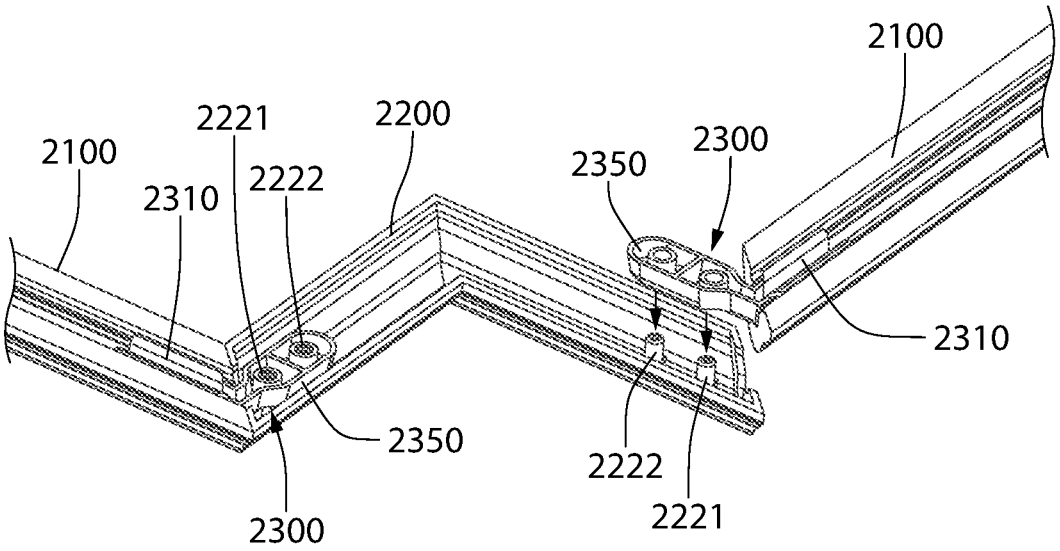

Next, referring to FIGS. 13C and 13D, the second portion 2350 of the connector 2300 is coupled to one of the second moulding pieces 2200. That is, when the first portion 2310 of the connector 2300 is coupled to the first moulding piece 2100, the second portion 2350 of the connector 2300 protrudes or extends from the end of the first moulding piece 2100 and is therefore accessible for coupling to the second moulding piece 2200. To couple the second moulding piece 2200 to the second portion 2350 of the connector 2300, the first and second posts 2221, 2222 of the engagement feature 2220 of the second moulding piece 2200 are aligned with the first and second bores 2361, 2362 of the engagement feature 2360 of the second portion 2350 of the connector 2300. The second portion 2350 of the connector 2300 is then move into the channel 2210 of the second moulding piece 2200, during which the first and second posts 2221, 2222 of the second moulding piece 2200 enter into the bores 2361, 2362 of the second portion 2350 of the connector 2300. The connector 2300 continues to be pressed into the channel 2210 until the first and second posts 2221, 2222 are fully nested within the bores 2361, 2362. The posts 2221, 2222 and the bores 2361, 2362 may have various diameters or cross-sectional areas that allow for the engagement therebetween to be a press fit or friction fit or interference fit, which ensures that the second portion 2350 of the connector 2300 stays coupled to the second moulding piece 2200 via friction.

Figure 13E:
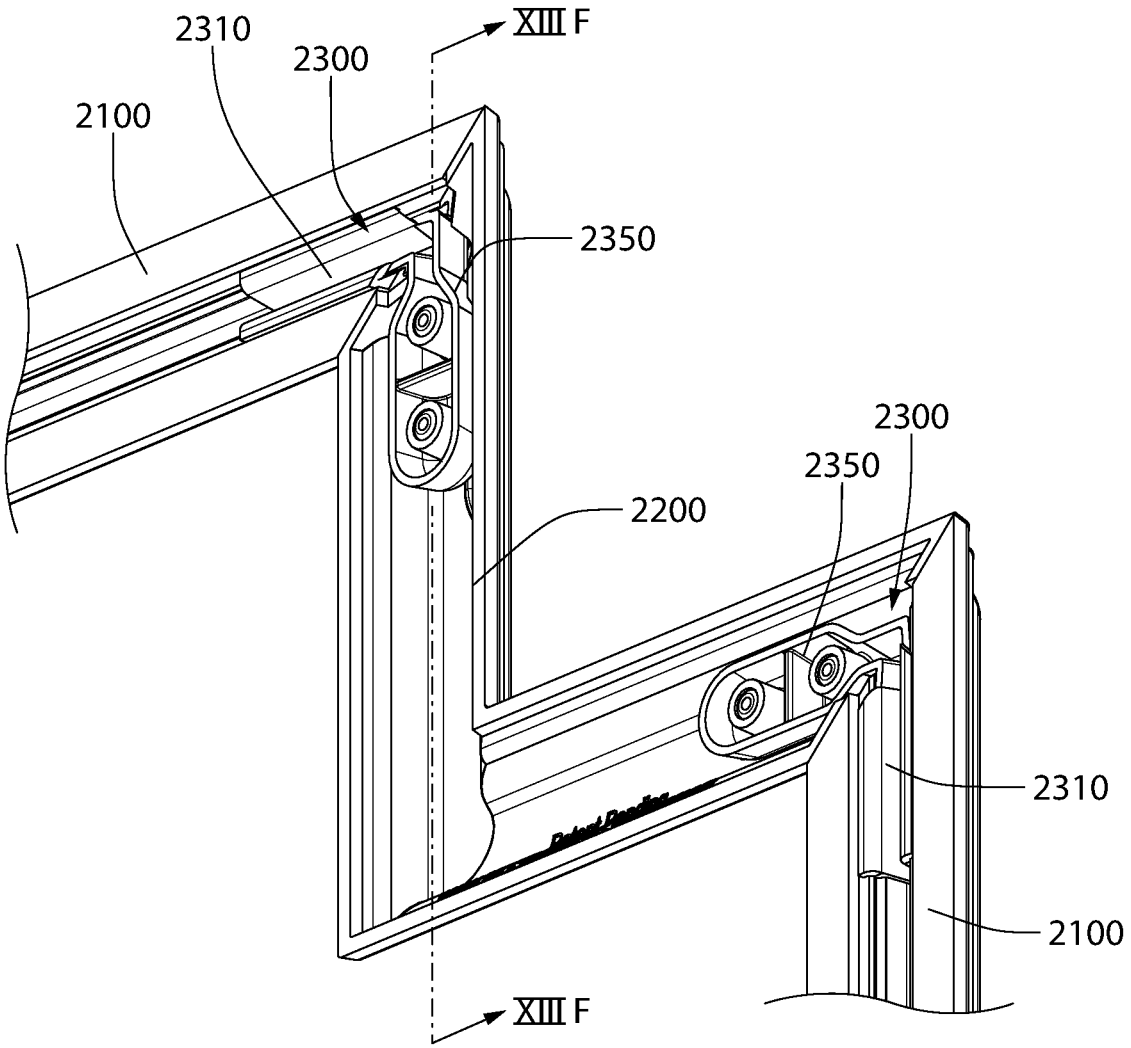

As mentioned above, the second moulding piece 2200 comprises two sets of the engagement features 2220 (i.e., two sets of the posts 2221, 2222). Thus, FIG. 13D illustrates a second connector 2300 which is coupled to yet another one of the first moulding pieces 2100 being attached to the second set of posts 2221, 2222 on the second moulding piece 2200. FIG. 13E illustrates one of the second moulding pieces 2200 being coupled to two distinct ones of the first moulding pieces 2100 with two distinct ones of the connectors 2300. This connection process continues until the decorative moulding assembly 2000 is assembled into the desired shape, such as the shape shown in FIGS. 8 and 10.

Figure 13F:
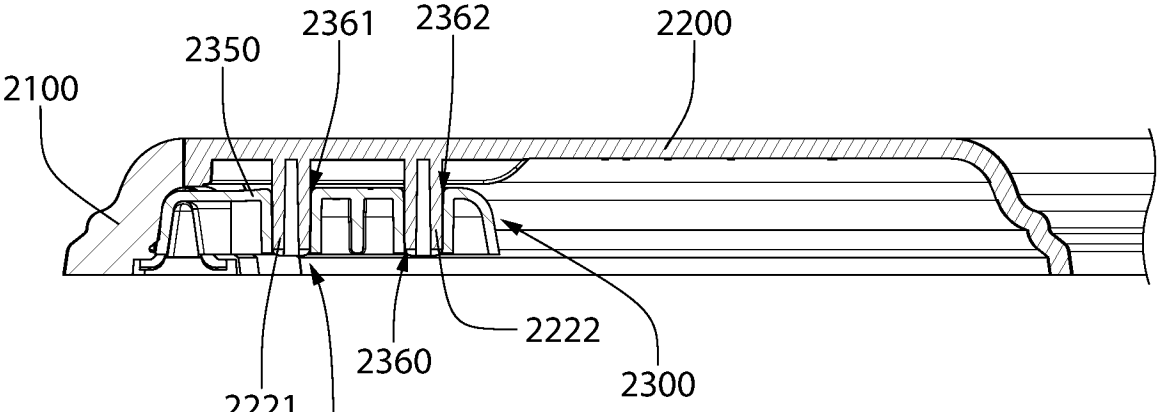
FIG. 13F is a cross-sectional view taken alone line XIIIF-XIIIF of FIG. 13E.

FIG. 13F is a cross-sectional view which illustrates the interaction between the posts 2221, 2222 of the second moulding piece 2200 and the bores 2361, 2362 of the second portion 2350 of the connector 2300. The posts 2221, 2222 nest within the bores 2361, 2362 in a tight fit (i.e., press fit, friction fit, or interference fit) so that the posts 2221, 2222 cannot be removed from the bores 2361, 2362 without some user force being applied onto the connector 2300 relative to the second moulding piece 2200. To reiterate what was stated previously, the interaction between the first portion 2310 of the connector 2300 and the first moulding piece 2100 is exactly the same as that which is shown in FIG. 6E.

Thus, in this embodiment the connector 2300 comprises the first portion 2310 and the second portion 2350, each with different types of engagement features. Furthermore, the first and second moulding pieces 2100, 2200 have different types of engagement features for mating with the different engagement features of the first and second portions 2310, 2350 of the connector 2300, respectively.

Figure 14:
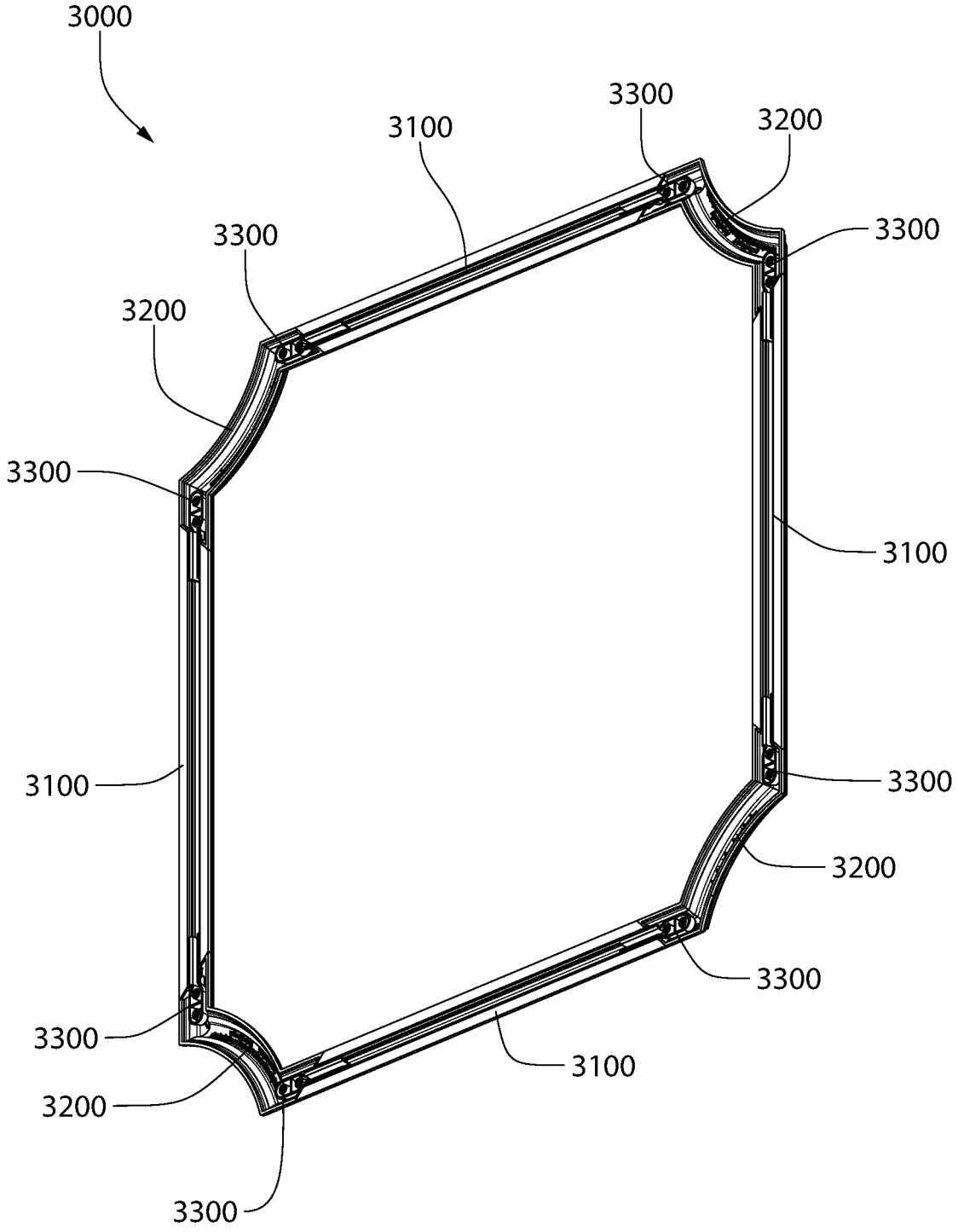
FIG. 14 is a rear perspective view of a decorative moulding assembly in accordance with a third embodiment of the present invention.
Figure 15:
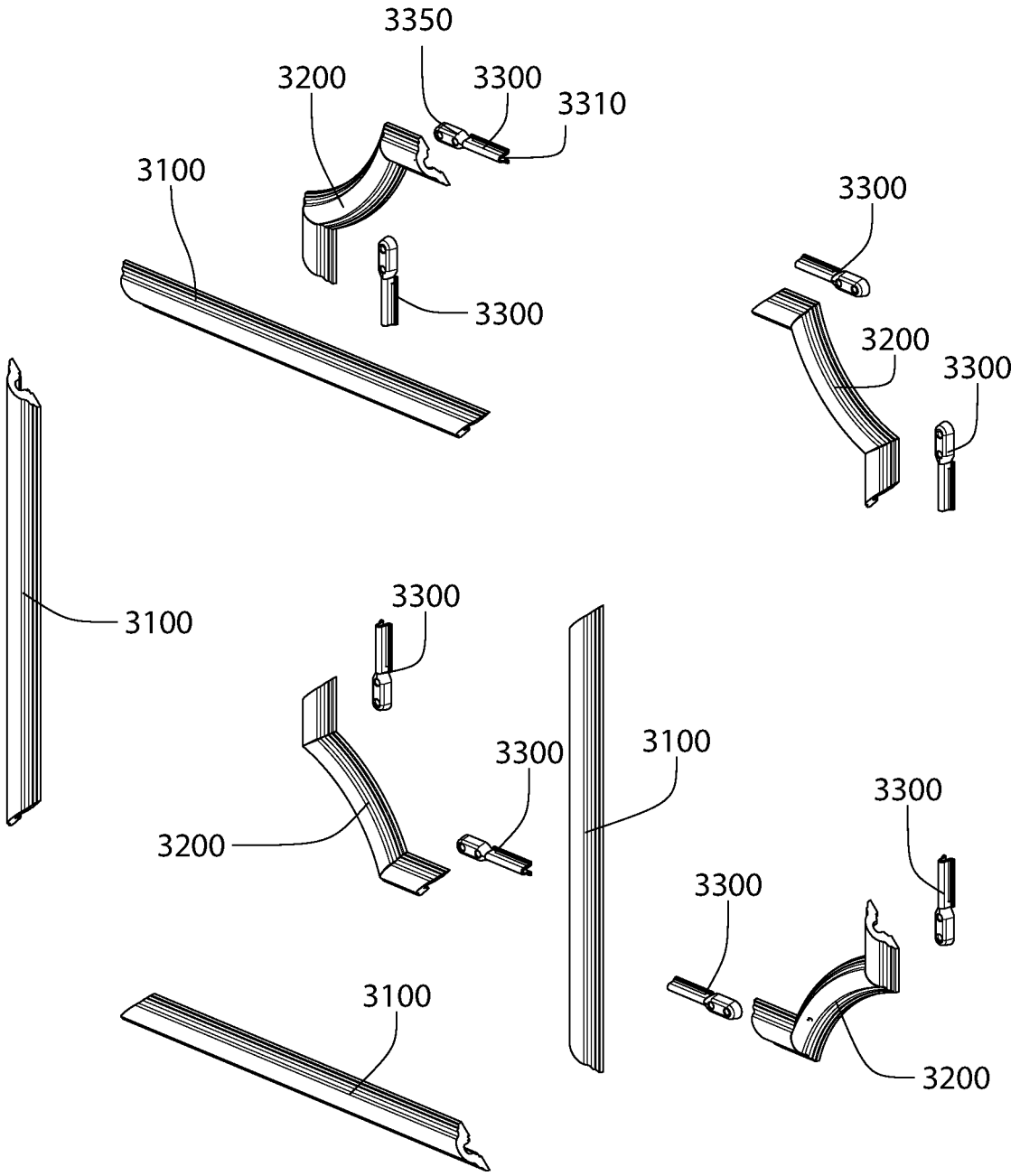
FIG. 15 is an exploded front view of the decorative moulding assembly of FIG. 14.
Figure 16:
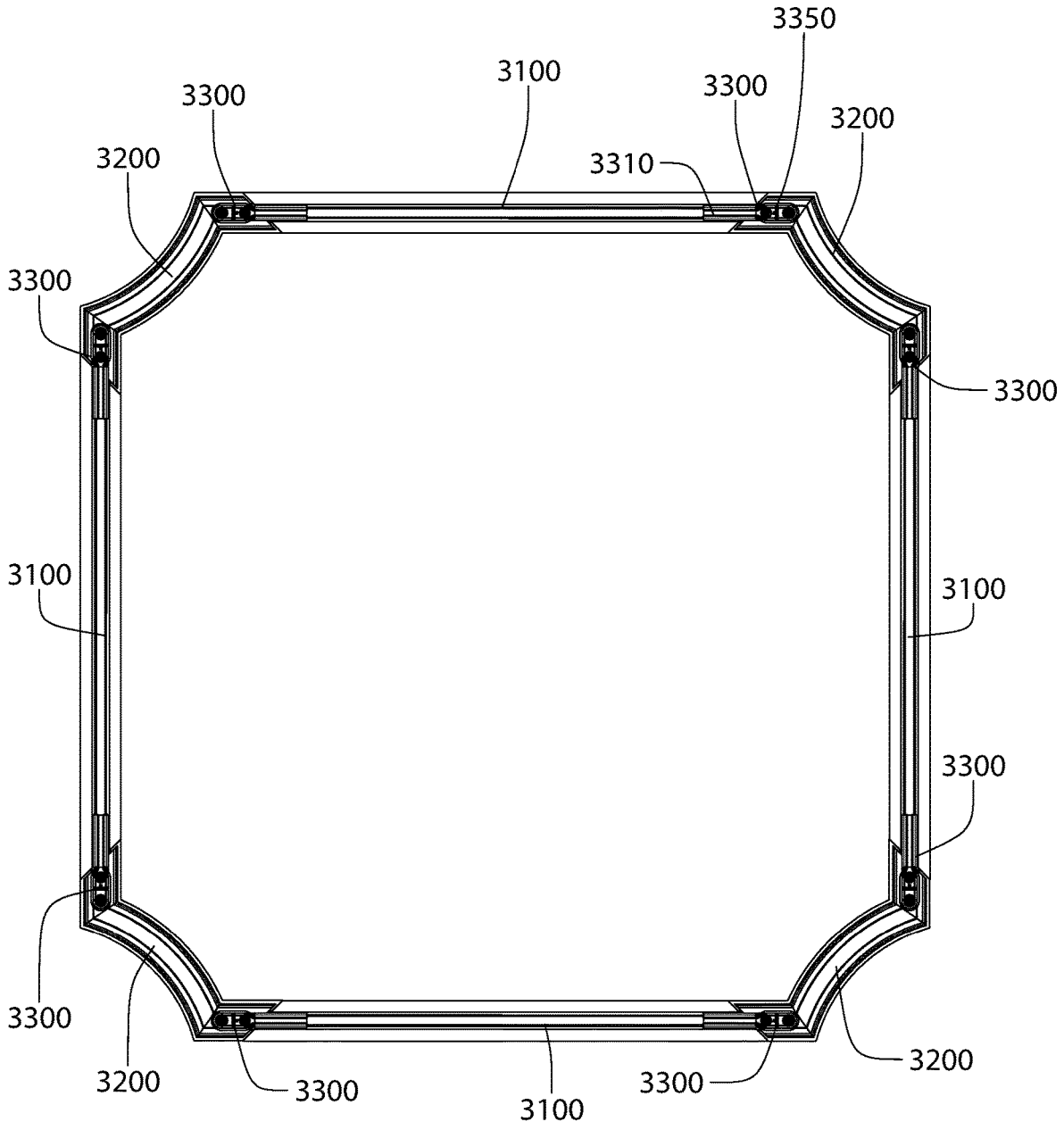
FIG. 16 is a rear view of the decorative moulding assembly of FIG. 14.

Referring to FIGS. 14-16, a decorative moulding assembly 3000 will be described in accordance with another embodiment of the present invention. The decorative moulding assembly 3000 generally comprises a plurality of first moulding pieces 3100, a plurality of second moulding pieces 3200, and a plurality of connectors 3300 for coupling the first and second moulding pieces 3100, 3200 together. As with the embodiment described above, the first moulding pieces 3100 are extruded preferably from polystyrene foam or polyvinyl chloride foam (although other materials are possible) and the second moulding pieces 3200 and the connectors 33300 are injection molded from a material selected from ABS, HIPS, and PVC, although other materials are possible in other embodiments.

The decorative moulding assembly 3000 is very similar to the decorative moulding assembly 2000 described above, except with regard to the shape of the second moulding pieces 3200 and the shape of the connectors 3300. In particular, the first moulding pieces 3100 are identical to the first moulding pieces 2100 and to the moulding pieces 100, and thus a detailed description of the first moulding pieces 3100 will not be provide, it being understood that the description of the first moulding pieces 2100, 100 is entirely applicable. The second moulding pieces 3200 are identical to the second moulding pieces 2200, except with regard to their shape. That is, the second moulding pieces 2200 are L-shaped to form a square corner, whereas the second moulding pieces 3200 are arcuate shaped with linear ends, to form a scalloped corner of the decorative moulding assembly 300. Some detail of the second moulding pieces 3200 will be provided herein, but it should be appreciated that many features of the second moulding pieces 3200 are the same as features previously described with reference to the second moulding pieces 2200 and such features may not be described here in the interest of brevity. Finally, the connectors 3300 are similar to the connectors 2300 described above, except with regard to the orientation of the portions thereof. That is, the connectors 3300 comprise first portions 3310 and second portions 3350 which are identical to the first and second portions 2310, 2350 of the connectors 2300 described above. However, the first and second portions 3310, 3350 are oriented in a linear fashion such that they are coaxial relative to one another rather than perpendicular to one another. The description of the first and second portions 2310, 2350 of the connectors 2300 is applicable to the first and second portions 3310, 3350 of the connectors 3300, except with regard to the orientation of the first and second portions 3310, 3350 relative to one another.

Figure 17A:
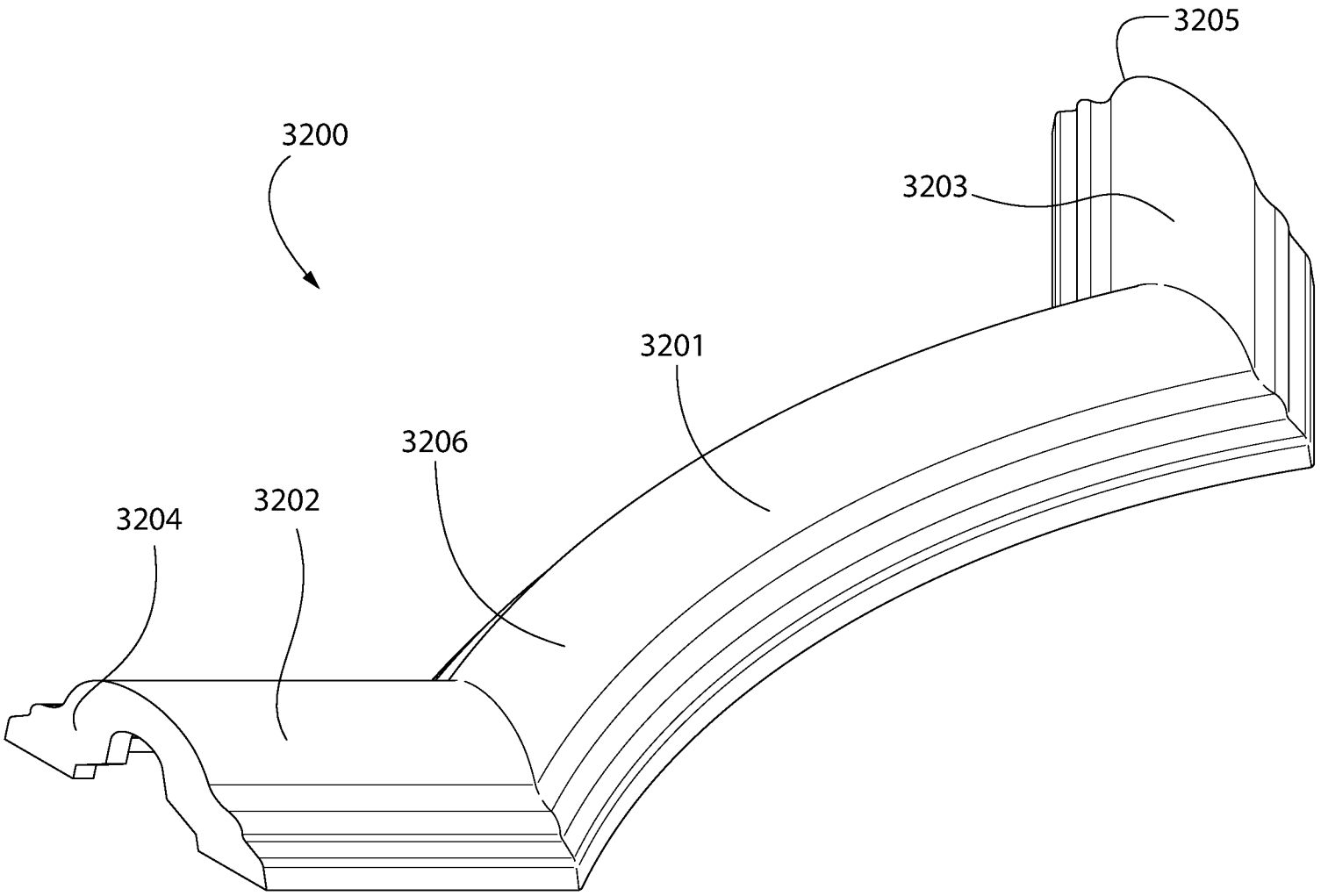
FIG. 17A is a front perspective view of a moulding piece of the decorative moulding assembly of FIG. 14.
Figure 17B:
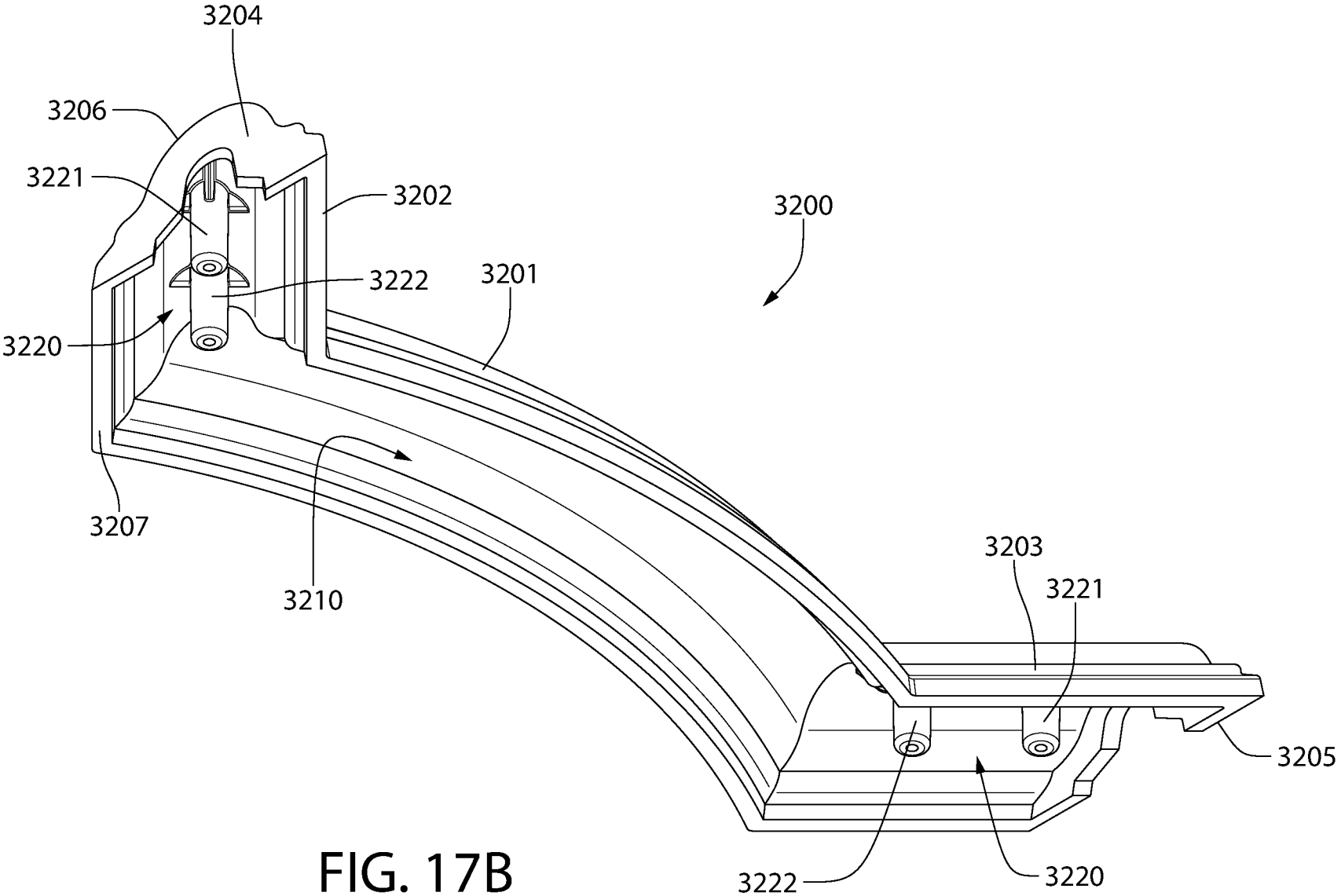
FIG. 17B is a rear perspective view of the moulding piece of FIG. 17A.

Referring to FIGS. 17A and 17B, the second moulding pieces 3200 will be described. The second moulding pieces 3200 comprise an arcuate section 3201, a first linear section 3202, and a second linear section 3203. The arcuate section 3201 is positioned between the first and second linear sections 3202, 3203 such that the second moulding pieces 3200 form a shape of a scalloped corner for the decorative moulding assembly 3000. The second moulding piece 3200 comprises a first end 3204, a second end 3205, an ornamental front surface 3206, and a rear surface 3207. The first and second ends 3204, 3205 may be mitered ends as described above. Furthermore, the second moulding piece 3200 comprises a channel 3210 formed into the rear surface 3207.

The second moulding piece 3200 comprises two engagement features 3220 such that one of the engagement features 3220 is located adjacent to each of the first and second ends 3204, 3205 for purposes of coupling to the connectors 3300. That is, one of the engagement features 3220 is located along the first linear section 3202 of the second moulding piece 3200 and the other one of the engagement features 3220 is located along the second linear section 3203 of the second moulding piece 3200. Each of the engagement features 3220 is identical to the engagement features 2220 of the second moulding piece 2200 described above. That is, each of the engagement features 3220 comprises a first post 3221 and a second post 3222. The first and second posts 3221, 3222 extend from the surface which defines the channel 3210 in a direction that is perpendicular to the longitudinal axis of the channel 3210 within which the first and second posts 3221, 3222 are located. In the exemplified embodiment, the arcuate section 3201 is devoid of any engagement features because the connectors 3300 only couple to the second moulding piece 3200 along the first and second linear sections 3202, 3203.

Figure 18A:
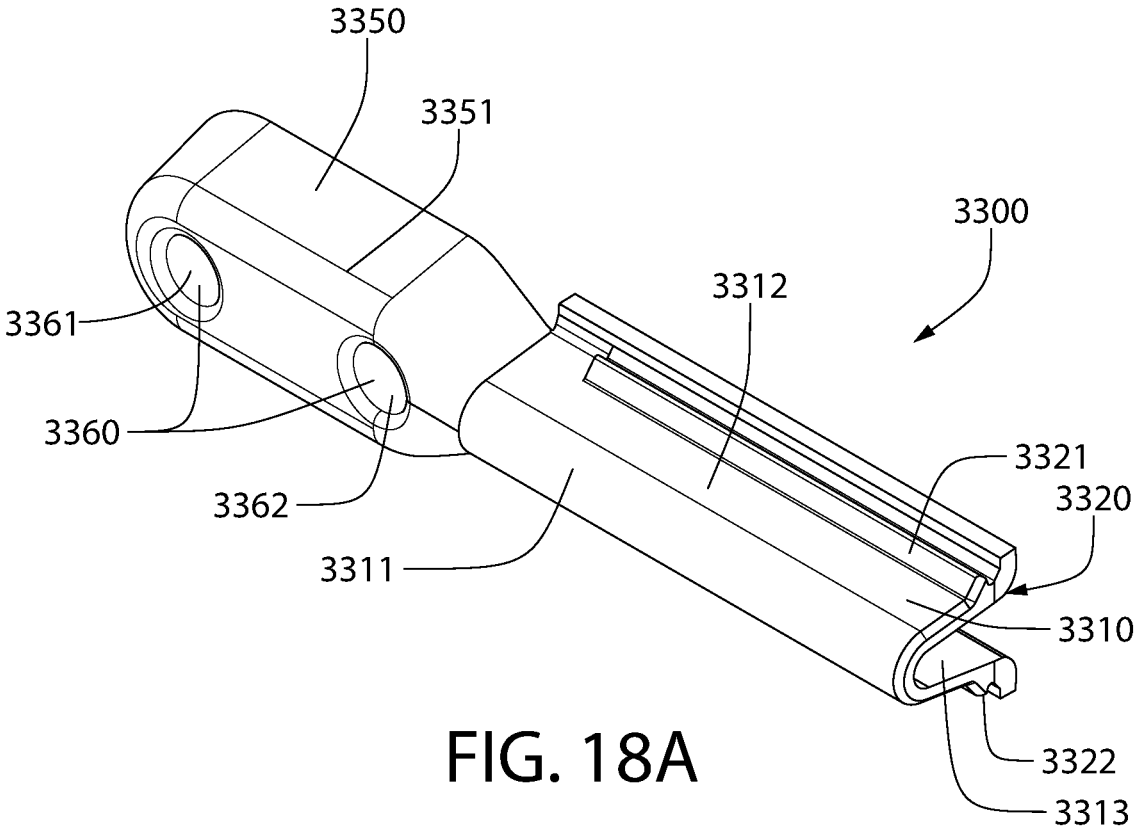
FIG. 18A is a front perspective view of a connector of the decorative moulding assembly of FIG. 14.
Figure 18B:
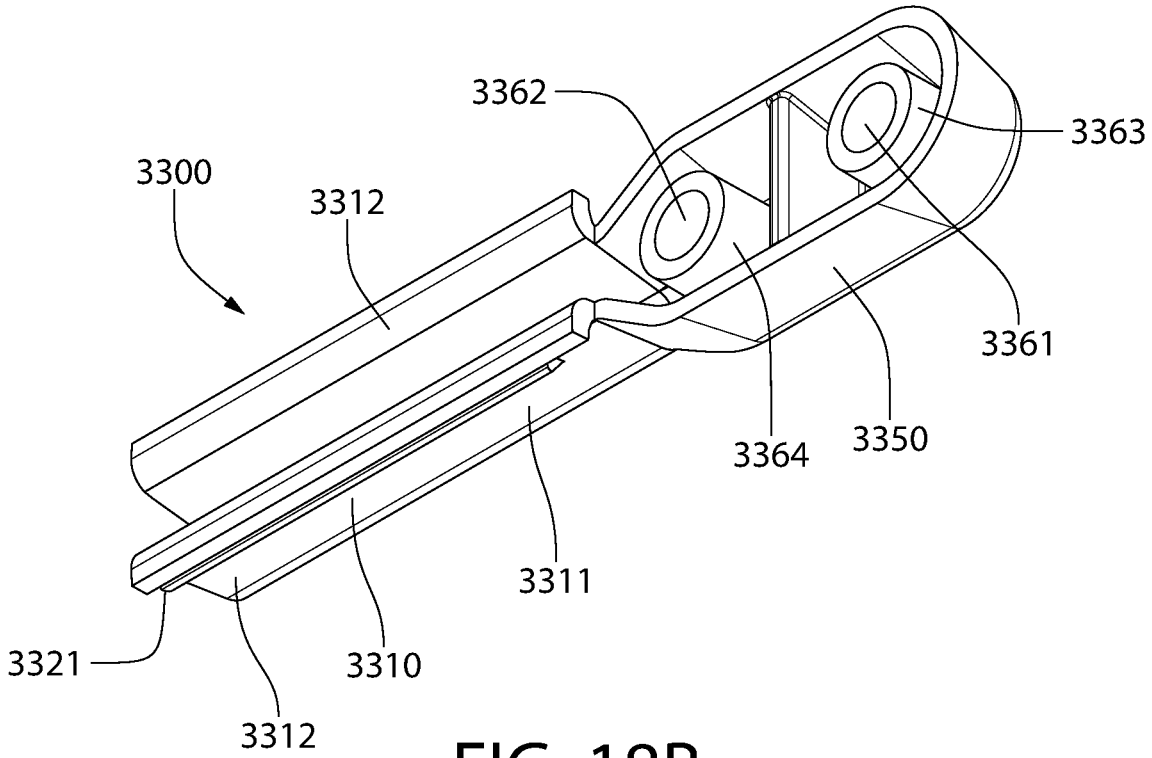
FIG. 18B is a rear perspective view of the connector of FIG. 18A.

Referring to FIGS. 18A and 18B, the connectors 3300 will be described in greater detail. The connectors 3300 comprise a first portion 3310 and a second portion 3350. The first portion 3310 is identical in shape and structure to the first portion 2310 of the connectors 2300 described above. Thus, the description of the first portion 2310 of the connectors 2300 (and of the structure of the connectors 200) is equally applicable to the first portion 3310 of the connectors 3300. Furthermore, the second portion 3350 is identical in shape and structure to the second portion 2350 of the connectors 2300. Thus, the description of the second portion 2350 of the connectors 2300 is equally applicable to the second portion 3350 of the connectors 3300. The only real difference between the connectors 3300 and the connectors 2300 is that for the connectors 3300, the first and second portions 3200, 3300 are coaxial. Thus, the connectors 3300 extend linearly rather than having an L shape as with the connectors 2300.

A brief description of the features of the first and second portions 3310, 3350 will be provided herein, it being understood that a more detailed description is provided in the earlier described embodiments which may be relied upon for support. The first portion 3310 comprises a U-shaped body 3311 which comprises a first leg 3312 and a second leg 3313. Furthermore, the first portion 3310 comprises an engagement feature 3320 which comprises a first protuberance 3321 extending from the first leg 3312 of the U-shaped body 3311 and a second protuberance 3322 extending from the second leg 3313 of the U-shaped body 3311. The first and second protuberances 3321, 3322 snap-fit and then nest within grooves in the channel in the first moulding piece 3100 as has been described thoroughly above (see, for example, FIG. 6E). Moreover, the first and second legs 3312, 3313 may deflect or flex inwardly during the insertion of the connector 3300 to the first moulding piece 3100 as described above.

The second portion 3350 of the connector 3300 comprises an oval-shaped body 3351 in the exemplified embodiment, although the body 3351 may have other shapes in other embodiments. Moreover, the second portion 3350 of the connector 3300 comprises an engagement feature 3360 which comprises a first bore 3361 and a second bore 3362 that are formed into the body 3351. The first and second bores 3361, 3362 are surrounded by annular walls 3363, 3364, respectively. The annular walls 3363, 3364 engage the posts 3221, 3222 of the second moulding piece 3200 via a friction-type fit when the connector 3300 is coupled to the second moulding piece 3200 as has been described above with reference to earlier described embodiments. In other embodiments, the body 3351 may be a solid structure with the bores 3361, 3362 formed directly therein. The bores 3361, 3362 may be through bores such that they extend through the full thickness of the body 3351 in some embodiments, although the bores 3361, 3362 may be blind bores such that the do not extend through the full thickness of the body 331 in other embodiments.

Figure 19A:
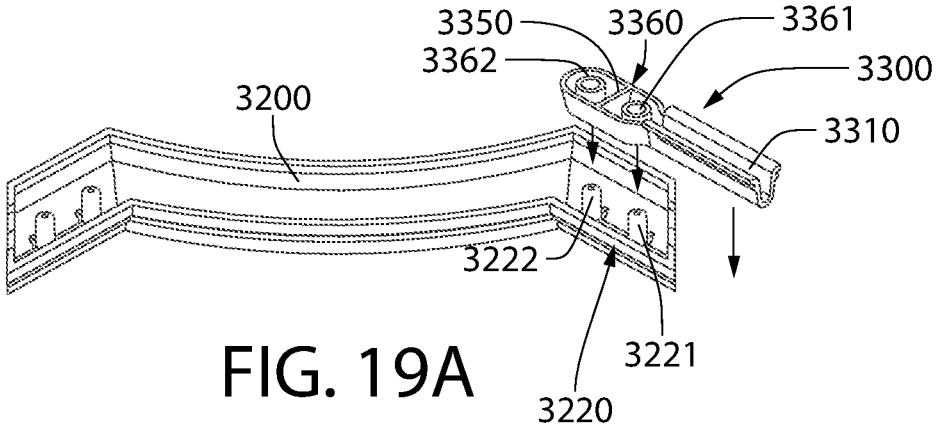
FIGS. 19A-19F illustrate the process of coupling the connector of FIGS. 18A and 18B to the various moulding pieces to form the decorative moulding assembly of FIG. 14.
Figure 19B:
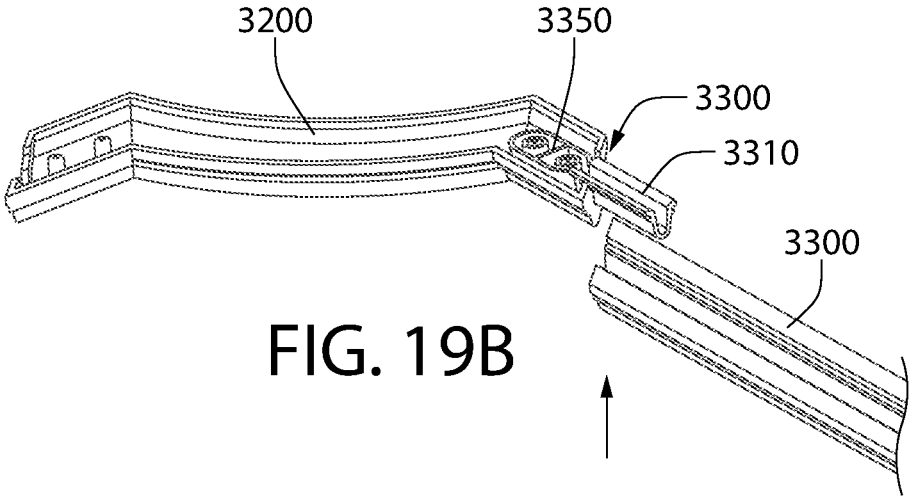
Figure 19C:
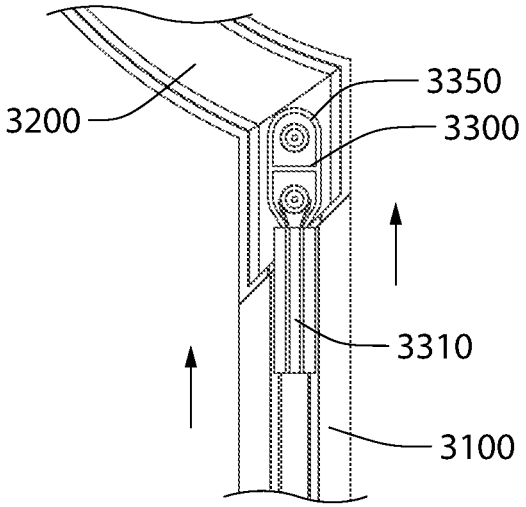

FIGS. 19A-19F illustrate the process of assembling the decorative moulding assembly 3000. First, as shown in FIGS. 19A and 19B, the second portion 3350 of the connector 3300 is coupled to the first and second posts 3221, 3222 of the engagement feature 3220 of the second moulding piece 3200. Next, the first portion 3310 of the connector 3300 is coupled to the first moulding piece 3100. The manner in which the first and second portions 3310, 3350 of the connector 3300 are coupled to the first and second moulding pieces 3100, 3200 is the same as that which has been previously described. The coupling between the first portion 3310 of the connector 3300 and the first moulding piece 3100 may be a snap-fit connection and the coupling between the second portion 3350 of the connector 3300 and the second moulding piece 3200 may be a press-fit connection. As shown in FIG. 19C, it may be possible to slide the first moulding piece 3100 relative to the connector 3300 even after the two are snap-fit together. This may be done to ensure that the ends of the first and second moulding pieces 3100, 3200 are in abutment with one another to create the desired decorative moulding assembly 3000.

Figure 19D:
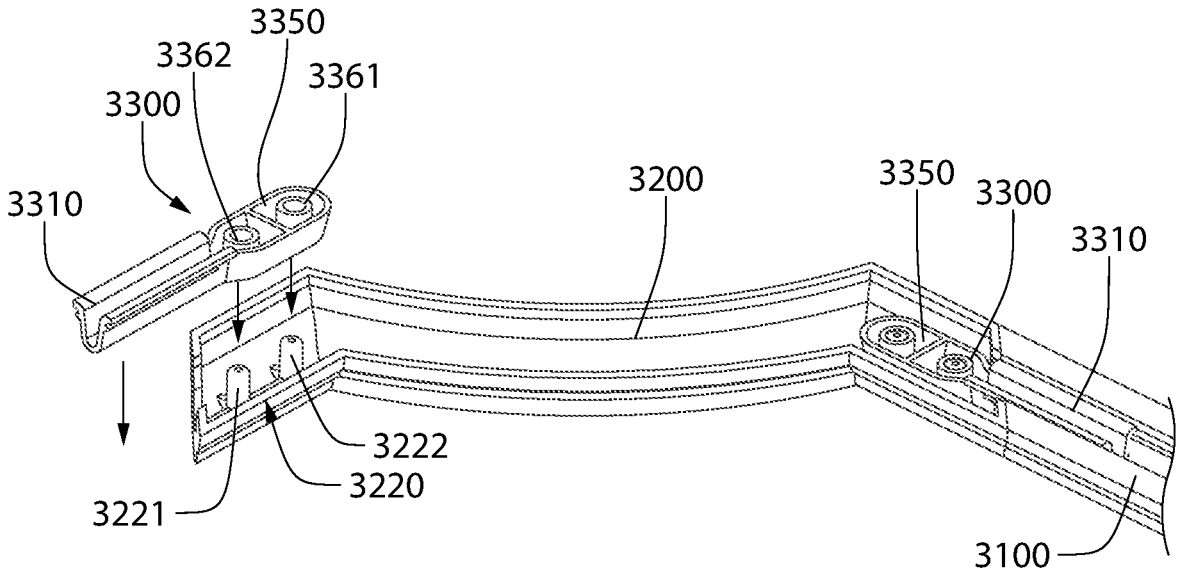
Figure 19E:
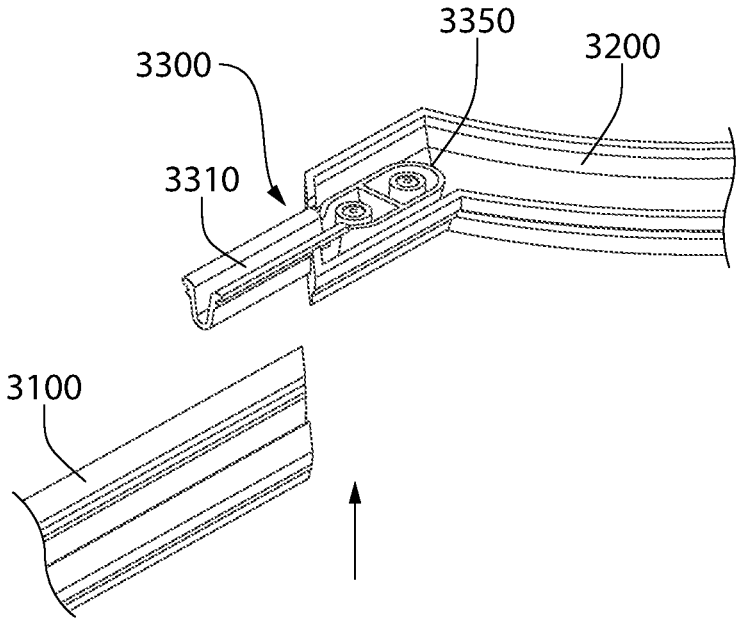

FIGS. 19D and 19E illustrate the manner of coupling the same second moulding piece 3300 as shown in FIGS. 19A-19C to another one of the first moulding pieces 3100. That is, the second portion 3350 of another connector 3300 is coupled to the other engagement feature 3220 of the second moulding piece 3200. Then, the first portion 3310 of the another connector 3300 is coupled to another one of the first moulding pieces 3100. This process continues until the decorative moulding assembly 3000 as shown in FIGS. 14 and 16 is assembled. Although the assembly has been described herein whereby the second portion 3350 of the connector 3300 is connected to the second moulding piece 3200 and then the first portion 3310 of the connector 3300 is coupled to the first moulding piece 3100, assembly may proceed in the opposite order in other embodiments. That is, the first portion 3310 of the connector 3300 may first be coupled to the first moulding piece 3100, and then the second portion 3350 of the connector 3300 may be coupled to the second moulding piece 3200. The order of assembly is not limiting of the invention in all embodiments described herein.

Figure 19F:
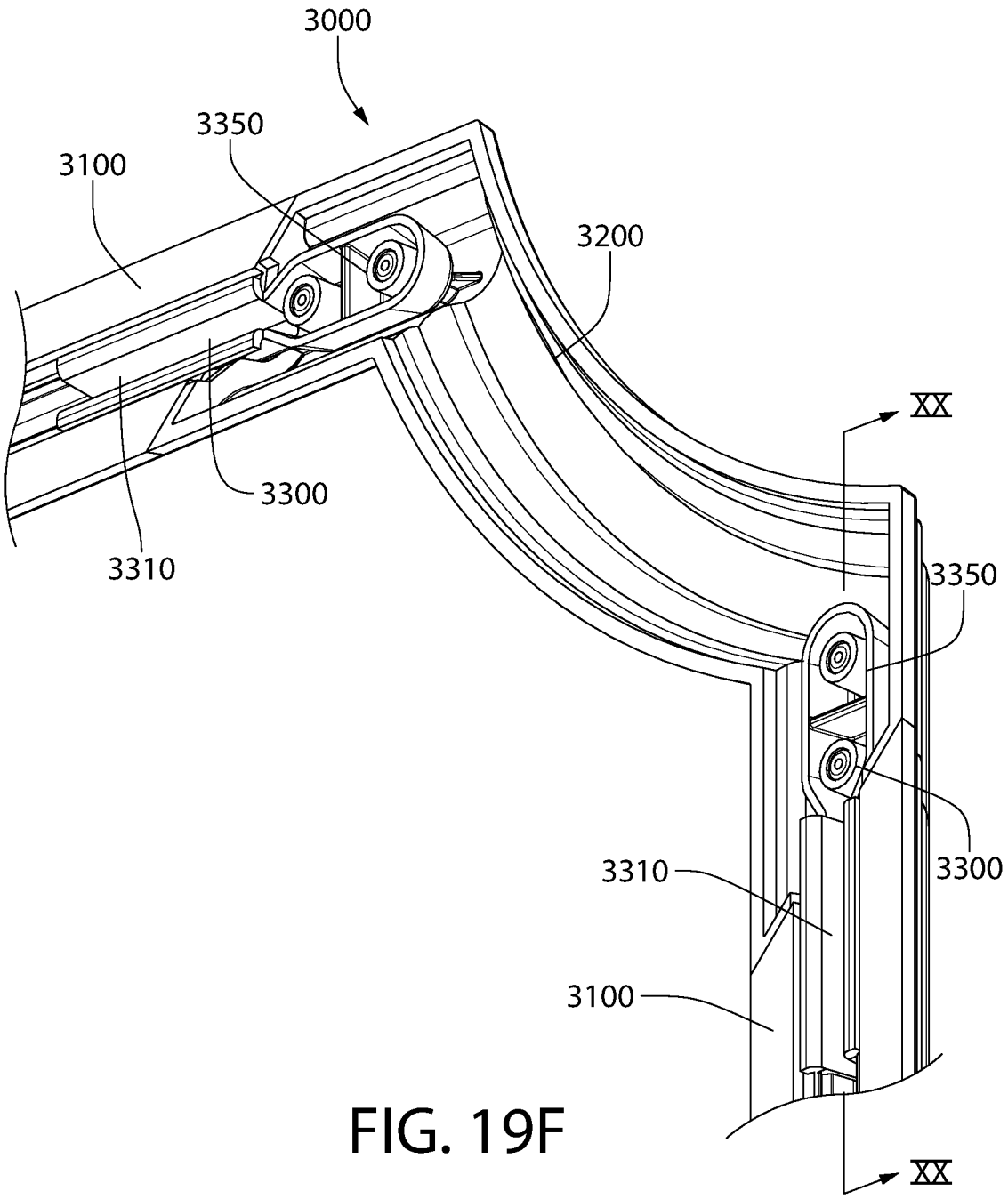
Figure 20:
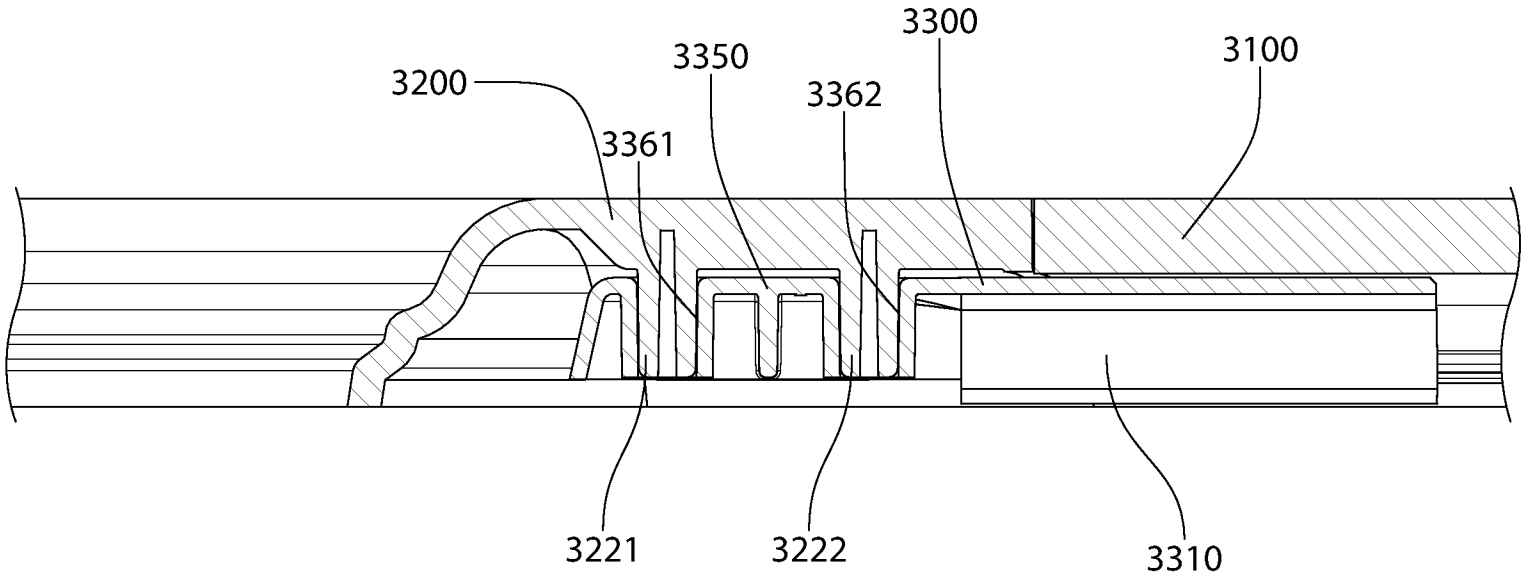
FIG. 20 is a cross-sectional view taken along line XX of FIG. 19F.

FIG. 19F illustrates the partially assembled decorative moulding assembly 3000, and specifically illustrates one of the second moulding pieces 3200 coupled to two separate ones of the first moulding assemblies 3100 via the connectors 3300. The end surfaces of the first and second moulding pieces 3100, 3200 abut one another to form miter joints due to the angled orientation of the end surfaces. The first portions 3310 of the connectors 3300 are securely coupled to the first moulding pieces 3100 via the snap-fit connection between the protuberances and grooves as described herein. The second portions 3350 of the connectors 3300 are securely coupled to the second moulding pieces 3200 via the press-fit connection between the posts and the bores. FIG. 20 is a cross-sectional view which illustrates the engagement of the posts 3221, 3222 with the bores 3361, 3362 and otherwise depicts the positioning of the connector 3300 relative to the first and second moulding pieces 3100, 3200.

Throughout this disclosure, where two features engage/mate, if one is a post and the other is a bore, the component with the bore could be modified to have a post instead and the component with the post could be modified to have the bore instead. Similarly, throughout this disclosure, where two features engage/mate, if one is a protuberance and the other is a groove, the component with the groove could be modified to have the protuberance and the component with the protuberance could be modified to have the groove.

Figure 21:
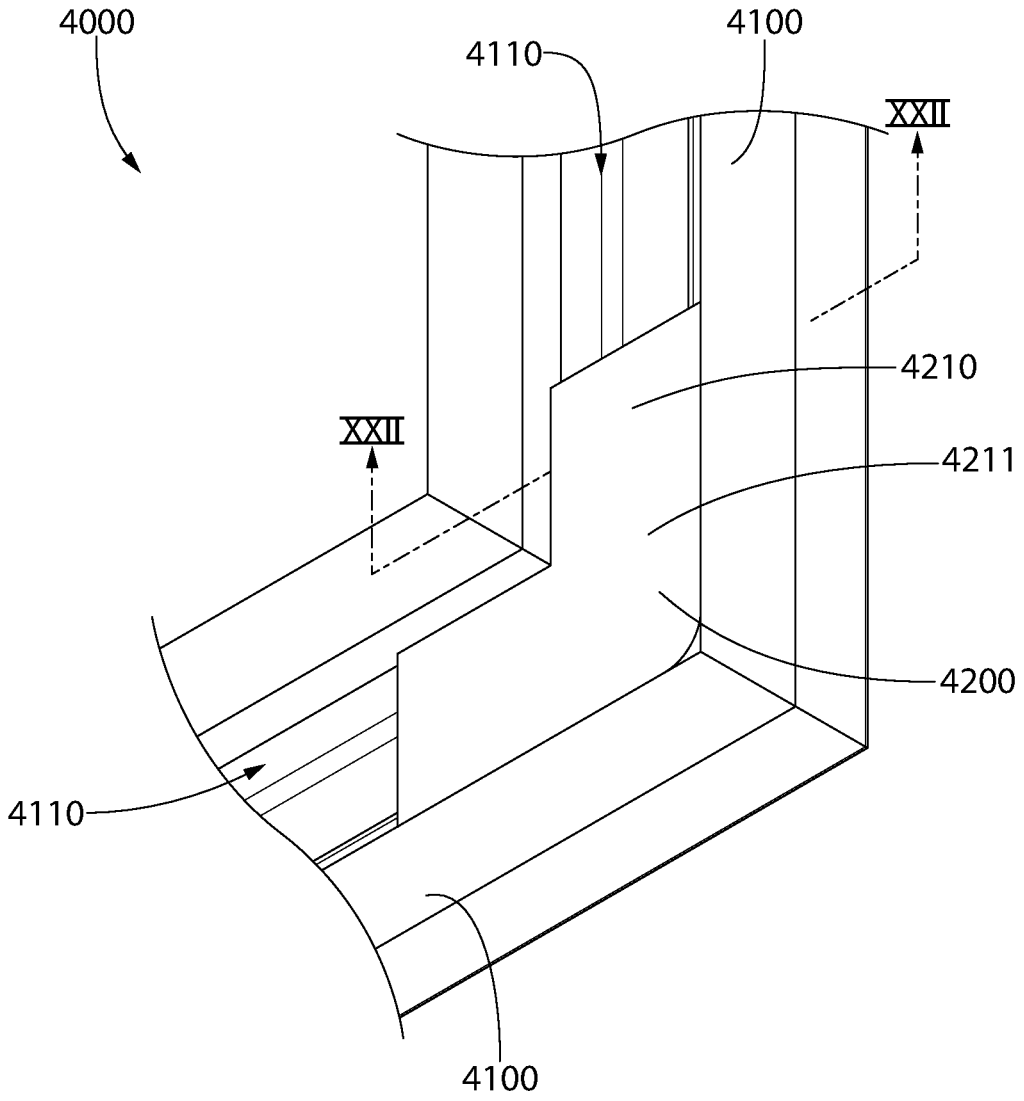
FIG. 21 is a partial view of a decorative moulding assembly in accordance with a fourth embodiment of the present invention.
Figure 22:
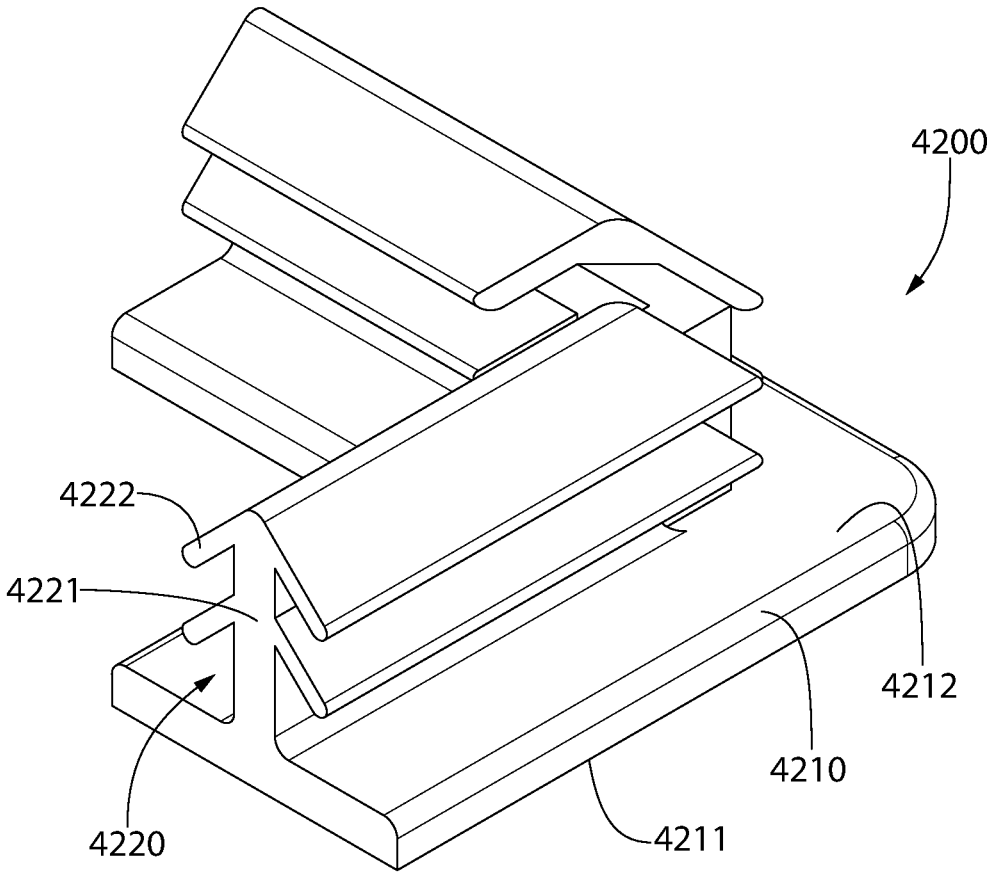
FIG. 22 is a rear perspective view of a connector of the decorative moulding assembly of FIG. 21.
Figure 23:
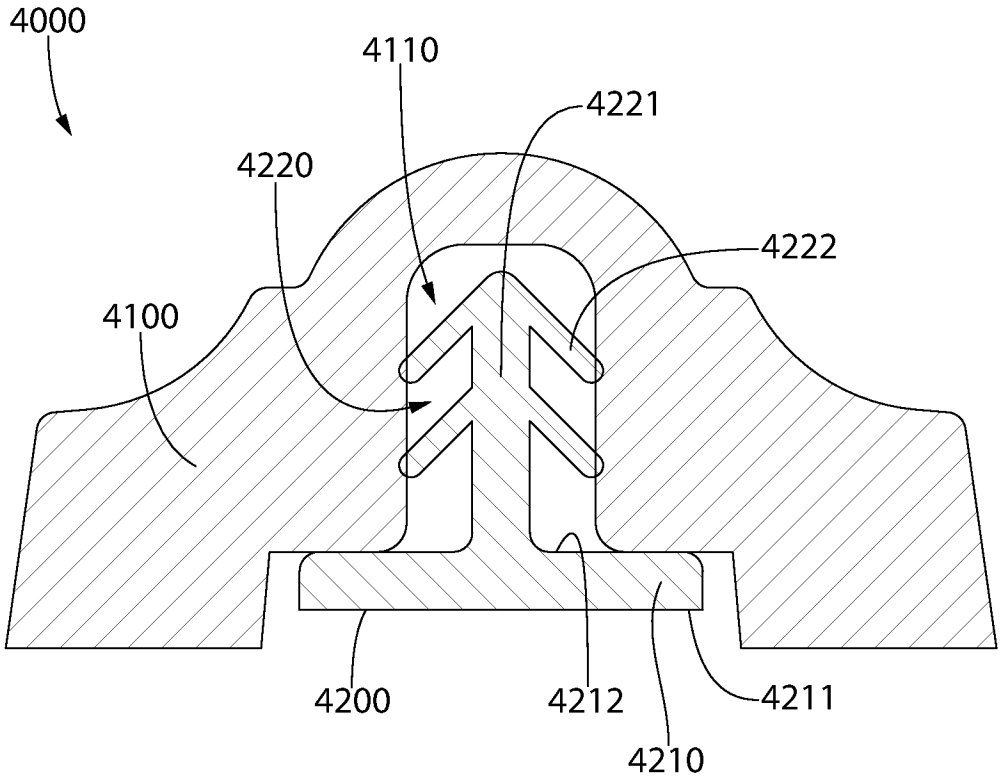
FIG. 23 is a cross-sectional view taken along line XIII-XIII of FIG. 21.

Referring to FIGS. 21-23, a decorative moulding assembly 4000 is illustrated in accordance with another embodiment of the present invention. The decorative moulding assembly 4000 comprises a plurality of moulding pieces 4100 and a plurality of connectors 4200 for coupling the moulding pieces 4100 together. FIG. 21 illustrates only an end portion of two of the moulding pieces 4100, but it should be appreciated that the moulding pieces 4100 may have any desired shape, including the linear shape, corner shape, and scalloped corner shape illustrated with the previous embodiments. Each of the moulding pieces 4100 comprises a channel 4110 within which a portion of the connector 4300 may nest to couple the connector 4300 to the moulding pieces 4100. The channel 4110 may comprise a generally U-shaped cross-sectional shape as best shown in FIG. 23. In this embodiment, there are no locking grooves or other structures for mating the channel 4110 with the connectors 4300.

The connector 4200 comprises a plate-like body portion 4210 having a top surface 4211 and a bottom surface 4212. The body portion 4210 is in the shape of an L in the exemplified embodiment to permit the coupling of the connector 4200 to two adjacent moulding pieces 4100 that are oriented at a perpendicular angle relative to one another. The body portion 4210 may have alternative shapes in other embodiments dictated in part by the orientation of the moulding pieces 4100 in the assembled decorative moulding assembly 4000. That is, the body portion 4210 could be linear in some embodiments, or could comprise two sections that are angled relative to one another in a manner that is intended to correspond to the angle between two adjacent moulding pieces 4100 in the decorative moulding assembly 4200.

The connector 4200 comprises one or more barbed connectors 4220 extending from the bottom surface 4212 of the body portion 4210. The barbed connectors 4220 comprise a post portion 4221 that extends perpendicularly from the bottom surface 4212 of the body portion 4212 and a plurality of barb portions 4222 extending from the post portion 4221 in a downwardly angled manner. That is, each of the barb portions 4222 extends from the post portion 4221 in a direction that is away from the post portion 4221 and downward back towards the bottom surface 4212 of the body portion 4210.

The connector 4200 is coupled to the moulding pieces 4100 by inserting the barbed connectors 4220 of the connector 4200 into the channels 4110 of the moulding pieces 4100. The barb portions 4222 may be forced to deflect downwardly as the barbed connecters 4220 are inserted into the channels 4110, thereby creating a tight fit between the barbed connectors 4220 and the moulding pieces 4100. In this manner, the connectors 4200 are coupled to two adjacent moulding pieces 4100 to maintain the two adjacent moulding pieces 4100 in abutment with one another as shown in FIG. 21. The connectors 4200 cannot be easily detached from the moulding pieces 4100 once coupled thereto due to the engagement between the barb portions 4222 and the inner surface which defines the channel 4110 of the moulding pieces 4100.

Figure 24:
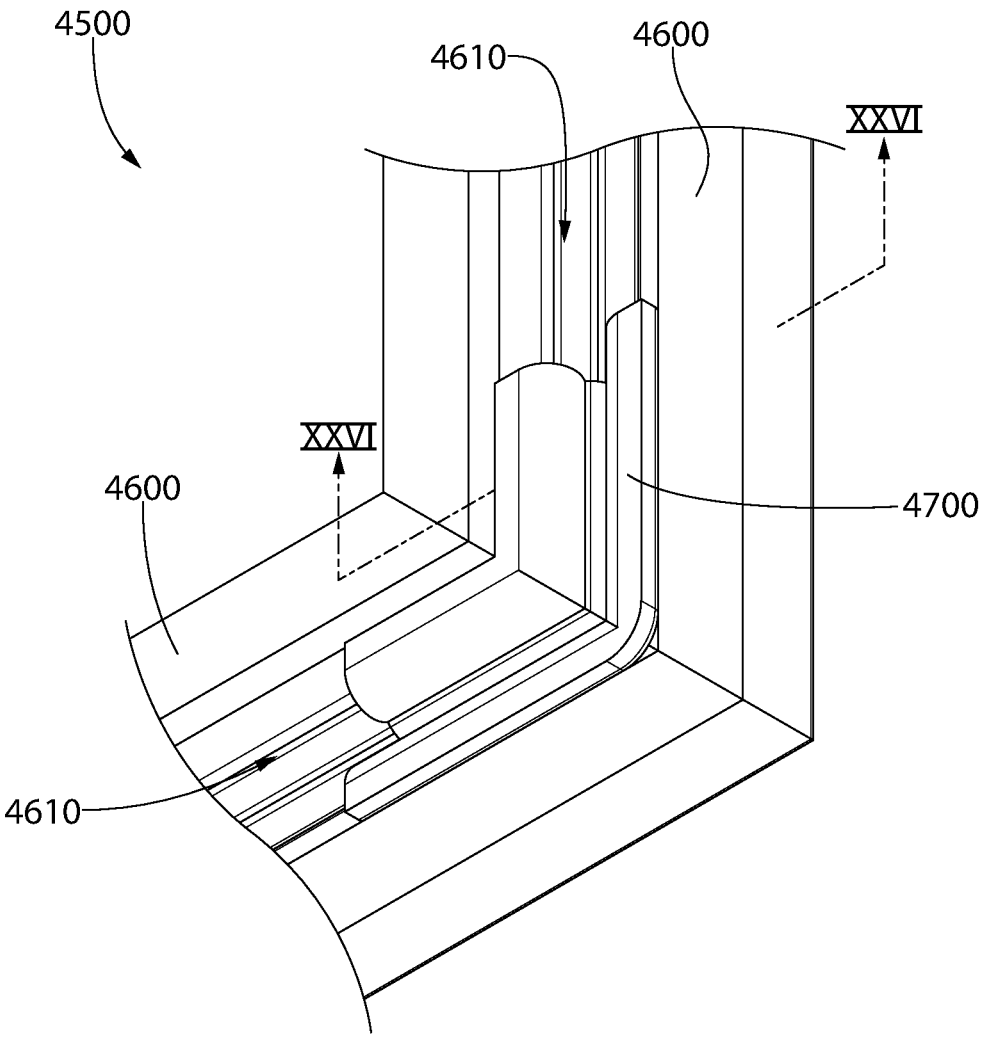
FIG. 24 is a partial view of a decorative moulding assembly in accordance with a fifth embodiment of the present invention.
Figure 25:
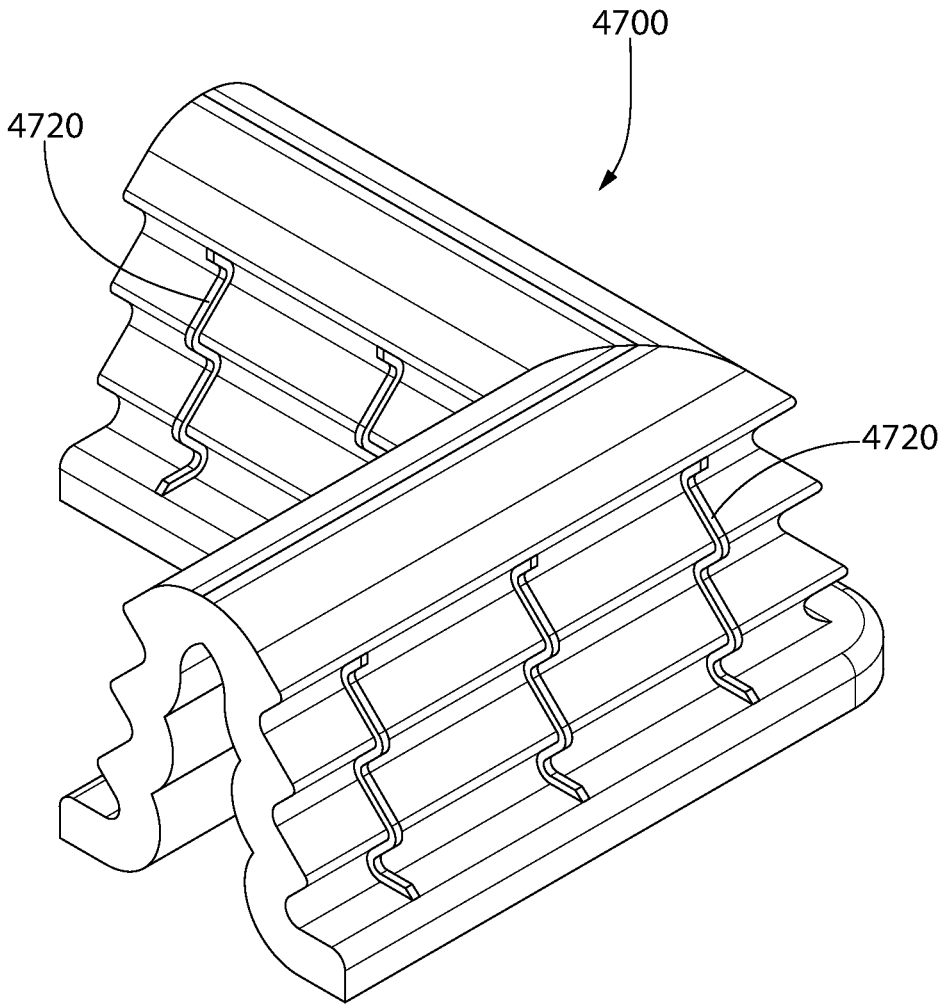
FIG. 25 is a perspective view of a connector of the decorative moulding assembly of FIG. 24.
Figure 26:
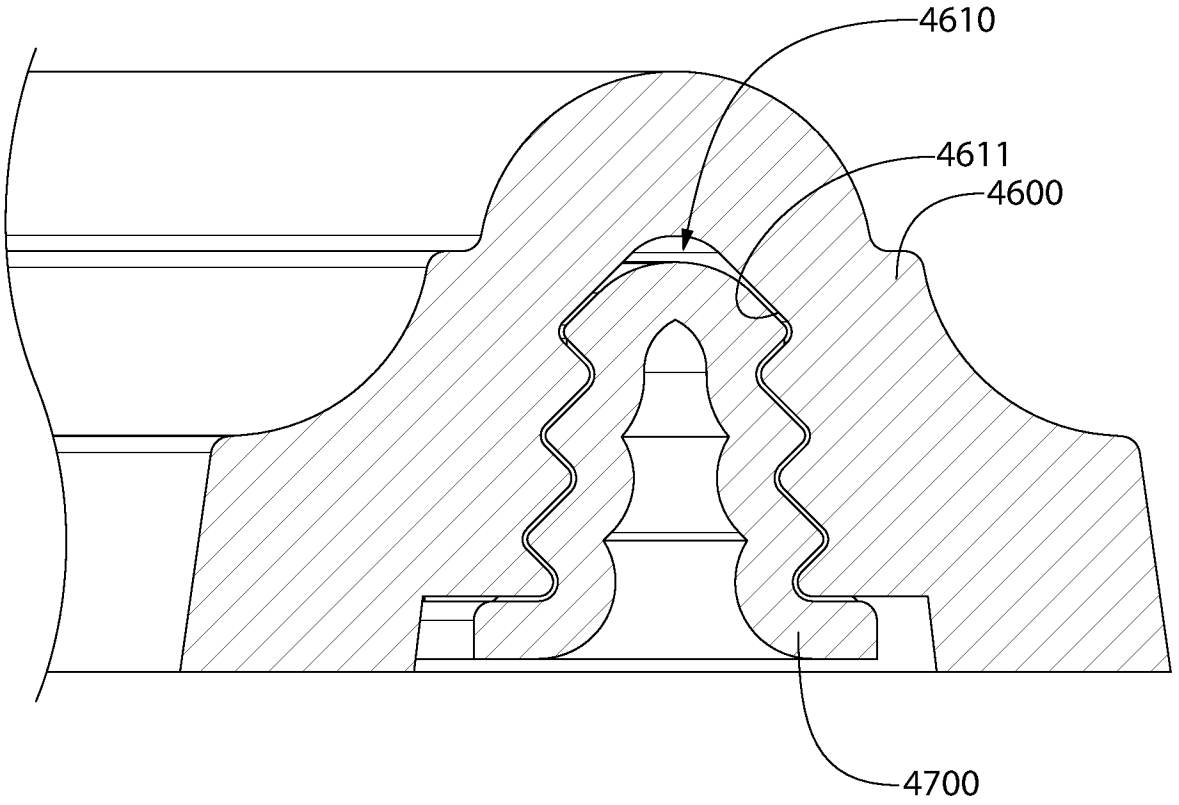
FIG. 26 is a cross-sectional view taken along line XXVI-XXVI of FIG. 24.

Referring to FIGS. 24-26, a decorative moulding assembly 4500 is illustrated in accordance with another embodiment of the present invention. The decorative moulding assembly 4500 comprises a plurality of moulding pieces 4600 that are coupled together with the use of connectors 4700. Each of the moulding pieces 4600 comprises a channel 4610 that is defined by an inner surface 4611. In this embodiment, the inner surface 4611 of the channel 4610 is undulating or wavy such that it comprises a plurality of vertically spaced apart grooves 4612 on both opposing sides of the inner surface 4611. In particular, the inner surface 4611 of the channel 4610 comprises three grooves on each side of the inner surface 4611.

Moreover, in this embodiment the connectors 4700 comprise U-shaped portions as with the prior embodiments. The U-shaped portions comprise undulating or wavy outer surfaces that mate or otherwise engage with the wavy/undulating inner surfaces 4611 of the channel 4610. In particular, the outer surface of the connectors 4700 comprise three protrusions or ribs along each leg thereof that nest within the three grooves on each side of the inner surface 4611 of the channel 4610 of the moulding pieces 4600. Thus, as the connectors 4700 are inserted into the channels 4610 of the decorative moulding assemblies 4600, the legs of the connectors 4700 flex/deflect inwardly until the protrusions nest within the grooves when connectors 4700 are fully inserted into the channels 4610 as shown in FIG. 26. In this embodiment, the connectors 4700 may also comprise vertical ribs 4720 to create an additional friction between the connectors 4700 and the moulding pieces 4600.

Figure 27:
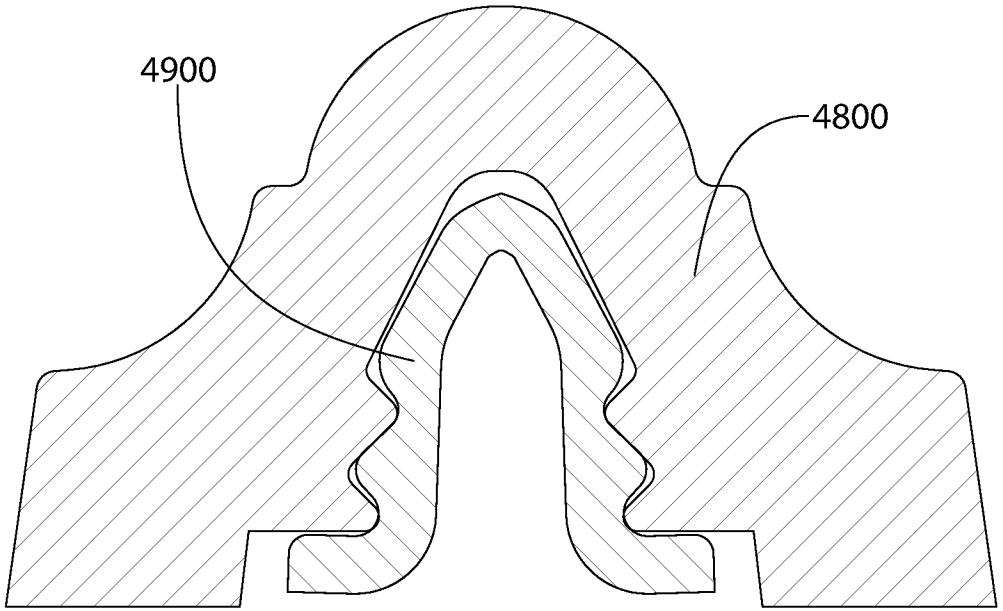
FIG. 27 is the cross-sectional view of FIG. 26 in accordance with an alternative embodiment.

FIG. 27 illustrates an alternative embodiment of a moulding piece 4800 and a connector 4900 which have wavy/undulating mating surfaces just like the moulding pieces 4600 and the connectors 4700. In this embodiment, the moulding pieces 4800 and the connectors 4900 have fewer grooves/valleys in the wavy/undulating structure than the previously described embodiment, but otherwise the concept is the same. Furthermore, the rounded bight portion of the connector 4900 has a somewhat different shape than the connector 4700 of the previous embodiment, but such different is minor and is merely done to ensure appropriate mating with the channel of the moulding piece 4800 as shown in FIG. 27.

Figure 28:
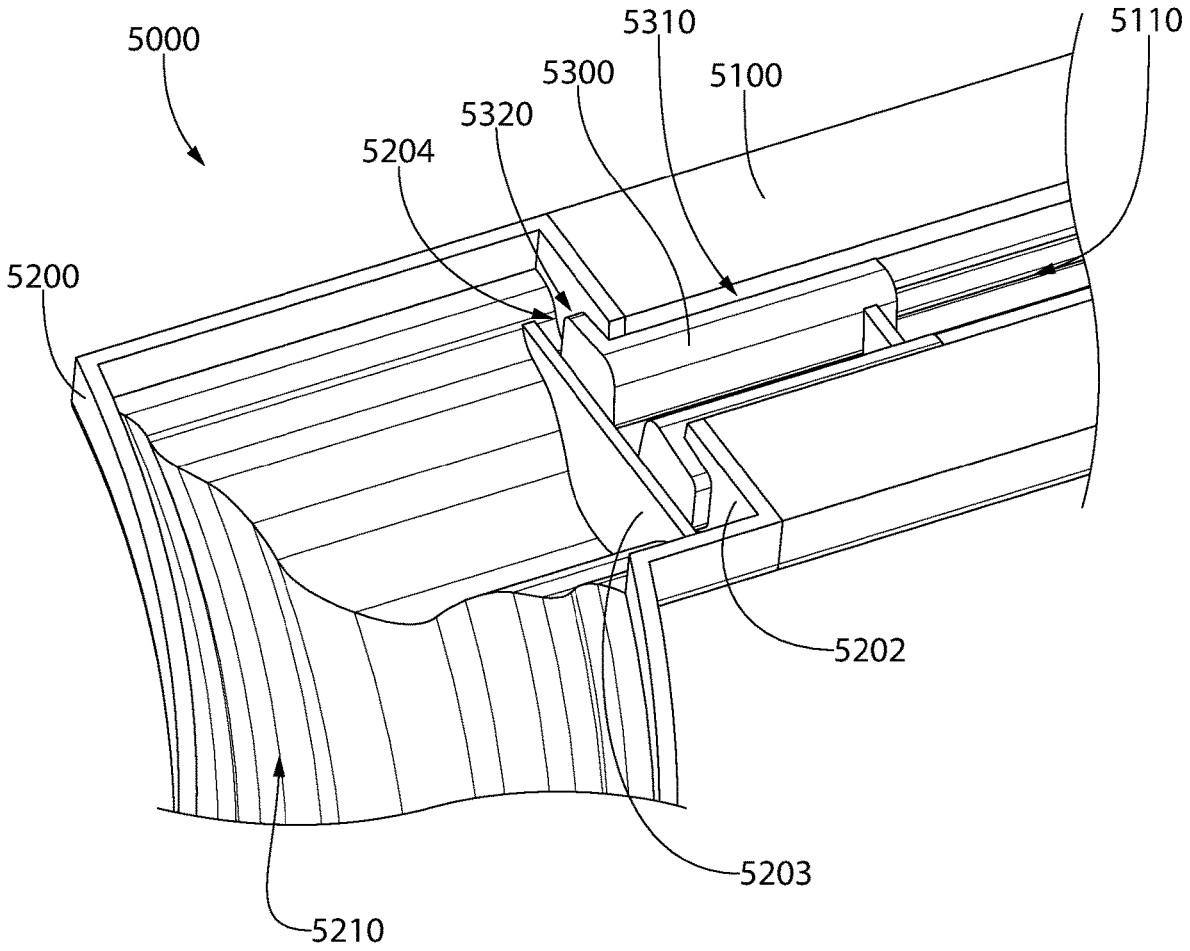
FIG. 28 is a partial view of a decorative moulding assembly in accordance with a sixth embodiment of the present invention.
Figure 29:
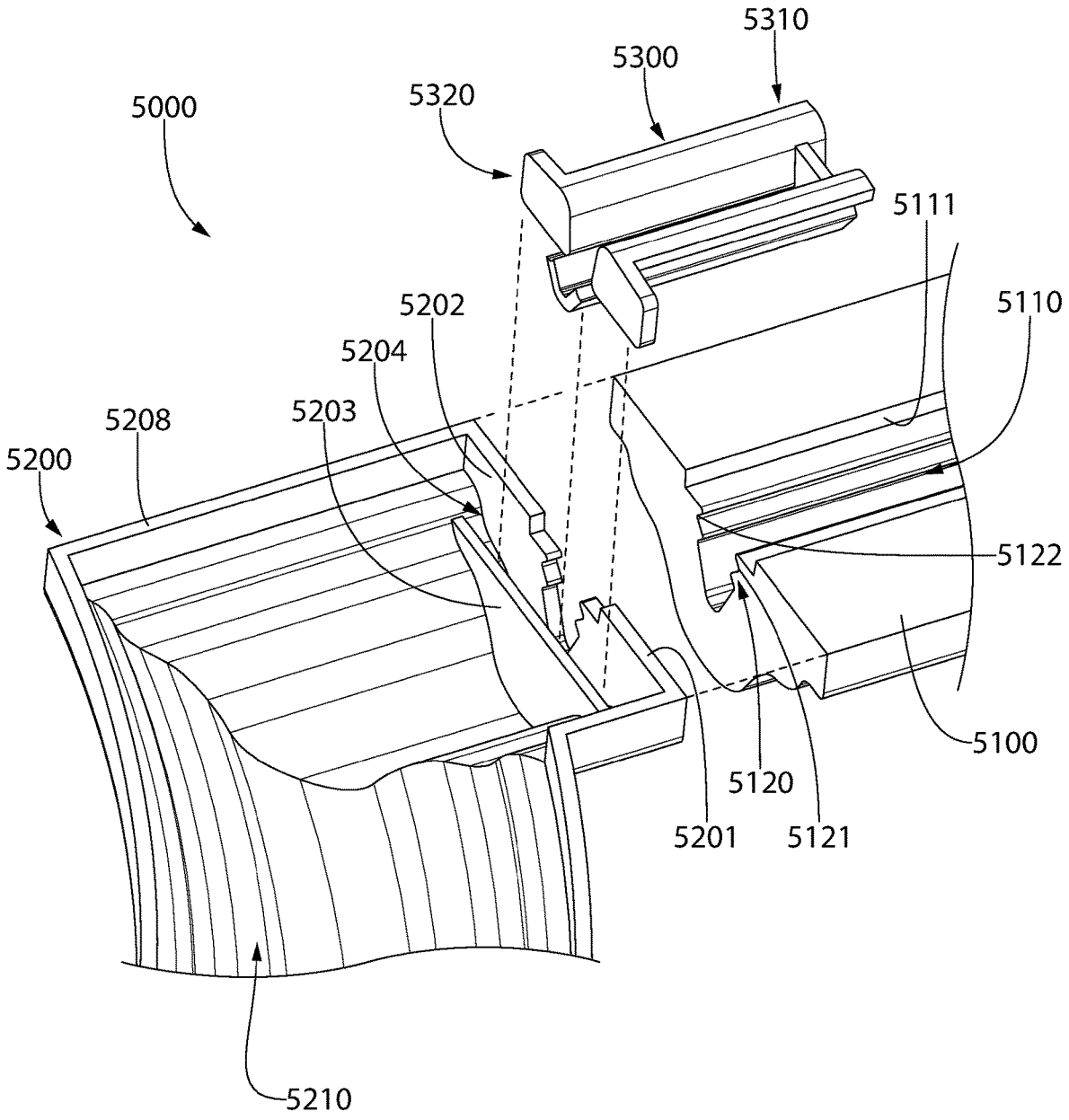
FIG. 29 is an exploded partial view of the decorative moulding assembly of FIG. 28.
Figure 30:
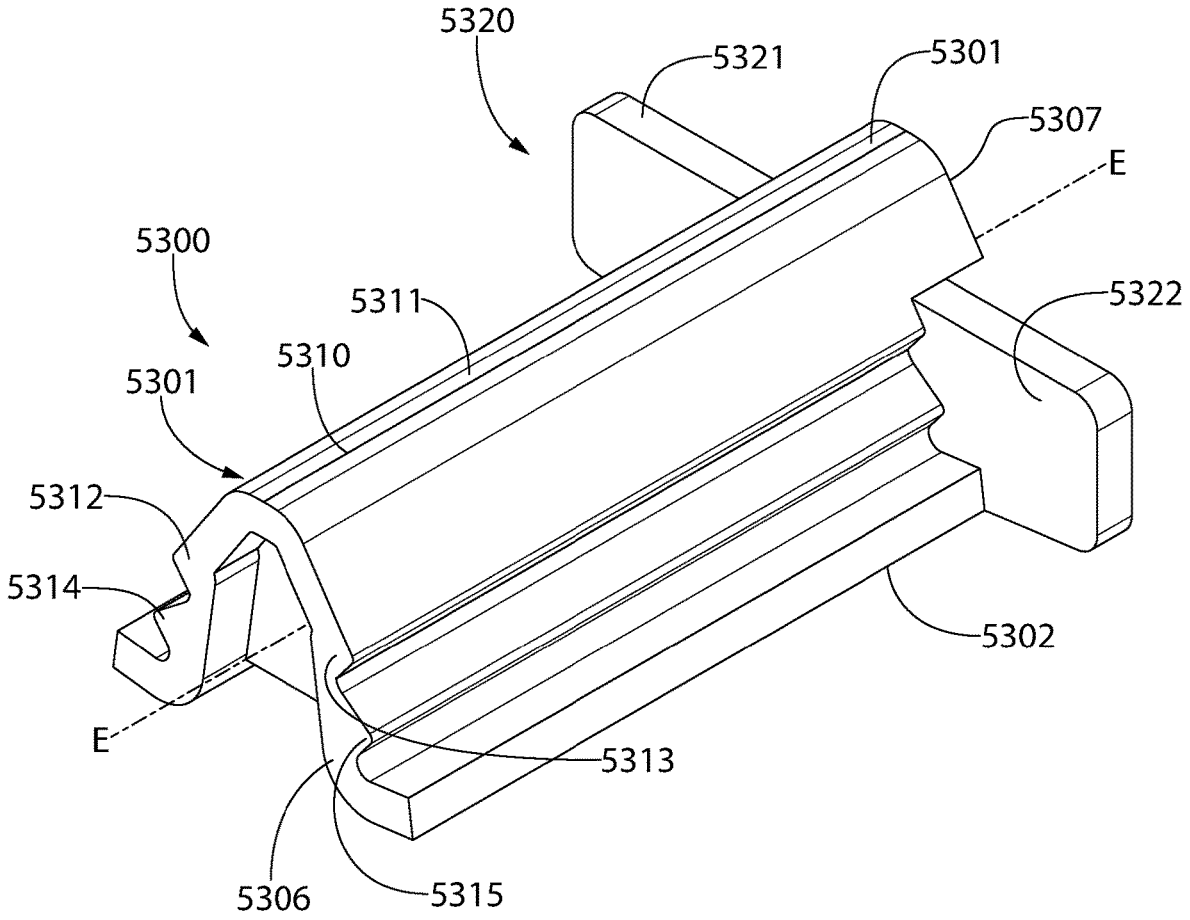
FIG. 30 is a perspective view of a connector of the decorative moulding assembly of FIG. 28.

Referring to FIGS. 28-30, a decorative moulding assembly 5000 is illustrated in accordance with yet another embodiment of the present invention. The decorative moulding assembly 5000 comprises at least one first moulding piece 5100, at least one second moulding piece 5200, and one or more connectors 5300 for connecting the first and second moulding pieces 5100, 5200 together. In this embodiment, the first moulding pieces 5100 are extruded and are identical to the moulding pieces 100, 2100 described above. Briefly, the moulding pieces 5100 comprise a channel 5110 defined by an inner surface 5111. The channel 5110 comprises an engagement feature 5120, which in the exemplified embodiment comprises a first groove 5121 located on a first side of the inner surface 5111 and a second groove 5122 located on a second side of the inner surface 5111. Thus, the engagement features of the first moulding piece 5100 is the same as with the first moulding pieces 100, 2100 described above.

The second moulding piece 5200 may be formed by injection molding, and may specifically be injection molded out of a material such as ABS, HIPS, and PVC, or the like. The second moulding piece 5200 comprises an inner surface 5211 that defines a channel 5210. Furthermore, the second moulding piece 5200 comprises a first end 5201 defined by a first end wall 5202 and a second end defined by a second end wall. While the second end and second end wall are not visible in the provided views, it should be appreciated that they are identical to the first end and the first end wall. The first and second end walls 5202 extend transversely across the channel 5210 (in a direction transverse to the longitudinal axis of the portion of the channel 5210 within which they are positioned). The first end wall 5202 comprises a notch or cutout or opening 5203 which provides a passageway into the channel 5210. The second moulding piece 5200 further comprises a transverse wall 5203 that extends transversely across the channel 5210. The transverse wall 5203 is spaced apart from the first end wall 5202 by a gap 5204. There is a similar transverse wall spaced apart from the second end wall by a gap, although this is not depicted in the provided views.

In some embodiments, the width of the gap 5204 measured in the direction between the first end wall 5204 and the transverse wall 5203 may be constant. In other embodiments, the width of the gap 5204 may decrease as the gap 5204 extends in a direction from a rear surface 5208 of the second moulding piece to a front surface of the second moulding piece, as discussed in great detail below.

The connector 5300 comprises a main body 5301 that extends from a first end 5306 to a second end 5307 along a longitudinal axis E-E. Furthermore, the connector 5300 comprises a first portion 5310 that is configured to nest within the first channel 5110 of the first moulding piece 5100 and a second portion 5320 that is configured to nest within the second channel 5210 of the second moulding piece 5200. The first portion 5310 comprises a U-shaped body 5311 comprising a first leg 5312 and a second leg 5313. The first portion 5310 comprises at least one protuberance 5314 protruding from the first leg 5312 and at least one protuberance 5315 protruding from the second leg 5313. When the connector 5300 is connected to the first moulding piece 5100, the first and second protuberances 5314, 5315 of the first and second legs 5312, 5313 nest within the first and second grooves 5121, 5122 of the channel 5110 of the first moulding piece 5100. The first and second legs 5312, 5313 may flex/deflect inwardly towards one another during the coupling of the connector 5300 to the first moulding piece 5100 as has been described herein with reference to earlier embodiments. The first portion 5310 of the connector 5300 may be snap-fit connected to the first moulding piece 5100.

The second portion 5320 of the connector 5300 is configured to nest within the gap 5204 between the first end wall 5204 and the transverse wall 5203 of the second moulding piece 5200. In particular, the second portion 5320 of the connector 5300 comprises a pair of flanges 5321 that extend from the U-shaped body 5311 of the first portion 5310 in a direction away from the longitudinal axis E-E. The flanges 5321 may extend from the U-shaped body 5311 at a position therealong that is adjacent to that second end 5307. Each of the flanges 5321 is cantilevered in its extension from the U-shaped body 5311. The thickness of the flanges 5321 may be constant, or the thickness of the flanges 5321 may increase moving in a direction from a bottom end 5301 of the connector 5300 toward a top end 5302 of the connector 5300. Thus, in some embodiments a width of the gap 5204 between the walls 5202, 5203 may decrease moving from the rear surface 5208 of the second moulding piece 5200 towards the ornamental front surface of the second moulding piece 5200. In other embodiments, a thickness of the second portion 5320 of the connector 5300 may increase moving in a direction from a bottom end 5301 of the connector 5300 towards a top end 5302 of the connector 5300. In either embodiment, the second portion 5320 of the connector 5300 may become wedged within the gap 5204 between the walls 5202, 5203 when the connector 5300 is coupled to the second moulding piece 5200.

Thus, the connector 5300 is coupled to the first moulding piece 5100 by a snap fit engagement between the engagement features (protrusions 5314, 5315) of the connector 5300 and engagement features (grooves 5121, 5122) on the first moulding piece 5100. The connector 5300 is coupled to the second moulding piece 5200 by a press-fit (e.g., tight-fit, interference fit, or friction fit) engagement between the flanges 5321 of the connector 5300 and the gap 5204 and the two walls 5202, 5203 bounding the gap 5204 on the second moulding piece 5200. If the thickness of the flanges 5321, 5322 increases or the width of the gap 5204 decreases, this causes the flanges 5321, 5322 to wedge tighter within the gap 5204 the deeper the flanges 5321, 5322 are located within the gap 5204. This configuration of the connector 5300 allows for the legs 5312, 5313 to flex/deflect during coupling to the first moulding piece 5100 as described above while still providing a firm fit between the second portion 5320 of the connector 5300 and the second moulding piece 5200.

Figure 31:
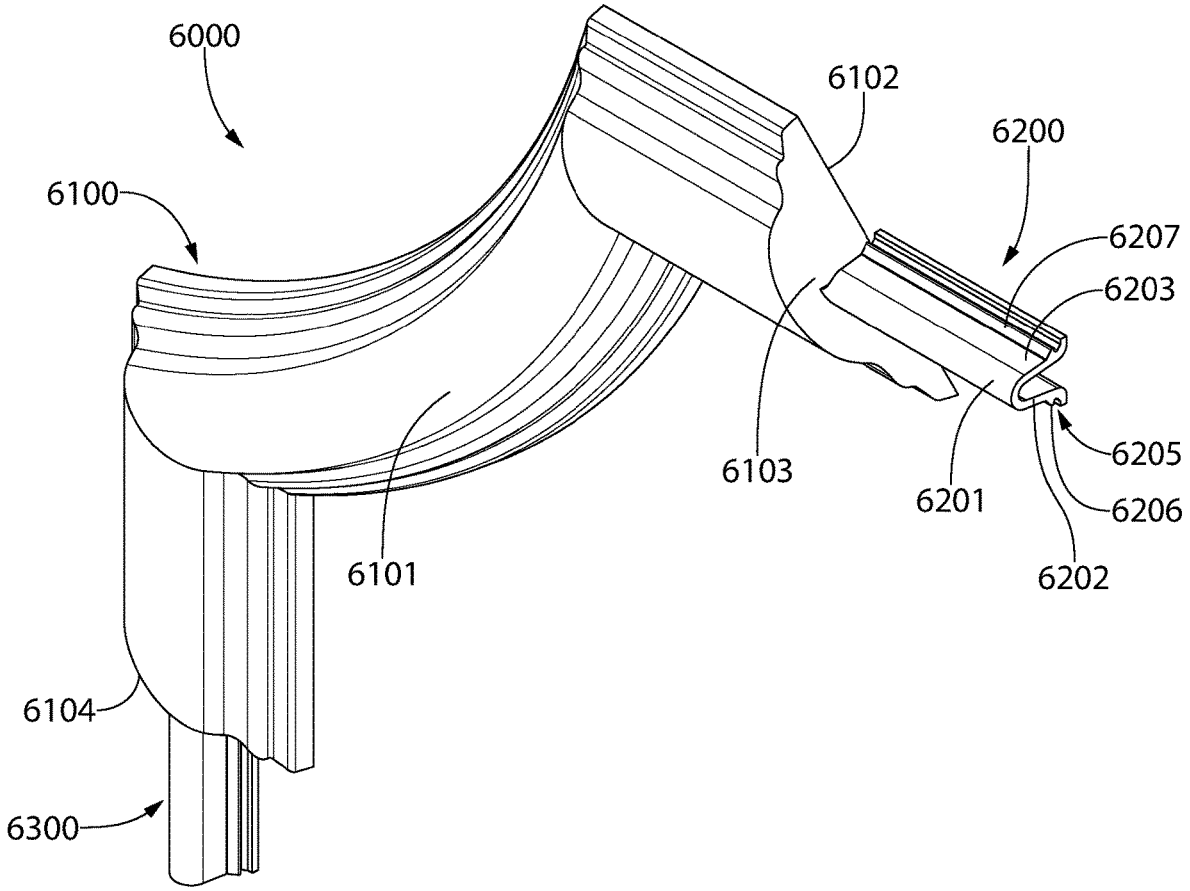
FIG. 31 is a front perspective view of a moulding piece with an integral connector in accordance with a seventh embodiment of the present invention.
Figure 32:
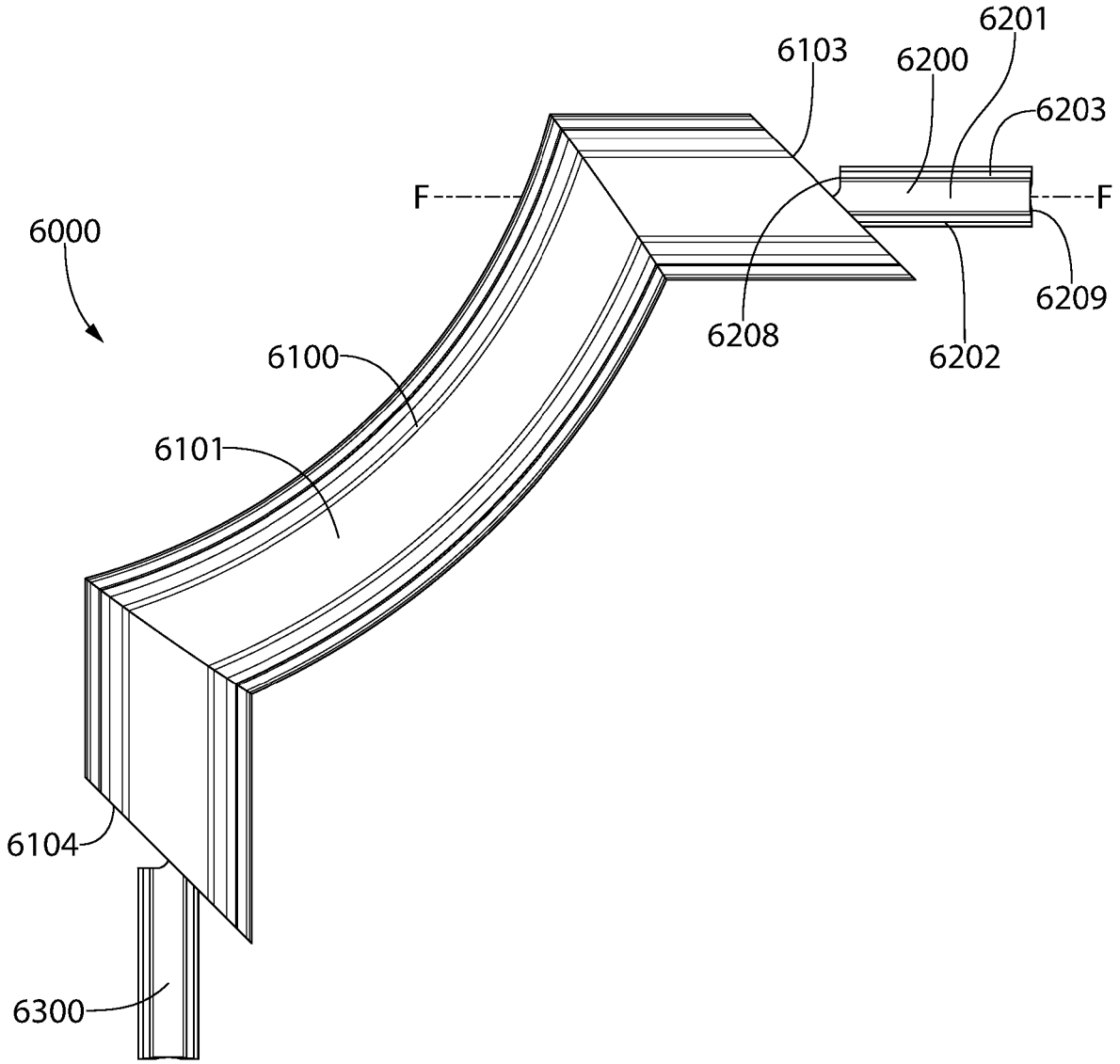
FIG. 32 is a front view of the moulding piece of FIG. 31.
Figure 33:
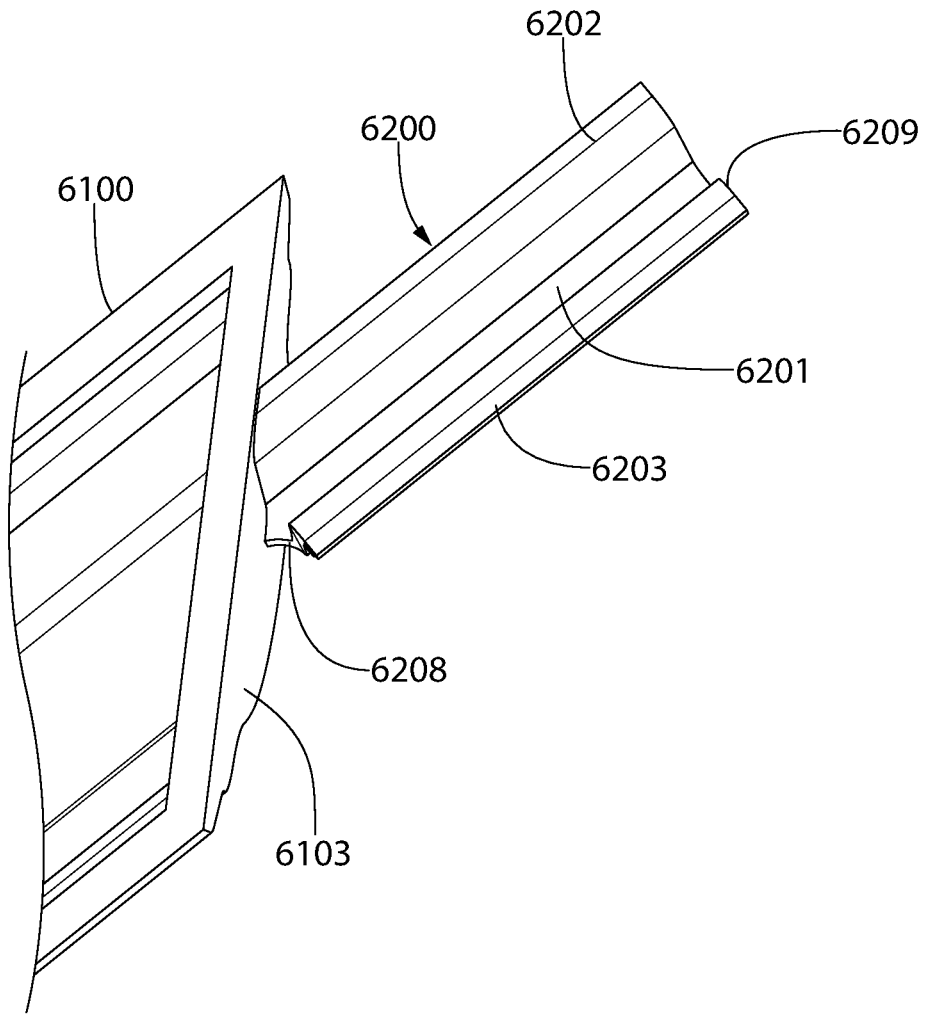
FIG. 33 is a close-up rear perspective view of an end portion of the moulding piece of FIG. 31.

Referring to FIGS. 31-33, a moulding component 6000 is illustrated in accordance with an embodiment of the present invention. The moulding component 6000 is an integral and monolithic structure which comprises a moulding piece 6100 and at least one connector 6200 as a unitary structure. The moulding component 6000 may be formed by injection molding out of a plastic material, including any of the materials described above. The moulding component 6000 is configured to be coupled to another moulding piece, such as the moulding piece 100 described above, via engagement between the engagement features of the moulding piece 100 and engagement features of the connector 6200.

The moulding piece 6100 of the moulding component 6000 comprises an ornamental front surface 6101 and a rear surface 6102. The ornamental front surface 6102 may have any of various different contours and profiles or the like to create a desired aesthetic since the ornamental front surface 6012 will be exposed when the moulding piece 6100 is mounted within an interior space. The moulding piece 6100 comprises a first end surface 6103 and a second end surface 6104. The first and second end surfaces 6103, 6104 may be mitered as with the prior described embodiments. In the exemplified embodiment, the moulding piece 6100 is in the shape of a scalloped corner in that it has two linear sections and an arcuate section between the two linear sections. However, the invention is not to be so limited and the moulding piece 6100 may be linear from the first end surface 6103 to the second end surface 6104 or it may have other shapes, such as being L-shaped to form a square corner, or the like. The moulding piece 6100 may be solid and non-hollow, or it may be hollow, or it may have a channel on its rear surface, with such details about the moulding piece 6100 not being limiting of the invention described herein. Because the connector 6200 is formed integrally with the moulding piece 6100, the moulding piece 6100 does not need to have a channel or other connection features for facilitating coupling of the moulding piece 6100 to the connector 6200 as with the other embodiments.

The moulding component 6000 comprises a first connector 6200 extending from the first end surface 6103 of the moulding piece 6100 and a second connector 6300 extending from the second end surface 6104 of the moulding piece 6100. Each of the first and second connectors 6200, 6300 is formed integrally with the moulding piece 6100 as an integral structure. Moreover, while two connectors 6200, 6300 are included in the exemplified embodiment, in other embodiments the moulding component 6000 may comprise the first connector 6200 but not the second connector 6300. Each of the first and second connectors 6200, 6300 is entirely identical in structure and in its manner of attachment to the moulding piece 6100. Thus, only the first connector 6200 will be described herein in the interest of brevity, it being understood that the description of the second connector 6200 is entirely applicable to the second connector 6300.

In the exemplified embodiment, the first connector 6200 has a similar, if not identical structure to either one of the first and second portions 210, 250 of the connectors 200 described above with reference to FIGS. 5A-5C. The first connector 6200 comprises a U-shaped body 6201 that extends from the first end surface 6103 of the moulding piece 6100 along an axis F-F. The U-shaped body 6201 is elongated along the axis F-F from a first end 6208 to a second end 6209. It should be noted that the linear section of the moulding piece 6100 from which the U-shaped body 6201 of the connector 6200 extends also extends along the axis F-F (that is, the section of the moulding piece 6100 from which the connector 6200 extends and the connector 6200 may be coaxial). The U-shaped body 6201 comprises a first leg 6202 and a second leg 6203. Furthermore, the first connector 6200 comprises an engagement feature 6205. In the exemplified embodiment, the engagement feature 6205 comprises a first protuberance 6206 protruding from the first leg 6202 and a second protuberance 6207 protruding from the second leg 6203. As discussed above, the first connector 6200 is configured to couple to a moulding piece, such as the first moulding piece 100 described above with reference to FIGS. 4A-4C. Thus, in the exemplified embodiment the first and second protuberances 6206, 6207 of the engagement feature 6205 of the first connector 6200 are configured to mate with the first and second grooves 121, 122 of the engagement feature 120 of the moulding piece 100 shown in FIGS. 4A-4C to couple the moulding piece 100 to the moulding piece 6100.

As seen in the figures, the first leg 6202 of the U-shaped body 6201 of the first connector 6200 is attached to the first end surface 6103 of the moulding piece 6100 at the first end 6208 of the U-shaped body 6201. However, the second leg 6203 of the U-shaped body 6201 is not attached to the moulding piece 6100 at all. This is done intentionally in order to enable the second leg 6203 of the U-shaped body 6201 to flex/deflect inwardly during insertion of the U-shaped body of the first connector 6200 into a channel of a moulding piece, such as the channel 110 of the moulding piece 100 described above with reference to FIGS. 4A-4C. That is, because the second leg 6203 is not coupled directly to the moulding piece 6100, the second leg 6203 can freely flex or bend relative to the first leg 6202 which is coupled directly to the moulding piece 6100.

Figure 34:
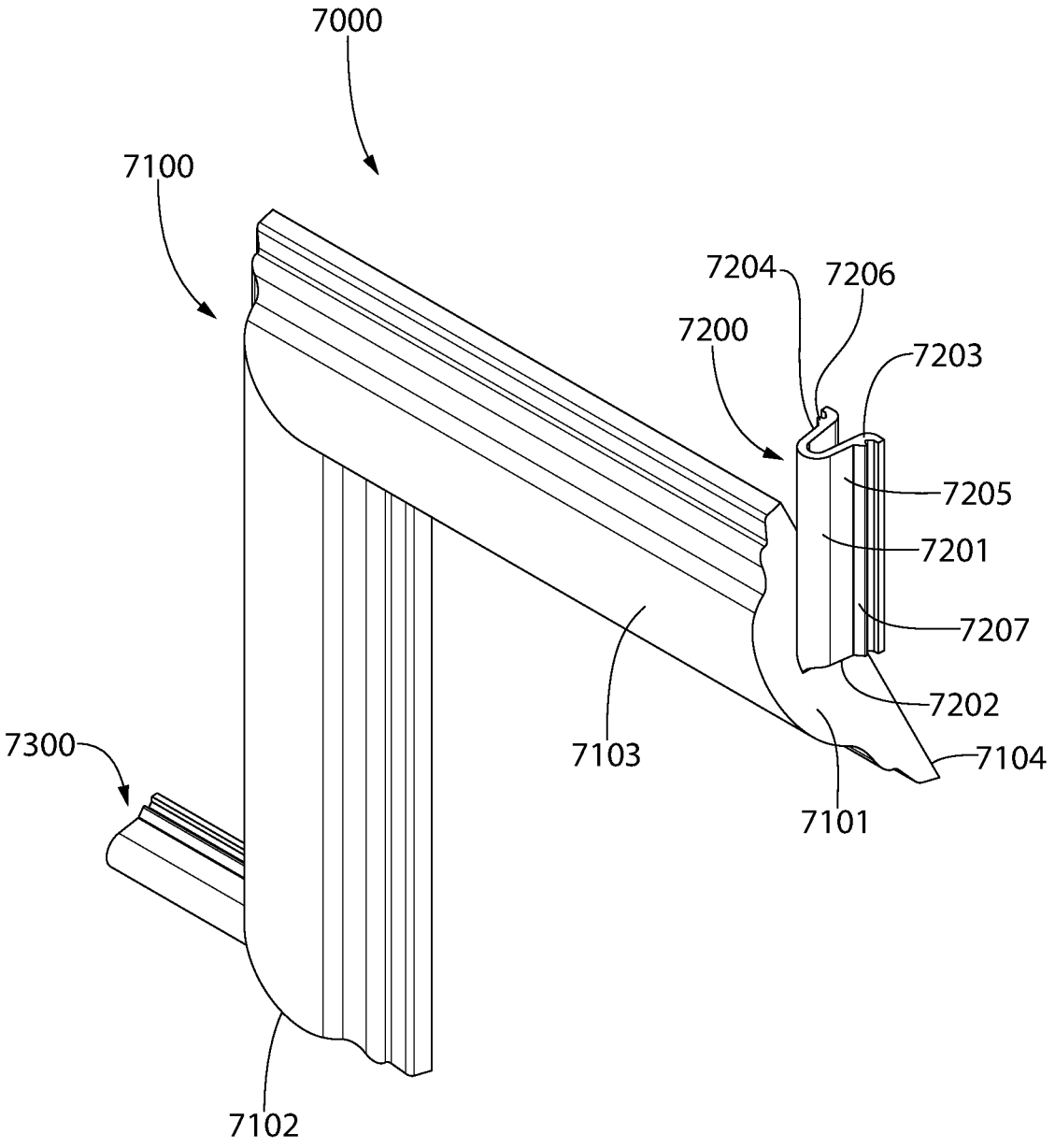
FIG. 34 is a front perspective view of a moulding piece with an integral connector in accordance with an eighth embodiment of the present invention.
Figure 35:
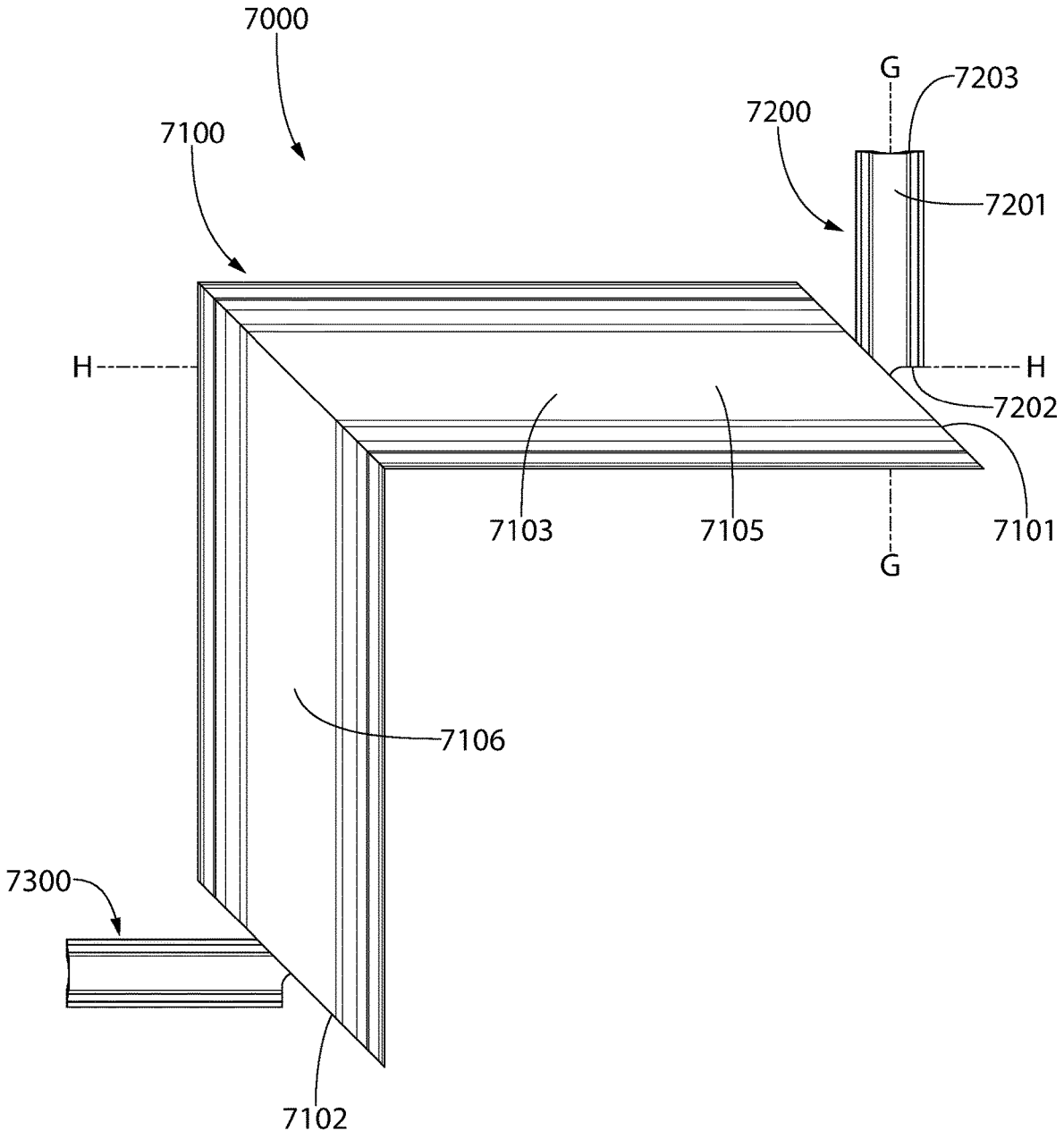
FIG. 35 is a front view of the moulding piece of FIG. 34.

FIGS. 34 and 35 illustrate a moulding component 7000 in accordance with another embodiment of the present invention. The moulding component 7000 comprises a moulding piece 7100 having a first end surface 7101 and a second end surface 7202, a first connector 7200 extending from the first end surface 7101 of the moulding piece 7100, and a second connector 7300 extending from the second end surface 7102 of the moulding piece 7100. The first and second end surfaces 7101, 7102 are mitered ends in the exemplified embodiment. The moulding component 7000 is a monolithic structure which comprises the moulding piece 7100 and the first and second connectors 7200, 7300. Moreover, the moulding component 7000 is identical to the moulding component 6000 described above with reference to FIGS. 31 to 33 except with regard to the shape of the moulding piece 7100.

That is, in this embodiment the moulding piece 7100 is in the shape of a square corner, such that it comprises first and second linear sections 7105, 7106 that are oriented perpendicularly relative to one another. The first linear section 7105 terminates in the first end surface 7101 and the second linear section 7106 terminates in the second end surface 7102. As with the previously described embodiment, the moulding piece 7100 comprises an ornamental front surface 7103 and a non-ornamental rear surface 7104. The moulding piece 7100 may be solid and non-hollow or it may be hollow or it may comprise a channel in its rear surface 7104. However, the connectors 7200, 7300 are integrally formed with the moulding piece 7100 so the connectors 7200, 7300 need not be coupled to the moulding piece 7100 in any subsequent steps. Rather, the connectors 7200, 7300 are merely coupled to a separate moulding piece, such as the moulding piece 100 described above with reference to FIGS. 4A-4C.

The first and second connectors 7200, 7300 are identical. Additional details will be provided for the first connector 7200, it being understood that the second connector 7300 is identical. The first connector 7200 comprises a U-shaped body 7201 that extends from a first end 7202 to a second end 7203 along an axis G-G. In the exemplified embodiment, the first connector 7200 is coupled to the first end surface 7101 of the moulding piece 7100. Furthermore, the first end surface 7101 is part of the first linear section 7105 of the moulding piece 7100. The first linear section 7105 of the moulding piece 7100 extends along an axis H-H. The first connector 7200 extends along the axis G-G, which is perpendicular to the axis H-H along which the first linear section 7105 of the moulding piece 7100 extends. This is slightly different than the prior embodiment, where the connector 6200 extends along an axis that is coaxial with the section of the moulding piece 6100 from which it extends.

The U-shaped body 7201 comprises a first leg 7204 and a second leg 7205. The connector 7200 comprises an engagement feature for mating with the grooves in the moulding piece 100 described above with reference to FIGS. 4A-4C, for example. The engagement feature comprises a first protuberance 7206 protruding from the first leg 7204 and a second protuberance 7207 protruding from the second leg 7205. Similar to the previous embodiment, in this embodiment the first leg 7204 is coupled directly to the end surface 7101 of the moulding piece 7100 at the first end 7202 of the U-shaped body 7201, while the second leg 7205 is not directly attached to the moulding piece 7100. This allows the second leg 7205 to flex/deflect inwardly as the connector 7200 is being inserted into the channel 110 of the moulding piece 100 shown in FIGS. 4A-4C.

Thus, the moulding component 6000 of FIGS. 31-33 and the moulding component 7000 of FIGS. 34 and 35 are configured to be coupled to the moulding pieces 100 of FIGS. 4A-4C. The connectors 6200, 6300, 7200, 7300 have engagement features (protuberances) which are configured to mate with the engagement features (grooves) of the channels 110 of the moulding pieces 100. When full assembled, four of the moulding components 6000 and four of the moulding piece 100 may be coupled together to form a decorative moulding assembly having a shape that is identical to the decorative moulding assembly 2000 of FIGS. 14-16. Furthermore, when fully assembled, four of the moulding components 7000 and four of the moulding pieces 100 may be coupled together to form a decorative moulding assembly having a shape that is identical to the decorative moulding assembly of FIGS. 8-10.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A decorative moulding assembly comprising:

a first moulding piece comprising a first end, a second end, a front surface, and a rear surface, a first channel formed into the rear surface and extending from the first end to the second end, the first channel comprising:

a U-shaped cross-sectional area;

a first axis;

an inner surface that defines the first channel, the inner surface comprising a first portion on a first side of the first axis and a second portion on a second side of the first axis; and a first locking groove formed into the first portion of the inner surface and a second locking groove formed into the second portion of the inner surface, wherein a U-shaped portion of the inner surface that extends between the first and second locking grooves is smooth and free of grooves and protuberances;

a second moulding piece comprising a first end, a second end, a front surface, and a rear surface, a second channel formed into the rear surface and extending from the first end to the second end, the second channel having a U-shaped cross-sectional area; and a connector comprising a first elongated portion and a second elongated portion that intersect in an L-shape, each of the first and second-elongated portion comprising a U-shaped body, wherein the first elongated portion of the connector nests within the first channel of the first moulding piece to couple the connector to the first and second moulding pieces and thereby couple the first and second moulding pieces together and the second elongated portion of the connector nests within the second channel of the second moulding piece.

2. The decorative moulding assembly according to claim 1 wherein the first and second moulding pieces are extruded and wherein the connector is injection molded.

3. The decorative moulding assembly according to claim 1 wherein the first and second ends of each of the first and second moulding pieces are mitered.

4. The decorative moulding assembly according to claim 1 further comprising:

the first axis extending in a direction between the front surface and the rear surface of the first moulding piece, wherein the first elongated portion of the connector is symmetric about a third axis, the first elongated portion of the connector comprising a first leg having an inner surface and an outer surface and a second leg having an inner surface and an outer surface, the inner surfaces of the first and second legs being spaced apart from one another by a third channel, and further comprising a first locking protuberance extending from the outer surface of the first leg and a second locking protuberance extending from the outer surface of the second leg; and wherein the first elongated portion of the connector is snap-fit connected to the first moulding piece such that the first and second locking protuberances of the first elongated portion nest within the first and second locking grooves of the first moulding piece, respectively.

5. The decorative moulding assembly according to claim 4 wherein the first and second legs of the first elongated portion of the connector flex inwardly into the third channel as the first elongated portion of the connector is snap-fit connected to the first moulding piece, the first and second legs of the first elongated portion of the connector biasing back to their natural position upon the first elongated portion of the connector being fully nested within the first channel of the first moulding piece.

6. The decorative moulding assembly according to claim 4 wherein the first leg of the first elongated portion of the connector comprises a distal-most portion that extends outwardly away from the third axis so that a first nesting groove exists between the distal-most portion of the first leg and the first locking protuberance, wherein the second leg of the first elongated portion of the connector comprises a distal-most portion that extends outwardly away from the third axis so that a second nesting groove exists between the distal-most portion of the second leg and the second locking protuberance, wherein the first moulding piece comprises a first tab located on the first portion of the inner surface of the first channel between the first locking groove and the rear surface of the first moulding piece and a second tab located on the second portion of the inner surface of the first channel between the second locking groove and the rear surface of the first moulding piece, the first and second tabs nesting within the first and second nesting grooves of the first and second legs of the first elongated portion of the connector, respectively.

7. The decorative moulding assembly according to claim 1 wherein each of the first and second elongated portions of the connector comprises a first leg and a second leg that are spaced apart from one another, and wherein the first and second legs of the first and second elongated portions of the connector flex inwardly towards one another as the connector is being snap-fit connected to the first and second moulding pieces and bias back to their natural position after being fully inserted into the first and second channels, respectively.

8. A decorative moulding assembly comprising:

a first moulding piece comprising a front surface and a rear surface, a first channel formed into the rear surface, the first channel having a closed top end, an open bottom end, and a first engagement feature;

a second moulding piece comprising a front surface and a rear surface, a second channel formed into the rear surface, the second channel having a closed top end, an open bottom end, and a second engagement feature; and a connector comprising a first elongated portion and a second elongated portion that intersect in an L-shape, the first elongated portion having a U-shaped body comprising first and second legs that are spaced apart from one another by a third channel having a closed top end and an open bottom end and the second elongated portion having a U-shaped body comprising first and second legs that are spaced apart from one another by a fourth channel having a closed top end and an open bottom end, the first elongated portion comprising a third engagement feature and the fourth elongated portion comprising a fourth engagement feature;

wherein the first elongated portion of the connector is snap-fit connected to the first moulding piece by inserting the first elongated portion into the first channel so that the closed top end of the third channel of the first elongated portion of the connector is adjacent to the closed top end of the first channel of the first moulding piece and the open bottom end of the third channel of the first elongated portion of the connector is adjacent to the open bottom end of the first channel of the first moulding piece and the third engagement feature of the first elongated portion of the connector mates with the first engagement feature of the first channel of the first moulding piece; and wherein the second elongated portion of the connector is snap-fit connected to the second moulding piece by inserting the second elongated portion into the second channel so that the closed top end of the fourth channel of the second elongated portion of the connector is adjacent to the closed top end of the second channel of the second moulding piece and the open bottom end of the fourth channel of the second elongated portion of the connector is adjacent to the open bottom end of the second channel of the second moulding piece and the fourth engagement feature of the second elongated portion of the connector mates with the second engagement feature of the second channel of the second moulding piece; and wherein an entirety of the connector is configured to be located within the first and second channels of the first and second moulding pieces such that no portion of the connector protrudes from the open bottom end of the first channel of the first moulding piece or from the open bottom end of the second channel of the second moulding piece when the first and second elongated portions of the connector are snap-fit connected to the first and second moulding pieces, respectively.

9. The decorative moulding assembly according to claim 8 wherein each of the first and second channels comprises an entry section and a nesting section, wherein a distal-most portion of the first elongated portion of the connector nests within the entry section of the first channel without protruding beyond the rear surface of the first moulding piece, and wherein a distal-most portion of the second elongated portion of the connector nests within the entry section of the second channel without protruding beyond the rear surface of the second moulding piece.

10. The decorative moulding assembly according to claim 8 wherein the first engagement feature comprises a first pair of grooves formed into a wall defining the first channel, the second engagement feature comprises a second pair of grooves formed into a wall defining the second channel, the third engagement feature comprises a first protuberance protruding from the first leg of the first elongated portion and a second protuberance protruding from the second leg of the first elongated portion, and the fourth engagement feature comprise a first protuberance protruding from the first leg of the second elongated portion and a second protuberance protruding from the second leg of the second elongated portion, the first and second protuberances on the first and second legs of the first elongated portion nesting within the first pair of grooves in the wall defining the first channel of the first moulding piece and the first and second protuberances on the first and second legs of the second elongated portion nesting within the second pair of grooves in the wall defining the second channel of the second moulding piece to couple the connector to the first and second moulding pieces.

11. A decorative moulding assembly comprising:

a first moulding piece comprising a front surface, a rear surface, and a first channel formed into the rear surface, the first channel extending from an opening in the rear surface of the first moulding piece to a floor of the first channel;

a second moulding piece comprising a front surface, a rear surface, and a second channel formed into the rear surface;

a connector comprising:

a first portion that nests within the first channel of the first moulding piece to couple the connector to the first moulding piece; and a second portion that nests within the second channel of the second moulding piece to couple the connector to the second moulding piece;

wherein the first portion of the connector comprises a U-shaped body comprising a top portion, a first leg extending from the top portion to a first distal end, and a second leg extending from the top portion to a second distal end, the first and second legs spaced apart from one another to define a cavity having an open bottom end located opposite the top portion and between the first and second distal ends of the first and second legs, wherein the first and second legs deflect inwardly towards one another as the first portion of the connector is inserted into the first channel of the first moulding piece;

wherein the first portion of the connector nests within the first channel of the first moulding piece with the top portion of the first portion of the connector adjacent to the floor of the first channel and the open bottom end of the cavity adjacent to the opening in the rear surface of the first moulding piece;

wherein the first channel comprises a first axis that extends in a direction between the front surface and the rear surface of the first moulding piece, the first moulding piece comprising an inner surface that defines the first channel, the inner surface comprising a first portion on a first side of the first axis and a second portion on a second side of the first axis, and further comprising a first locking groove formed into the first portion of the inner surface and a second locking groove formed into the second portion of the inner surface;

wherein the first portion of the connector is symmetric about a third axis, the first leg of the first portion of the connector having an inner surface and an outer surface and the second leg of the first portion of the connector having an inner surface and an outer surface, and further comprising a first locking protuberance extending from the outer surface of the first leg and a second locking protuberance extending from the outer surface of the second leg; and wherein the first portion of the connector is snap-fit connected to the first moulding piece such that the first and second locking protuberances of the first portion nest within the first and second locking grooves of the first moulding piece, respectively.

12. The decorative moulding assembly according to claim 11 wherein the second portion of the connector comprises a U-shaped body comprising first and second legs that deflect inwardly towards one another as the second portion of the connector is being inserted into the second channel of the second moulding piece, the first and second portions of the connector having an identical shape and structure, wherein the first portion of the connector is snap-fit connected to the first moulding piece such that the first and second legs of the first portion of the connector bias back into their natural position upon the first portion of the connector being fully inserted into the first channel of the first moulding piece, and wherein the second portion of the connector is snap-fit connected to the second moulding piece such that the first and second legs of the second portion of the connector bias back into their natural position upon the second portion of the connector being fully inserted into the second channel of the second moulding piece.

13. The decorative moulding assembly according to claim 11 wherein the first leg of the first portion of the connector comprises a distal-most portion that extends outwardly away from the third axis so that a first nesting groove exists between the distal-most portion of the first leg and the first locking protuberance, wherein the second leg of the first portion of the connector comprises a distal-most portion that extends outwardly away from the third axis so that a second nesting groove exists between the distal-most portion of the second leg and the second locking protuberance, wherein the first moulding piece comprises a first tab located on the first portion of the inner surface of the first channel between the first locking groove and the rear surface of the first moulding piece and a second tab located on the second portion of the inner surface of the first channel between the second locking groove and the rear surface of the first moulding piece, the first and second tabs nesting within the first and second nesting grooves of the first and second legs of the first portion of the connector, respectively.

14. The decorative moulding assembly according to claim 13 wherein the first channel of the first moulding piece comprises an entry section that is adjacent to the rear surface of the first moulding piece and a nesting section that extends from the entry section to the floor of the first channel, and wherein the distal-most portions of the first and second legs of the first portion of the connector nest within the entry section of the first channel and a remainder of the first elongated portion of the connector nests within the nesting section of the channel.

15. The decorative moulding assembly according to claim 11 wherein the first channel of the first moulding piece comprises a first engagement feature, the first engagement feature comprising one or more grooves, and wherein the first portion of the connector comprises a third engagement feature, the third engagement feature comprising one or more protuberances that extend from an outer surface of the U-shaped body and nest within the one or more grooves to lockingly couple the connector to the first moulding piece.

16. The decorative moulding assembly according to claim 11 wherein the second channel of the second moulding piece comprises a second engagement feature, the second engagement feature comprising one or more grooves, and wherein the second portion of the connector comprises a U-shaped body and a fourth engagement feature, the fourth engagement feature comprising one or more protuberances that extend from an outer surface of the U-shaped body and nest within the one or more grooves to lockingly couple the connector to the second moulding piece.

* * * * *